US006176814B1

(12) United States Patent
Ryan et al.

(10) Patent No.: US 6,176,814 B1
(45) Date of Patent: Jan. 23, 2001

(54) CROSS TRAINING EXERCISE APPARATUS

(75) Inventors: Allen L. Ryan, Chicago, IL (US); Paul W. Eschenbach, Moore, SC (US); Steven M. Lenz, Naperville, IL (US); Clifford F. Mueller, Palatine, IL (US); Gary E. Oglesby, Manhattan, IL (US); Charles J. Rosenow, Carol Stream, IL (US); Mark C. Termion, Winfield, IL (US)

(73) Assignee: Brunswick Corporation, Lake Forest, IL (US)

( * ) Notice: Under 35 U.S.C. 154(b), the term of this patent shall be extended for 0 days.

This patent is subject to a terminal disclaimer.

(21) Appl. No.: 08/871,381

(22) Filed: Jun. 9, 1997

Related U.S. Application Data

(63) Continuation-in-part of application No. 08/814,487, filed on Mar. 10, 1997, which is a continuation-in-part of application No. 08/644,854, filed on Jun. 17, 1996.

(51) Int. Cl.[7] ..... A63B 22/00; A63B 22/04
(52) U.S. Cl. ..... 482/51; 482/52
(58) Field of Search ..... 482/51, 52, 57, 482/70, 62, 79, 80

(56) References Cited

U.S. PATENT DOCUMENTS

| | | | |
|---|---|---|---|
| 3,432,164 | | 3/1969 | Deeks . |
| 4,900,013 | | 2/1990 | Rodgers, Jr. . |
| 5,242,343 | | 9/1993 | Miller . |
| 5,290,211 | | 3/1994 | Stearns . |
| 5,299,993 | | 4/1994 | Habing . |
| 5,423,729 | | 6/1995 | Eschenbach . |
| 5,433,680 | | 7/1995 | Knudsen . |
| 5,435,801 | * | 7/1995 | Hung ..... 482/52 X |
| 5,518,473 | | 5/1996 | Miller . |
| 5,527,246 | * | 6/1996 | Rodgers ..... 482/57 |
| 5,529,555 | * | 6/1996 | Rodgers, Jr. ..... 482/52 X |
| 5,540,637 | | 7/1996 | Rodgers, Jr. . |
| 5,562,574 | * | 10/1996 | Miller . |
| 5,573,480 | | 11/1996 | Rodgers, Jr. . |
| 5,577,985 | | 11/1996 | Miller . |

(List continued on next page.)

*Primary Examiner*—Mickey Yu
*Assistant Examiner*—Denise Pothier
(74) *Attorney, Agent, or Firm*—Michael B. McMurry; Kathleen A. Ryan

(57) ABSTRACT

An exercise apparatus includes a frame that is adapted for placement on the floor, a pivot axis supported by the frame, a pedal bar which has first and second ends, a pedal that is secured to the pedal bar, an ellipse generator, and a track. The ellipse generator is secured to both the pivot axis and to the first end of the pedal bar such that the first end of said pedal bar moves in an elliptical path around the pivot axis. The track is secured to the frame and engages the second end of said pedal bar such that the second end moves in a linear reciprocating path as the first end of the pedal bar moves in the elliptical path around said pivot axis. Consequently, the pedal also moves in a generally elliptical path. As the pedal moves in its elliptical path, the angular orientation of the pedal, relative to a fixed, horizontal plane, such as the floor, varies in a manner that simulates a natural heel to toe flexure. The apparatus can also include a resistance member, a data input member, and a control member. The resistance member applies a resistive force to the pedal. The data input means permits the user to input control signals. The control means responds to the input control member to control the resistance member and apply a braking force to the pedal. In addition, the exercise apparatus can include an arm handle and an arm handle coupling member that couples the arm handle to the pedal such that the arm handle moves in synchronism with the pedal.

23 Claims, 37 Drawing Sheets

U.S. PATENT DOCUMENTS

| | | | | |
|---|---|---|---|---|
| 5,593,372 | | 1/1997 | Rodgers, Jr. . | |
| 5,653,662 | | 8/1997 | Rodgers, Jr. . | |
| 5,685,804 | | 11/1997 | Whan-Tong et al. . | |
| 5,707,321 | | 1/1998 | Maresh . | |
| 5,743,834 | | 4/1998 | Rodgers, Jr. . | |
| 5,746,683 | * | 5/1998 | Lee . | |
| 5,755,642 | | 5/1998 | Miller . | |
| 5,759,136 | | 6/1998 | Chen . | |
| 5,762,588 | | 6/1998 | Chen . | |
| 5,766,113 | | 6/1998 | Rodgers, Jr. . | |
| 5,772,558 | | 6/1998 | Rodgers, Jr. . | |
| 5,779,598 | | 7/1998 | Lee . | |
| 5,779,599 | | 7/1998 | Chen . | |
| 5,782,722 | | 7/1998 | Sands et al. . | |
| 5,788,609 | | 8/1998 | Miller . | |
| 5,792,026 | * | 8/1998 | Maresh et al. | 482/57 X |
| 5,899,833 | * | 5/1999 | Ryan et al. | 482/4 X |
| 5,947,872 | * | 9/1999 | Ryan et al. | 482/52 X |
| 5,957,814 | * | 9/1999 | Eschenbach | 482/51 |

* cited by examiner

570'
498'
608'
600
592'
606
610'
596'
612'
584'
580
578'
576'
574'
604'
572'
590'
602'
42
598'
582
616'
44
614'
572
510'
498
600
608
382'
606
596
590
574
604
578
576
584
610
612
602
501
580
592
598
570

CROSS TRAINING EXERCISE APPARATUS

This application is a continuation in part of application Ser. No. 08/814,487, filed Mar. 10, 1997, pending, which was a continuation in part of application Ser. No. 08/644,854, filed Jun. 17, 1996, pending.

FIELD OF THE INVENTION

This invention relates generally to exercise equipment and more particularly to exercise equipment which can be used to exercise the upper body and the lower body of the user.

BACKGROUND OF THE INVENTION

There are a number of different types of exercise apparatus that exercise a user's lower body by providing a circuitous stepping motion. These orbital stepping apparatuses provide advantages over other types of exercise apparatuses. For example, the orbital stepping motion generally does not jar the user's joints as can occur when a treadmill is used. In addition, orbital stepping apparatuses exercise the user's lower body to a greater extent than, for example, cycling-type exercise apparatuses or skiing-type exercise apparatuses. Examples of orbital stepping apparatuses include U.S. Pat. Nos. 3,316,898, 5,242,343, and 5,279,529, and German Patent No. DE 2,919,494.

However, known orbital stepping exercise apparatuses suffer from various drawbacks. For example, some apparatuses are limited to exercising the user's lower body and do not provide exercise for the user's upper body. In addition, the orbital stepping motion of some apparatuses produces an un-natural heel to toe flexure that reduces exercise efficiency. Moreover, known orbital stepping exercise apparatuses are limited in the extent to which the user can achieve a variety of exercise experiences. Consequently, boredom ensues and the user may lose interest in using the orbital stepping exercise apparatuses. A need therefore exists for an improved orbital stepping exercise apparatus.

SUMMARY OF THE INVENTION

It is therefore an object of the invention to provide an orbital stepping exercise apparatus that exercises the user's lower and upper body.

Another object of the invention is to provide an orbital stepping exercise apparatus that simulates a natural heel to toe flexure and thereby promotes exercise efficiency.

Another object of the invention is to provide an orbital stepping exercise apparatus that can be used in a multiplicity of modes by an individual user.

Another object of the invention is to provide an orbital stepping apparatus that can be tailored to the individual needs and desires of different users.

These and other objectives and advantages are provided by the present invention which is directed to an exercise apparatus that can be employed by a user to exercise the user's upper and lower body. The exercise apparatus includes a frame that is adapted for placement on the floor, a pivot axis supported by the frame, a pedal bar which has first and second ends, a pedal that is secured to the pedal bar, an ellipse generator, and a track. The ellipse generator is secured to both the pivot axis and to the first end of the pedal bar such that the first end of said pedal bar moves in an elliptical path around the pivot axis. The track is secured to the frame and engages the second end of said pedal bar such that the second end moves in a linear reciprocating path as the first end of the pedal bar moves in the elliptical path around said pivot axis. Consequently, the pedal also moves in a generally elliptical path. As the pedal moves in its elliptical path, the angular orientation of the pedal, relative to a fixed, horizontal plane, such as the floor, varies in a manner that simulates a natural heel to toe flexure.

A second embodiment of the invention includes a frame, a pivot axis that is supported by the frame, a pedal lever, a coupler, a guide member, a pedal that has a toe portion and a heel portion, and a coupling member. The coupler pivotally couples a first end of the pedal lever to the pivot axis at a predetermined distance from the pivot axis such that the first end of the pedal lever moves in an arcuate pathway around the pivot axis. The guide member is supported by the frame and engages a second end of the pedal lever such that the second end of the pedal lever moves in a reciprocating pathway as the first end moves in the arcuate pathway. The coupling member couples the pedal with the second end of the pedal lever such that the toe portion is intermediate the heel portion and such that the heel portion is raised above the toe portion when the second end of the pedal lever moves in the reciprocating pathway away from the pivot axis. The angular orientation of the pedal thus varies in a manner that simulates a natural heel to toes flexure.

A third embodiment of the invention includes a frame, a pivot axis that is supported by the frame, a track, a coupling assembly, a pedal assembly, and a pedal tie. The coupling assembly supports the track near a first end thereof, on the pivot axis at a first predetermined distance from the pivot axis, such that the first end of the track moves in a vertically reciprocating arcuate path relative to the pivot axis. The pedal assembly includes a pedal that slidably engages a second end of the track. A first end of the pedal tie is secured to the coupling assembly at a second predetermined distance from the pivot axis. A second end of the pedal tie is secured to the pedal assembly such that the pedal moves in a linear reciprocating path along the track as the first end of the track moves in the vertically reciprocating arcuate path. As the pedal moves, the angular orientation of the pedal varies in a manner that simulates a natural heel to toe flexure.

All three embodiments of the invention can be used in either a forward stepping mode or in a backward stepping mode. All three embodiments of the invention can also include a resistance member, a data input member, and a control member. The resistance member applies a resistive force to the pedal. The data input means permits the user to input control signals. The control means responds to the input control member to control the resistance member and apply a braking force to the pedal. The user can thus control the amount of resistance offered by the pedal and so can vary the degree of effort required to move the pedal. The invention thus can accommodate the individual needs and desires of different users. In addition, all three embodiments of the invention can include an arm handle and an arm handle coupling member that couples the arm handle to the pedal such that the arm handle moves in synchronism with the pedal. The invention thus can be employed by the user to exercise the user's upper and lower body.

BRIEF DESCRIPTION OF THE DRAWINGS

FIG. 13 is a graph of the percentage of time that the field control signal is enabled vs. the RPM signal when the exercise apparatus in FIG. 1 is used with the pace mode on;

DETAILED DESCRIFFION

Figure 1:
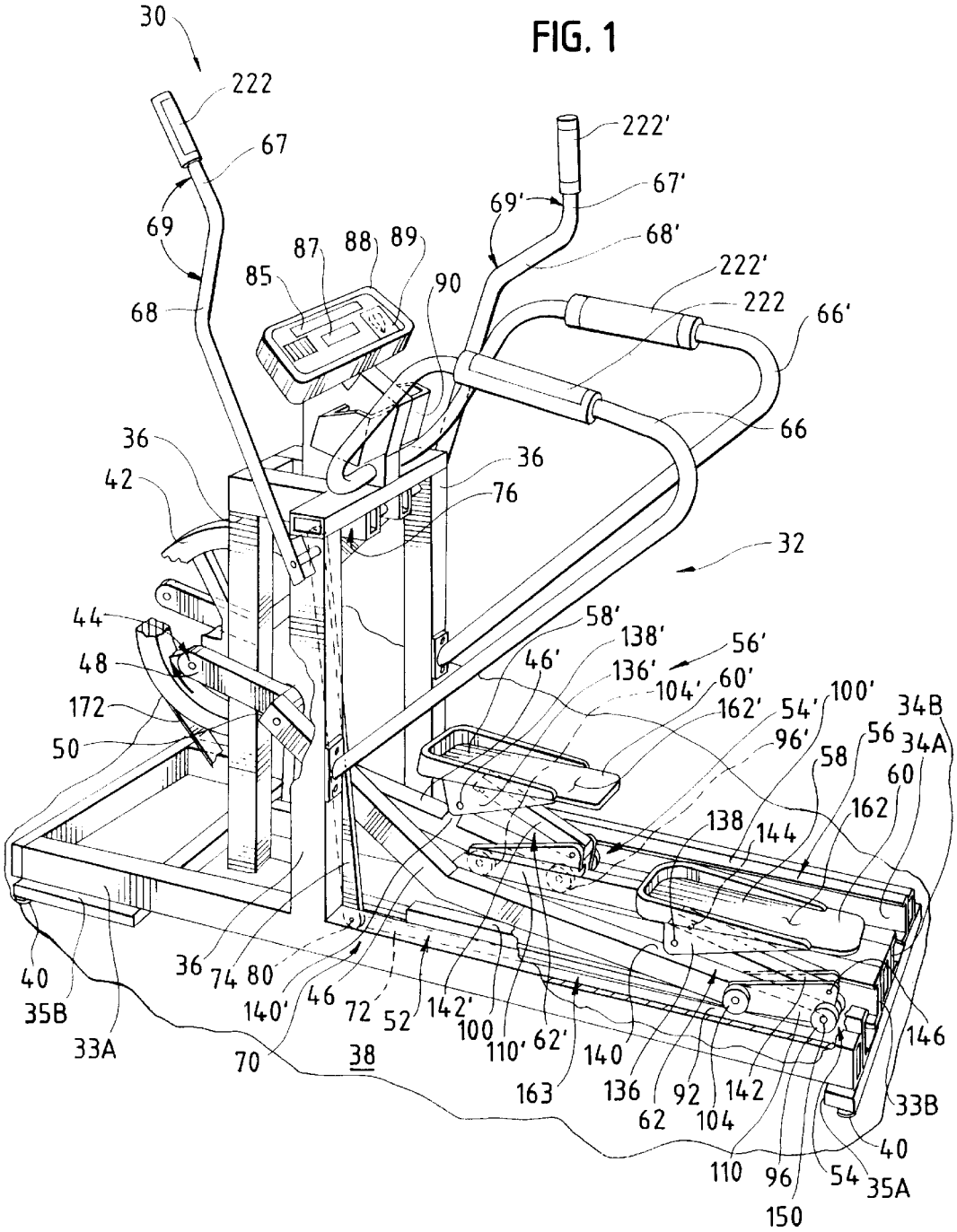
FIG. 1 is partially cut-away side perspective view of a first embodiment of an exercise apparatus according to the invention.

I. Overview Of Mechanical Aspects Of The Invention

A primary objective of the present invention is to provide an orbital stepping exercise apparatus in which the pedal follows a substantially elliptical pathway in such a manner so as to simulate the natural foot weight distribution and flexure associated with a natural walking or running gait while at the same time providing a synchronized mechanism for upper body exercise. The present invention implements three different pedal actuation assemblies for providing this pedal motion. In addition, each of these pedal actuation assemblies can be connected to an arm handle assembly to provide an upper body workout.

The first pedal actuation assembly utilizes a pedal lever connected at one end to a pulley crank arm and the other end of the pedal lever reciprocates on a horizontal track. The desired foot motion is accomplished by mounting a foot pedal on the pedal lever using a four bar linkage.

The second pedal actuation assembly achieves the desired foot motion by utilizing a roller mounted on a pulley crank arm to periodically lift one end of a track vertically. The other end of the track is pivotally attached to the frame. A pedal assembly is mounted on the track and is reciprocated by a pedal tie member which is also attached to the crank arm thereby producing the desired foot motion.

The third pedal actuation assembly uses a pedal bar which has one end that reciprocates horizontally in a track and has a second other end which is coupled to a pulley by elliptical motion generator. A foot pedal mounted on the pedal bar produces the desired foot motion.

This invention is thus directed to three general embodiments of an exercise apparatus in which the foot pedal follows a substantially elliptical pathway and moves in a manner that simulates the natural weight distribution and flexure of a foot associate with the normal human walking or running gait. It should be understood, however, that the mechanisms as described can be modified within the scope of the invention to produce other types of foot motion. The first general embodiment is discussed with reference to FIGS. 1–14. The second general embodiment is discussed with reference to FIGS. 15–26. The third general embodiment, which is the preferred embodiment of the invention is discussed with reference to FIGS. 27–39D.

Throughout all of the various embodiments and Figures, like reference numbers denote like components. In addition, the pedalling mechanism of the invention is symmetrical and includes a left portion and a right portion. The following detailed description of all three general embodiments is directed to the components of the left portion, although it is to be understood that the right portion includes like components that operate in a like fashion. In the Figures, the components of the right portion are referenced with prime numbers that correspond to the reference numbers used for the components of the left portion.

II. Detailed Description The First General Embodiment

FIGS. 1, 2, 7, and 8 show a first embodiment 30 of an exercise apparatus according to the invention. As noted earlier, this embodiment 30 includes the first type of pedal actuation assembly to provide the desired elliptical motion. This embodiment 30, as well as all the various embodiments described herein, include motion controlling components which operate in conjunction with the pedal actuation assembly and other motion generating components to provide a pleasurable exercise experience for the user. The motion generating components of the apparatus 30, including the pedal actuation assembly, are described with reference to FIGS. 1–10 and the motion controlling components are discussed in detail with reference to FIGS. 11–14.

A. Motion Generating Components of the First General Embodiment.

The apparatus 30 includes a frame, shown generally at 32, which includes vertical support member 36 and longitudinal support members 33A, B, 34A, 334B that are secured to cross members 35A and 35B. The cross members 35A and 35B are configured for placement on a floor 38. Levelers 40 are provided so that if the floor 38 is uneven, the cross members 35A and 35B can be raised or lowered such that the cross members 35A and 35B and the longitudinal support members 33A, B, 34A, 34B are substantially level. The apparatus further includes a pulley 42 supported an axle that serves as a pivot axis 44 which in turn is by the frame 32. In the preferred embodiment the pulley 42 is supported by pillow block bearings (not shown) which are attached to and extend from the vertical support members 36 to the pivot axis 44.

The pedalling mechanism of the apparatus 30 includes a pedal lever 46 that is coupled to the pivot axis 44 by a coupler 48 that maintains a first end 50 of the pedal lever 46 at a predetermined distance from the pivot axis 44 so that the first end 50 moves in a circular pathway 51 (shown in FIGS. 9A–9F) around the pivot axis 44 when the pulley 42 rotates. In the preferred embodiment, coupler 48 is a bell crank. The frame 32 supports a guide member, shown generally at 52, that engages a second end 54 of the pedal lever 46 so that the second end 54 moves in a reciprocating linear pathway 53, (shown in FIGS. 9A–9F) as the first end 50 moves in the circular pathway 51 around the pivot axis 44.

The exercise apparatus 30 further includes a pedal 56 that includes a toe portion 58 and a heel portion 60 and a linkage assembly 62 that links the pedal 56 to the pedal lever 46 so that the toe portion 58 is intermediate the heel portion 60 and the pivot axis 44. As is explained in more detail below in reference to FIGS. 7–10, the linkage assembly 62 links the pedal 56 to the pedal lever 46 so that the desired foot weight distribution and flexure are achieved when the pedal 56 travels in a substantially elliptical pathway 64 (shown in FIG. 10) as the first end 50 of the pedal lever 46 travels in the circular pathway 51 (shown in FIGS. 9A–9F) around the pivot axis 44. In the preferred embodiment, the first end 50 can move in two ways in the circular pathway 51 around the pivot axis. First, the first end 50 can move counterclockwise in the circular pathway 51, as seen from the user's left side. When the first end 50 travels counterclockwise in the circular pathway 51, the pedal 56 travels in a direction along the elliptical pathway 64 that simulates a forward-stepping motion. In the forward-stepping mode, as the pedal 56 moves in the elliptical pathway 64, the heel portion 60 is lowered below the toe portion 58 when the second end 54 of the pedal lever moves in the reciprocating linear pathway 53 in a direction towards the pivot axis 44. Second, the first end 50 can move clockwise in the circular pathway, as seen from the user's left side. When the first end 50 travels clockwise in the circular pathway 51, the pedal 56 travels in a direction along the elliptical pathway 64 that simulates a backward-stepping motion. In the backward-stepping mode, as the pedal 56 moves in the elliptical pathway 64, the heel portion 60 is raised above the toe portion 58 when the second end 54 of the pedal lever moves in the reciprocating linear pathway 53 in a direction towards the pivot axis 44.

In the preferred embodiment, the exercise apparatus 30 also includes a handrail 66 and an arm 68. The handrail 66 is rigidly secured to the frame 32. In contrast, the arm 68 is coupled to the pedal lever 46 by a coupling assembly, shown generally at 70, so that the arm 68 moves toward the second end 54 of the pedal lever 46 when the second end 54 of the pedal lever 46 moves in the reciprocating linear pathway 53 towards the pivot axis 44. Specifically, the coupling assembly 70 includes a first arm link 72, a second arm link 74 and a shaft 76. The first arm link 72 is coupled with the pedal lever 46 at a pivot point 78 (shown in FIG. 3) located near the second end 54 of the pedal lever 46. The second arm link 74 is coupled with the first arm link 72 at a second pivot point 80 and is rigidly secured to the shaft 76. The shaft 76 is rotatably supported by the vertical support members 36 and is in turn rigidly secured to the arm 68. As a result, when the second end 54 of the pedal lever 46 moves towards the pivot axis 44, the first arm link 72 also moves toward the pivot axis 44 causing the second pivot point 80 to move toward the pivot axis 44. In turn, this causes the shaft 76 to rotate in a clock-wise direction as seen in FIG. 1, so that the arm 68 moves rearward towards the second end 54 of the pedal lever 46. In the reverse direction, as the second end 54 of the pedal lever 46 moves away from the pivot axis 44, the first arm link 72 and the second arm link 74 act on the shaft 76 so that the shaft 76 rotates in a generally counterclockwise direction as seen in FIG. 1. Consequently, the arm 68 moves towards the pivot axis 44 and away from the second end 54 of the pedal lever 46. In the preferred embodiment, a hand grip 67 is rigidly secured to the arm 68 at a predetermined angle 69 which is chosen to promote ergonomic efficiency.

As noted earlier, the exercise apparatus 30 also includes the resistive force and control components, including an alternator 82 (shown in FIG. 7) and a transmission 84 (shown in FIGS. 7 and 8) that includes the pulley 42, which operate in conjunction with the motion generating components. As is explained in more detail in reference to FIGS. 11–14, the alternator 82 provides a resistive force that is transmitted to the pedal 56 and to the arm 68 through the transmission 84. The alternator 82 thus acts as a brake to apply a resistive force to the movement of the pedal 56 and of the arm 68. Alternatively, a resistive force can be provided by any suitable component, for example, by an eddy current brake, a friction brake, a band brake, or a hydraulic braking system. In the preferred embodiment, the resistive force control components of the exercise apparatus 30 include a microprocessor 86 (shown in FIG. 11) housed within a console 88. The console 88 includes a message center 85, a display panel 87 to display information to the user and a data input center 89 which accepts data from the user. The microprocessor 86 is operatively coupled to both the data input center 89 and the resistance component, such as the alternator 82, and in the preferred embodiment the microprocessor 86 is a Motorola HC-11. Data provided by the user thus can be used to change the resistive force provided by the resistive component 82 through the interaction of the microprocessor 86 and the resistive component 82. The microprocessor 86, the message center 85, the display panel 87, and the data input center 89 are discussed in more detail with reference to FIGS. 11 and 12. The exercise apparatus 30 can also include an accessory tray 90 for storing various items, such as a water bottle.

Figure 3:
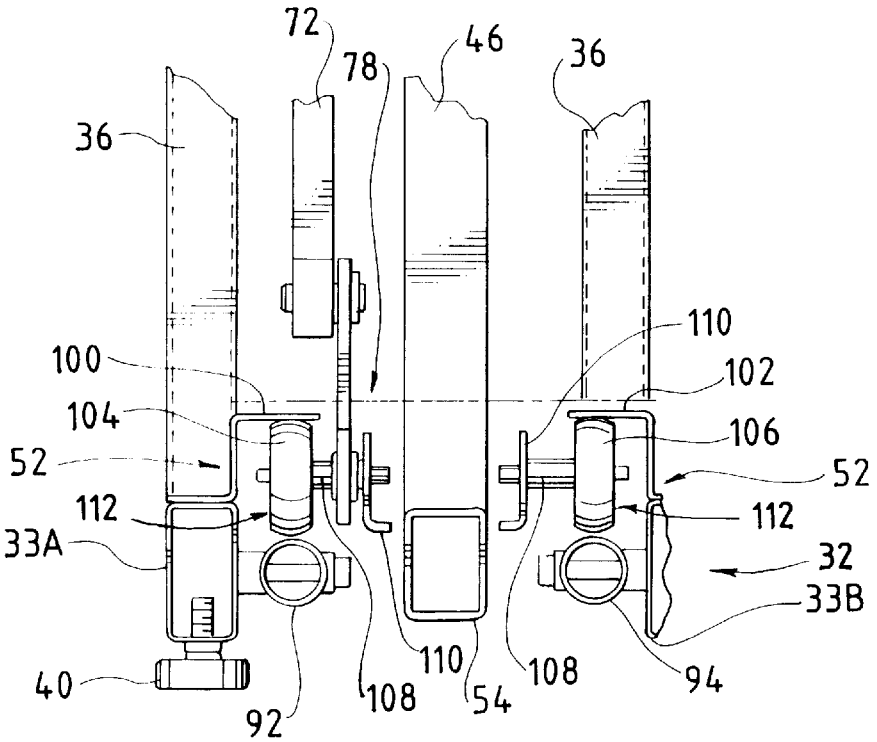
FIG. 3 is a partial cross section along line 3—3 in FIG. 2.
Figure 4:
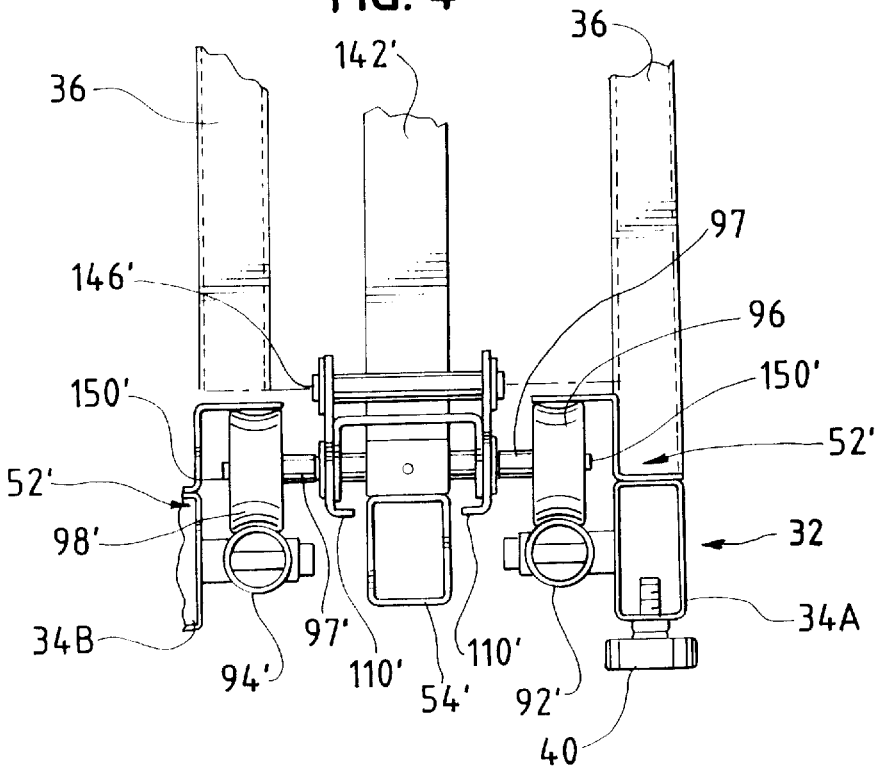
FIG. 4 is a partial cross section along line 4—4 in FIG. 2.

FIGS. 3 and 4 show one embodiment of the guide member 52 which includes longitudinal tracks 92 and 94 that are secured to the frame 32 and are configured to support the second end 54 of the pedal lever 46. The longitudinal tracks 92 and 94 preferably are secured to the longitudinal support members 33A, B. Consequently, the longitudinal tracks 92 and 94 are substantially level. Rollers 96 and 98 rest on the longitudinal tracks 92 and 94 and are secured to the pedal lever 46 by an axle 97 that passes through the pedal lever 46. Upper longitudinal tracks 100 and 102 are secured to the frame 32 above the lower longitudinal tracks 92 and 94 and are aligned with the lower longitudinal tracks 92 and 94. Consequently, each vertical pair of longitudinal tracks, for example 92 and 100 or 94 and 102, engages one of the rollers 96 and 98. This dual track system provides greater lateral stability to the pedal 56 than would a single track system. A second set of rollers 104 and 106 is generally aligned with and located in front of the first set of rollers 96 and 98. The rollers 104 and 106 are supported on axles 108 that are carried by pedal carriages 110. The pedal carriages 110 are also pivotally secured to the axle 97. The rollers 96 and 98 and the pedal carriages 110, along with the rollers 104 and 106, together form a slider assembly 112 that cooperates with the longitudinal tracks 92, 94, 100, and 102 to direct the second end 54 of the pedal lever 46 in the generally level reciprocating linear pathway 53 (shown in FIGS. 9A–9F).

When the pedal lever 46 moves in the reciprocating linear pathway 53, the load carried by the first set of rollers 96 and 98 differs from that carried by the second set of rollers 104 and 106. Specifically, the first set of rollers 96 and 98 tend to carry a downwardly directed load and so travel primarily on the lower longitudinal tracks 92 and 94. In contrast, the reciprocating movement of the second end 54 of the pedal lever 46 tends to pull up on the second set of rollers 104 and 106 which consequently tend to ride primarily on the upper longitudinal tracks 100 and 102. In the preferred embodiment, the tracks 92 and 94 and the rollers 96, 98, 104, and 106 are configured to exploit the different load requirements. Specifically, the lower longitudinal tracks 92 and 94 are tubular and the first set of rollers 96 and 98 are concave. The arcuate cross-section of the lower longitudinal tracks 92 and 94 help to prevent accumulations of dirt and debris that could lead to excessive wear. The concave configuration of the rollers 96 and 98 in turn promotes lateral stability of the pedal lever 46 on the longitudinal tracks. The rollers 104 and 106, which ride primarily on the upper longitudinal tracks 100 and 102, preferably are convex.

Figure 5:
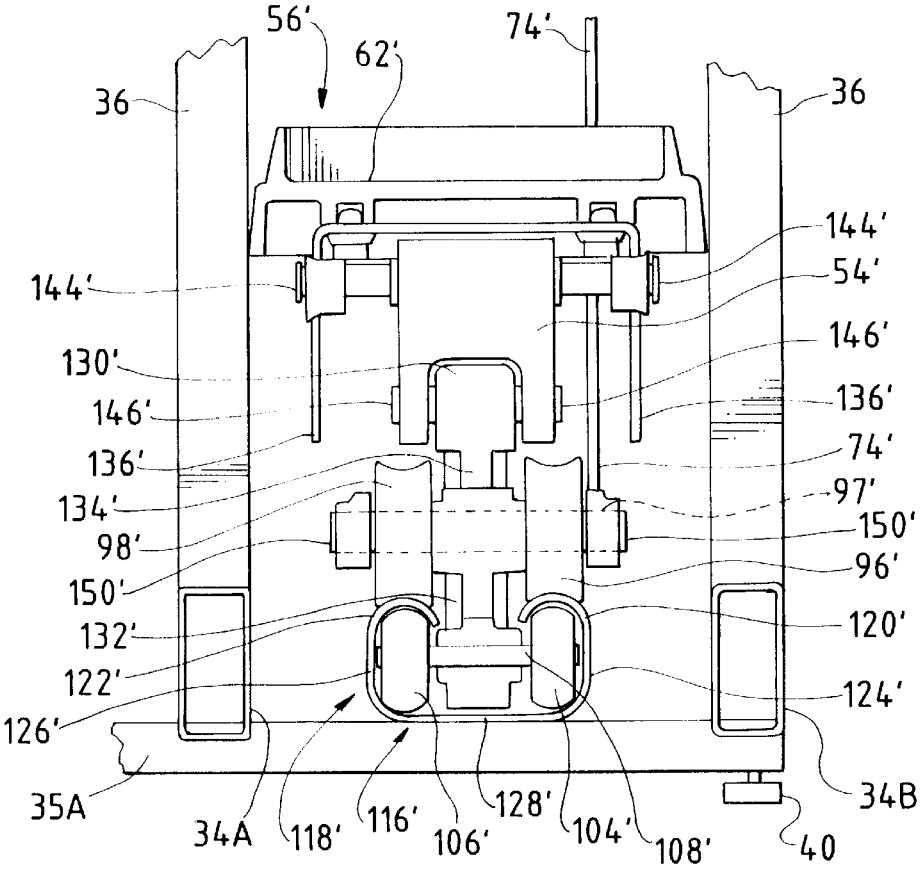
FIG. 5 is the same view as FIG. 4 and shows the preferred embodiment of the guide member and the slider assembly which are parts of the exercise apparatus of FIG. 1.
Figure 6:
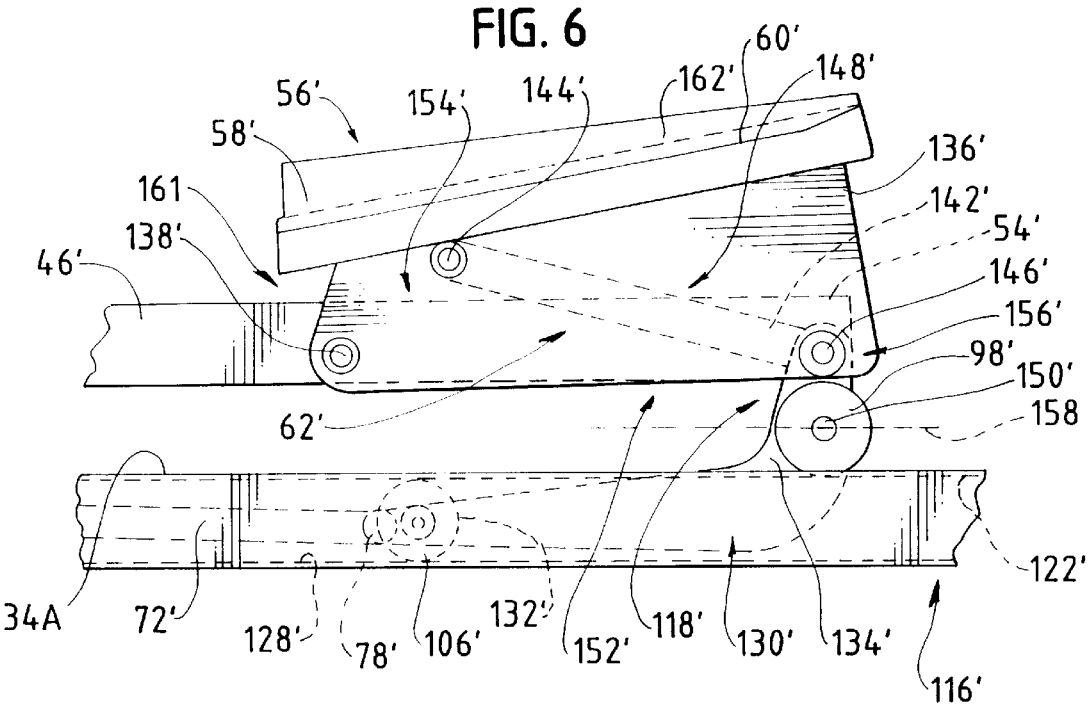
FIG. 6 is a stylized partial side view of the pedal, guide member, and slider assembly shown in FIG. 5.

FIGS. 5 and 6 show the preferred embodiment of the guide member 116 and the preferred embodiment of the slider assembly 118. The guide member 116 includes arcuate longitudinal tracks 120 and 122 that are secured by side members 124 and 126 to a lower longitudinal track 128. The lower longitudinal track 128 is secured to the cross members 35A and 35B (not shown). Consequently, the upper longitudinal tracks 120 and 122 and the lower longitudinal track 128 are substantially level. The concave rollers 96 and 98 of the slider assembly 118 are positioned on the arcuate longitudinal tracks 120 and 122. The convex roller 104 of the slider assembly 118 is 50 128 and the convex roller 106 of the slider assembly 118 is positioned between the arcuate longitudinal track 122 and the lower longitudinal track 128. The slider assembly 118 also includes a pedal carriage 130 that has a lower member 132 to which the convex rollers 104 and 106 are rotatably secured via the axle 108, as best seen in FIG. 6. The concave rollers 96 and 98 are rotatably secured via the axle 97 to a second member 134 which extends upwardly from the lower member 132. The lower member 132 extends longitudinally from the upper member 134 so that the convex rollers 104 and 106 are positioned below the pedal 56 and in front of the concave rollers 96 and 98. As with the slider assembly 112, the rollers 96 and 98 of the slider assembly 118 provide lateral stability for the pedal 56 and the front convex rollers 104 and 106 of the slider assembly 118 provide vertical stability for the pedal 56.

Figure 7:
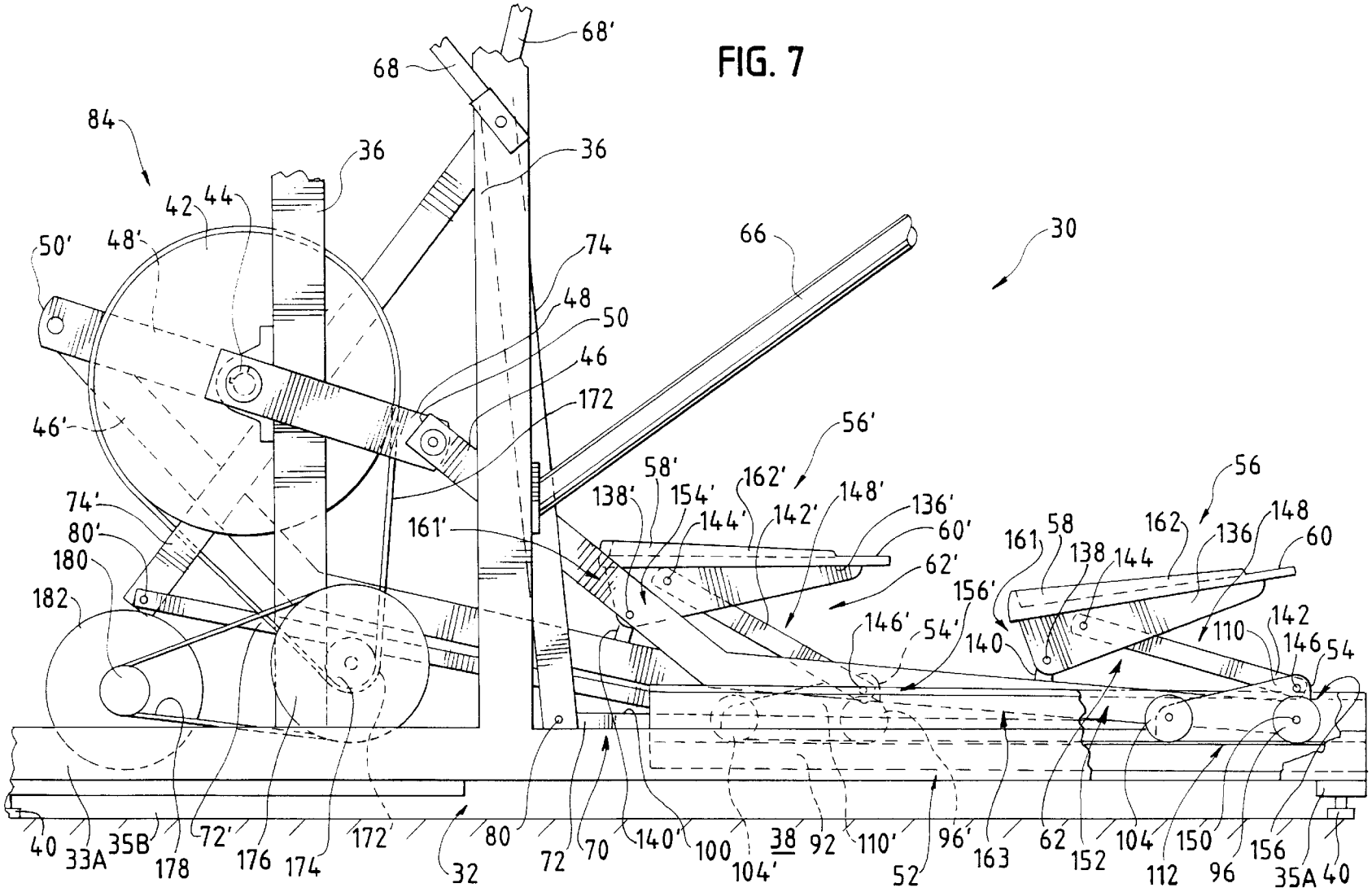
FIG. 7 is a partially cut-away side perspective view of the exercise apparatus in FIG. 1 showing the relative placement of the pedals at one point in the reciprocating path of the second end of the pedal lever which form parts of the exercise apparatus shown in FIG. 1.
Figure 8:
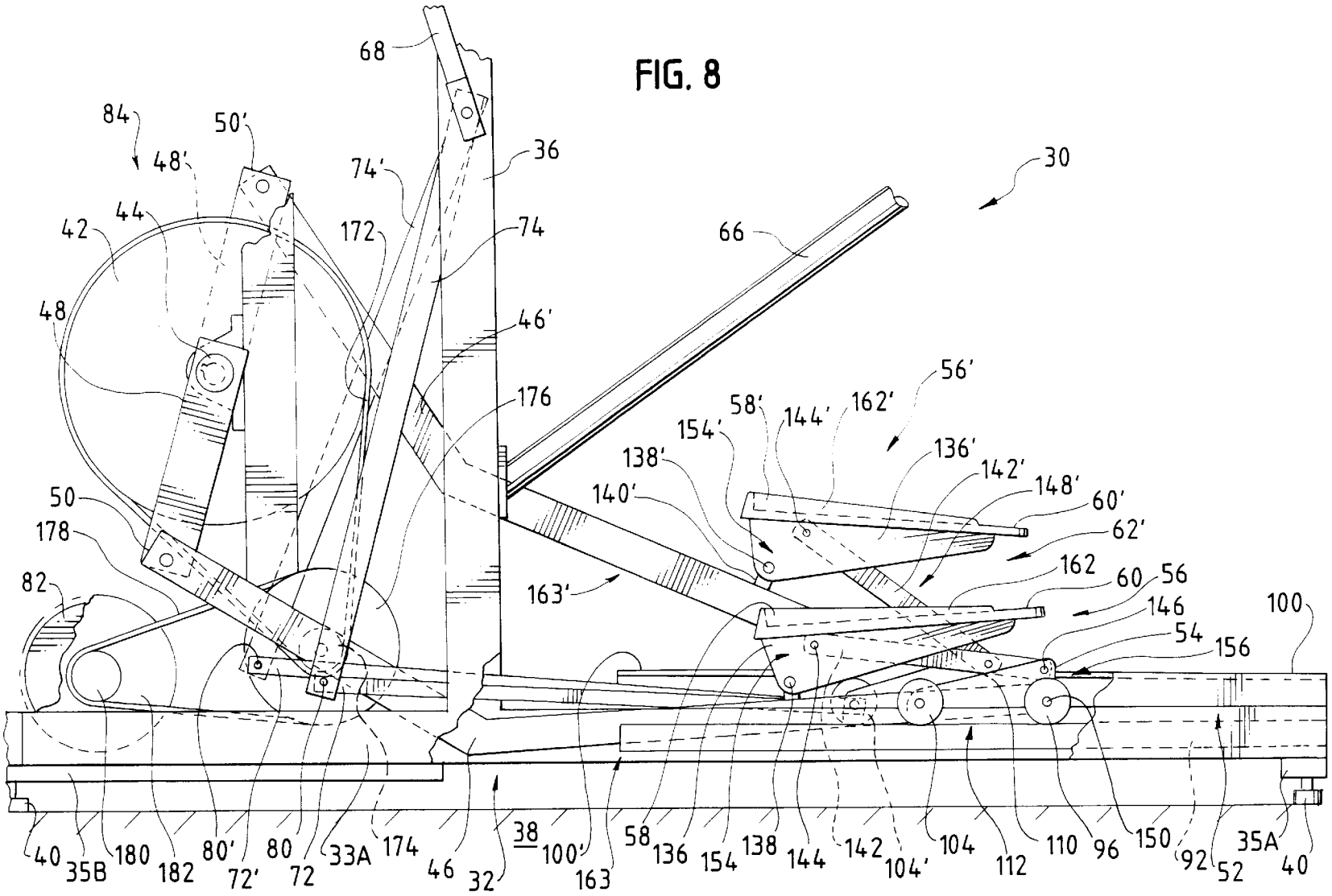
FIG. 8 is a partially cut-away side perspective view of the exercise apparatus in FIG. 1 showing the relative placement of the pedals at a second point in the reciprocating pathway of the second end of the pedal lever.

Turning now to FIGS. 6–8, the apparatus 30 further includes a vertical member 136 that is coupled to the pedal lever 46 at a first pivot point 138. As shown in FIG. 6, the vertical member 136 preferably is coupled directly to the pedal lever 46 at the first pivot point 138. Alternatively, as shown in FIGS. 7 and 8 a link arm 140 extends from the pedal lever 46 and the vertical member 136 is pivotally secured to the link arm 140 at the first pivot point 138. The linkage assembly 62 includes a pedal link 142 that links the pedal 56 to the pedal lever 46. The pedal link 142 is pivotally secured to the vertical member 136 at a second pivot point 144 that is located near the first pivot point 138. The pedal arm 142 is also pivotally coupled with the pedal lever 46 at a third pivot point 146 located on the pedal carriages 110 and 130. The location of the second pivot point 144 and the third pivot point 146 define a first link 148 therebetween. The axle 97 of the slider assembly 112 or 118 defines a pivotal slider point 150 and together with the first pivot point 138 define a second link 152 therebetween. A third link 154 is defined by the distance between the first pivot point 138 and the second pivot point 144, and a fourth link 156 is defined by the distance between the third pivot point 146 and the slider point 150. The pedal 56 is rigidly secured to the vertical member 136 by any suitable securing means, for example, by welding, riveting or bolting.

The vertical member 136, the pedal link 142, and the pedal carriage 110 or 118, together with the pivot points 138, 144, and 146 and the slider point 150, thus define a four-bar linkage that determines the movement of the pedal 56 relative to a horizontal surface, such as the horizontal plane 158 (shown in FIGS. 6 and 9A–9F) that contains the slider point 150. For example, if the first link 148 and the second link 152 are of equal length and the third link 154 and the fourth link 156 are of equal length, the angle 160 (shown in FIGS. 9A–9F) between the top surface 162 of the pedal 56 and the horizontal plane 158 will not change as the second end 54 of the pedal lever 46 moves in the reciprocating linear pathway 53 (shown in FIGS. 9A–9F). In the preferred embodiment, however, the angle 160 varies in order to simulate a natural heel to toe flexure. Consequently, in the preferred embodiment the lengths of the first link 148 and the second link 152 are unequal and are chosen such that the angular displacement of the top surface 162 of the pedal 56, relative to the horizontal plane 158, simulates a natural heel to toe flexure as the second end 54 of the pedal lever 46 moves in the reciprocating linear pathway 53. Specifically, in the preferred embodiment the length of the first link 148 is 9.5 inches, the length of the second link 152 is 12 inches, the length of the third link 154 is 3.5 inches and the length of the fourth link 156 is 2 inches. These predetermined lengths result in the angular displacement of the top surface 162 relative to the horizontal plane 158 shown in FIGS. 9A–9F.

Taken together, the linkage assembly 62, including the pedal link 142, the pedal carriage 110 or 130, and the vertical member 136 define a pedal assembly 161 that couples the pedal 56 to the pedal lever 46 intermediate the first and second ends 50 and 54 of the pedal lever 46, so that the pedal 56 moves in the substantially elliptical path 64 as the pulley 42 rotates. In addition, the pedal lever 46, the coupler 48, the slider assembly 112 or 118, the fixed tracks 92, 94, 100, and 102 or the fixed tracks 120, 122, and 128, and the pedal assembly 161 together define the pedal actuation assembly 163 of the apparatus 30. The contributions of the components of the pedal actuation assembly 163 to the desired elliptical motion are now explained generally with reference to FIGS. 9A–9F and 10. As the pulley 42 rotates on the pivot axis 44, the first end 50 of the pedal lever 46 moves in the generally circular path 51 due to the coupling between the pivot axis 44, the coupler 48 and the first end 50 of the pedal lever 46. The second end 54 of the pedal lever 46, however, is constrained to move in a linear fashion, due to the interaction between the second end 50, the slider assembly 112 or 118, and the fixed tracks 92, 94, 100, and 102 or the fixed tracks 120, 122, and 128. Consequently, as the first end 50 of the pedal lever 46 moves in the circular path 51, the second end 54 of the pedal lever 46 moves along the fixed tracks 92, 94, 100, and 102 or the fixed tracks 120, 122, and 128 in the reciprocating linear path 53. The translation from the circular motion of the first end 50 of the pedal lever 46 to the reciprocating linear motion of the second end 54 of the pedal lever 46 provides a substantially elliptical motion intermediate the first end 50 and the second end 54. Consequently, the pedal 56, which is coupled to the pedal lever 46 intermediate the first and second ends 50 and 54 by the pedal assembly 161 moves in the substantially elliptical path 64 shown in FIG. 10. The horizontal dimension of the elliptical path 64 is determined by the diameter of the circular path 51. The vertical dimension of the elliptical path 64 is determined by the exact location of the pedal 56 between the first and second ends 50 and 54 of the pedal lever 46. Specifically, the motion of the pedal 56 approaches a more circular motion the closer the pedal 56 is to the first end 50 of the pedal lever 46 and the motion of the pedal 56 approaches a more linear motion the closer the pedal 56 is to the second end 54 of the pedal lever 46. Consequently, the height of the elliptical path 64 can be changes by changing the location of the pedal 56 along the pedal lever 46.

In addition to coupling the pedal 56 to the pedal lever 46 intermediate the first and second ends 50 and 54 so that the pedal 56 moves in the substantially elliptical path 64 as the pulley 42 rotates, the pedal assembly 161 also provides the desired weight distribution and flexure. The movement of the pedal 56, which is determined by the components of the pedal actuation assembly 163, is now discussed in detail with reference to FIGS. 9A–9F and 10. FIGS. 9A–9F show the movement of the pedal 56 as the pedal 56 completes one forward-stepping revolution along the elliptical path 64, beginning at the rearmost position on the reciprocating linear path 53 of the second end 54 of the pedal lever 54. The second end 54 of the pedal lever 46 can be moved in two modes that simulate a forward-stepping motion and a backward-stepping motion, respectively. When the second end 54 is moved in the forward-stepping mode, the second end 54 travels sequentially through the positions shown in FIGS. 9A–9F. When the second end 54 is moved in the backward-stepping mode, the sequence is reversed so that the pedal 56 moves from the position shown in FIG. 9A toward the position shown in FIG. 9F.

Figure 9A:
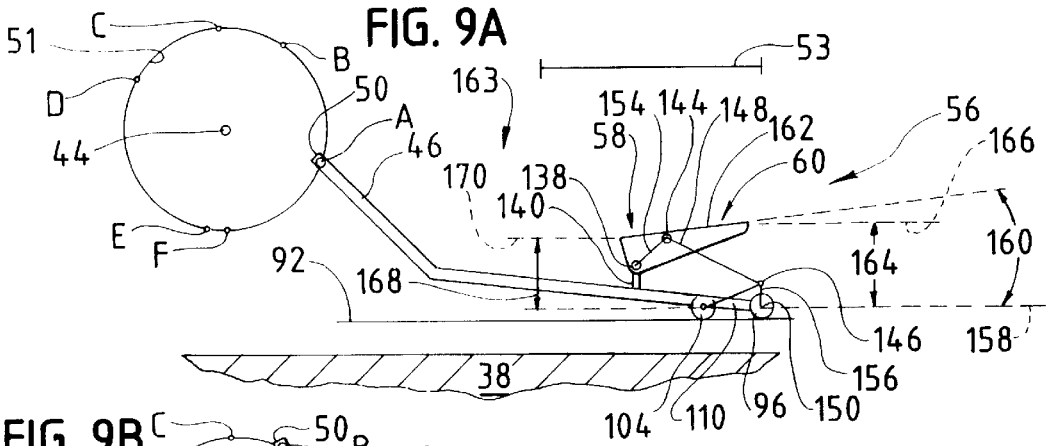
FIGS. 9A–9F are schematic representations of the reciprocating pathway of the second end of the pedal lever.
Figure 9B:
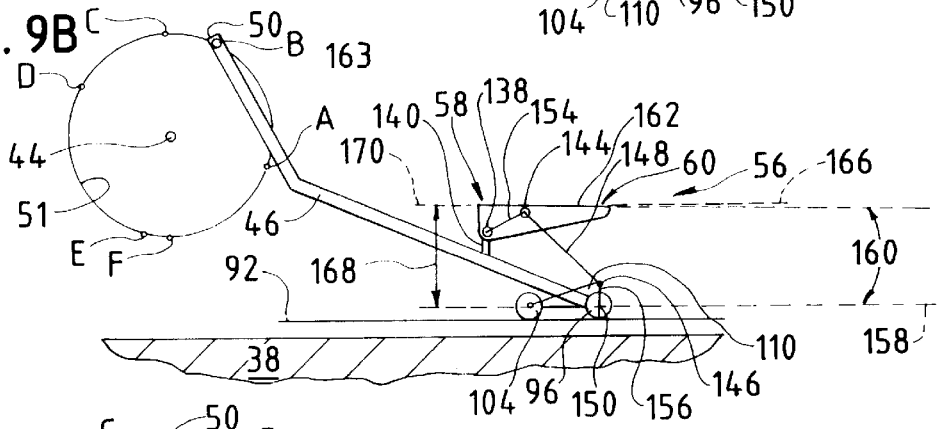

In FIG. 9A, the second end 54 of the pedal lever 46 is at the rearmost position in the reciprocating linear pathway 53. In this position, the angular displacement of the top surface 162 relative to the horizontal plane 158 preferably is positive and so the heel portion 60 is elevated above the toe portion 58. If the previously described lengths of the links 148, 152, 154, and 156 are used, the displacement angle 160 of the top surface 162 is +6.0°. In addition, the distance 164 between the plane 158 and a horizontal plane 166 that intersects the heel portion 60 of the pedal 56 is 7.68 inches and the distance between the plane 158 and a horizonal plane 170 that intersects the toe portion 58 is 6.29 inches. Referring to FIG. 7, the pedal 56 corresponding to the user's left foot is approximately located at the position shown in FIG. 9A. In FIG. 9B, the first end 50 of the pedal lever 46 has moved in the circular arcuate pathway 51 from position A to position B. Concurrently, the second end 54 of the pedal lever 46 has moved toward the pivot axis 44. As the second end 54 moves toward the pivot axis 44 when the second end 54 is manipulated in the forward-stepping mode, the angular displacement of the top surface 162 preferably becomes negative so that the heel portion 60 is lowered below the toe portion 58. If the previously described lengths of the links 148, 152, 154, and 156 are used, the displacement angle 160 of the top surface 162 at this position is 2.37°.

Figure 9C:
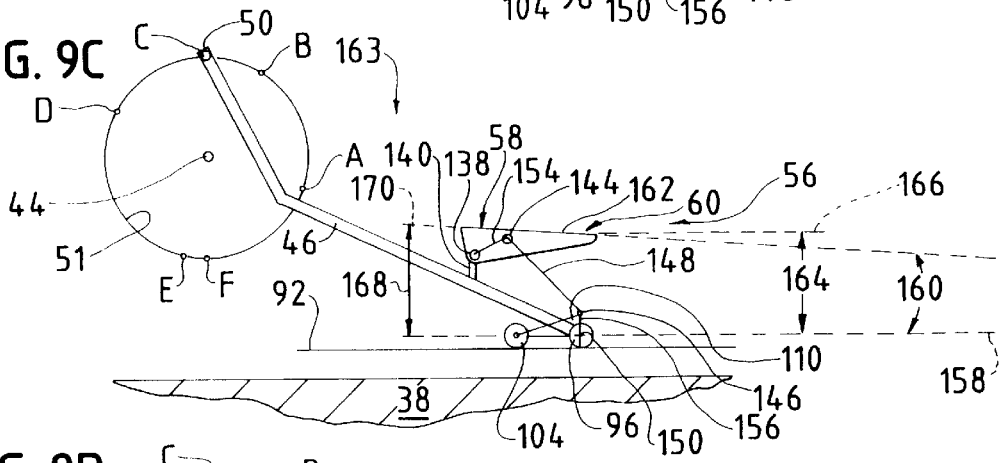
Figure 9D:
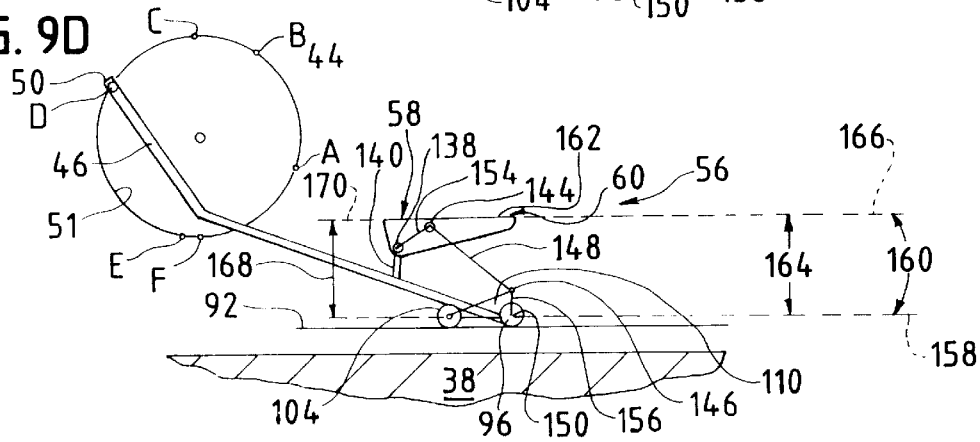
Figure 9E:
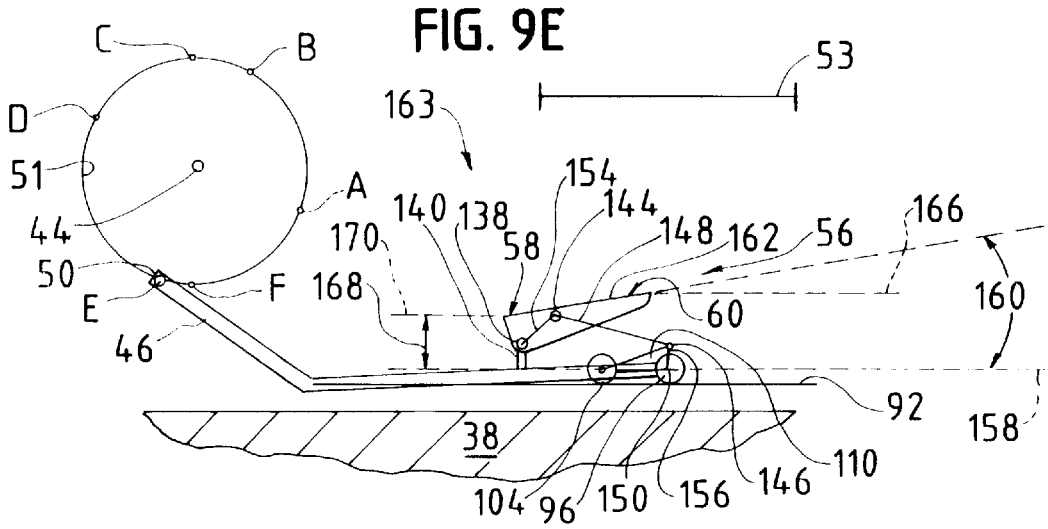
Figure 9F:
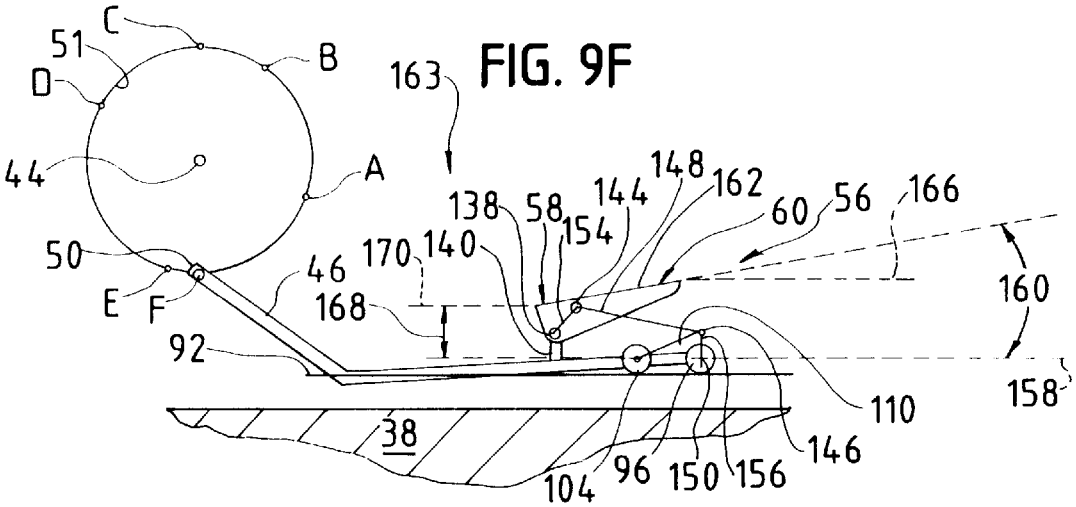

In addition the distance 164 between the horizontal heel plane 166 and the plane 158 is 9.03 inches and the distance 168 between the horizontal toe plane 170 and the plane 158 is 9.57 inches. Referring to FIG. 8, the pedal 56' corresponding to the user's right foot is approximately located in the position shown in FIG. 9B. As the first end 50 continues in the circular pathway 51 from position B to position C, the heel portion 60 is lowered even further below the toe portion 58. At this position, shown in FIG. 9C, the second end 54 has traveled about two-thirds of the distance in the reciprocating linear pathway 53 towards the pivot axis 44. If the previously described lengths of the links 148, 152, 154, and 156 are used, the displacement angle 160 of the top surface 162 at this position is 3.46°. In addition, the distance 164 between the horizontal heel plane 166 and the plane 158 is 9.1 inches and the distance 168 between the horizontal toe plane 170 and the plane 158 is 9.91 inches. In FIG. 9D, the second end 54 of the pedal lever 46 has moved to the front-most position in the reciprocating linear pathway 53, concurrent with the movement of the first end 50 in the circular pathway 51 from position C to position D. At this location, the angular displacement of the top surface 162 preferably is about zero so that the top surface 162 is substantially level. If the previously described lengths of the links 148, 152, 154, and 156 are used, the displacement angle 160 of the top surface 162 at this position is +0.90°. Additionally, the distance 164 between the horizontal heel plane 166 and the plane 158 is 8.67 inches and the distance 168 between the horizontal toe plane 170 and the plane 158 is 8.47 inches. Referring to FIG. 7, the pedal 56' corresponding to the user's right foot is approximately located in the position shown in FIG. 9D. In FIGS. 9E and 9F, the second end 54 of the pedal lever 46 moves in the reciprocating linear pathway 53 away from the pivot axis 44. As the second end 54 is manipulated in the forward-stepping mode and travels away from the pivot axis 44, the angular displacement of the top surface 162 preferably is positive so that the heel portion 60 is elevated above the toe portion 58. If the previously described lengths of the links 148, 152, 154, and 156 are used, the displacement angle 160 of the top surface 162 is +9.23° at a location that is about one-third the path away from the pivot axis 44, as shown in FIG. 9E. In addition, the distance 164 between the horizontal heel plane 166 and the plane 158 is 6.62 inches and the distance 168 between the horizontal toe plane 170 and the plane 158 is 4.49 inches. Referring to FIG. 8, the pedal 56 corresponding to the user's left foot is approximately located in the position shown in FIG. 9E. If the previously described lengths of the links 148, 152, 154, and 156 are used, the displacement angle 160 of the top surface 162 is +9.39° when the second end 54 has traveled about two-thirds of the way in the reciprocating linear pathway 53 away from the pivot axis 44, as shown in FIG. 9F. In addition, the distance 164 between the horizontal heel plane 166 and the plane 158 is 6.55 inches and the distance 168 between the horizontal toe plane 170 and the plane 158 is 4.39 inches. Thus, when the second end 54 is manipulated in the forward-stepping mode, the heel portion 60 is lowered below the toe portion 58 as the second end 54 moves toward the pivot axis 44, as shown in FIGS. 9A–9C, and the heel portion 60 is raised above the toe portion 58 as the second end 54 moves away from the pivot axis 44, as shown in FIGS. 9D–9F.

When the second end 54 is manipulated in the backward-stepping mode, the sequence of positions of the second end 54 is reversed relative to the sequence followed when the second end 54 is manipulated in the forward-stepping mode. Starting again at the rearmost position shown in FIG. 9A, as the second end 54 moves toward the pivot axis 44, the first end 50 moves in the circular path 51 from position A to position F to position E and finally to position D. Concurrently, position of the second end 54 and the pedal 56 changes from that shown in FIG. 9A to those shown in FIGS. 9F–9D, respectively. Consequently, when the second end 54 is manipulated in the backward-stepping mode, the heel portion 60 is raised above the toe portion 60 as the second end 54 moves toward the pivot axis 44. When the first end 50 continues in the circular path 51 from position D to position C on to position B and finally back to position A, the position of the second end 54 changes from that shown in FIG. 9D to those shown in FIGS. 9C–9A, respectively. Thus, as the second end 54 moves away from the pivot axis 44 the heel portion 60 is raised above the toe portion 58 when the second end is manipulated in the backward-stepping mode.

Figure 10:
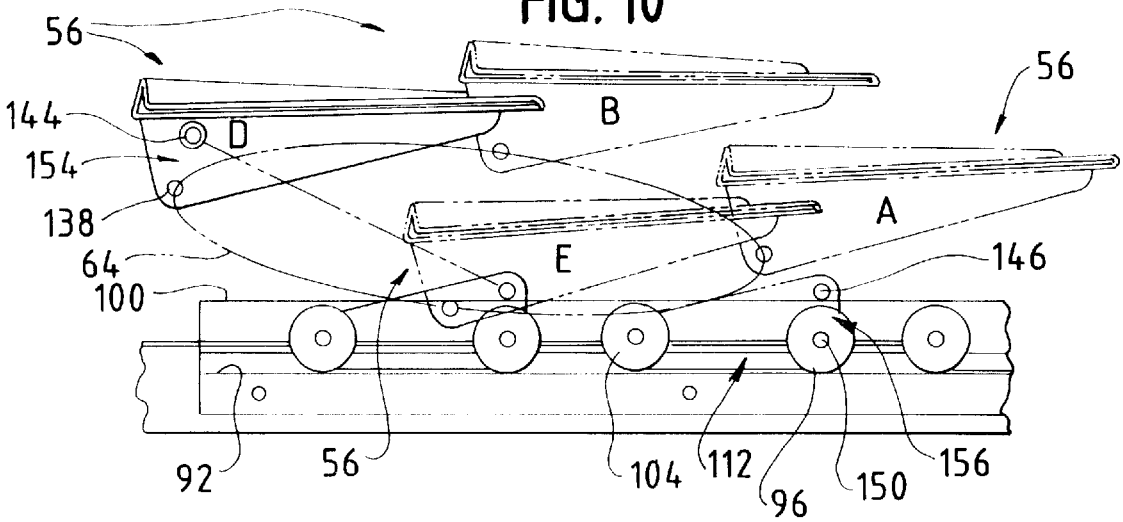
FIG. 10 is an illustration of the elliptical pathway traced by the pedal as the second end of the pedal lever completes the reciprocating path of travel shown in FIGS. 9A–9F.

FIG. 10 traces the elliptical path 64 that the pedal 56 follows as the second end 54 of the pedal lever 46 completes the reciprocating linear pathway 53 shown in FIGS. 9A–9F. When the second end 54 of the pedal lever 46 is at the rearmost position in the reciprocating linear pathway 53, as shown in FIG. 9A, the pedal 56 is positioned at a longitudinal edge position on the elliptical path 64. This position corresponds to the pedal 56 located at position A in FIG. 10. When the second end 54 of the pedal lever 46 is manipulated in the forward-stepping mode, as the second end 54 of the pedal lever 46 moves forward, toward the pivot axis 44, the pedal 56 moves upwardly along the elliptical path 64. Thus, for example, when the pedal lever 46 is in the position shown in FIG. 9B, the pedal 56 is approximately located at the position labeled B in FIG. 8. Conversely, when the second end 54 is manipulated in the backward-stepping mode, the pedal 56 moves along the elliptical path 64 from position A in FIG. 10 to position E in FIG. 10. The position labeled D in FIG. 10 indicates the location of the pedal 56 on the elliptical path 64 when the second end 54 of the pedal lever 46 is at the front-most position in the reciprocating path, as shown in FIG. 9D. When the second end 54 of the pedal lever 46 is manipulated in the forward-stepping mode, as the second end 54 of the pedal lever 46 moves rearward, away from the pivot axis 44, the pedal 56 moves downwardly along the elliptical path 64. For example, when the pedal lever 46 is at the position shown in FIG. 9E, the pedal 56 is approximately located at the position labeled E in FIG. 10. In contrast, when the second end 54 is manipulated in the backward-stepping mode, the location of the pedal 56 along the elliptical path 64 changes from position D to position B as the second end 54 moves away from the pivot axis 44.

In the preferred implementation of this embodiment, as the pedal 56 moves along the elliptical path 64 the uneven four-bar linkage defined by the pivot points 138, 144, and 146, the slider point 150, the pedal arm 142, and a portion of the pedal lever 46 thus permits the angular displacement of the top surface 162 of the pedal 56, relative to the horizontal plane 158, to vary in order to simulate a natural heel to toe flexure. In the forward-stepping mode, as illustrated as a counterclockwise rotation 64 in FIG. 10, the pedal 56 moves upward along the elliptical path 64, for example, from a position A to a position B, and concurrently the heel portion 60 is lowered below the toe portion 58, as shown in FIGS. 9B and 9C. By lowering the heel portion 60 below the toe portion 58, the user's weight is distributed in a manner similar to that which occurs when the user begins a non-assisted forward-stepping motion. In the second part of the forward-stepping mode, the pedal 56 moves downward along the elliptical path 64, for example, to position E in FIG. 10, and concurrently the heel portion 60 is elevated above the toe portion, as shown in FIGS. 9D and 9E. Consequently, the user's weight is shifted to the toe portion 58 as it would be if the user were completing a non-assisted forward-stepping motion. Conversely, in the backward-stepping mode the heel portion 60 is raised above the toe portion 58 as the second 54' end of the pedal lever 46 moves toward the pivot axis 44 and the pedal moves from position A in FIG. 10 to position E in FIG. 10. Thus, in the first half of the backward-stepping mode, the user's weight is shifted to the toe portion 58 as it would be if the user were beginning a non-assisted backward step. Moreover, in the backward-stepping mode the heel portion 60 is lowered below the toe portion 58 as the second end 54 of the pedal lever 46 moves away from the pivot axis 44 and the pedal 56 moves from position D in FIG. 10 to position B in FIG. 10. Thus, in the second half of the backward-stepping mode, the user's weight is shifted to the heel portion 60 as it would be if the user were completing a non-assisted backward step.

The exercise apparatus 30 thus provides an elliptical stepping motion that simulates a natural heel to toe flexure. Consequently, the apparatus 30 minimizes stresses due to un-natural flexures, thereby enhancing exercise efficiency and promoting a pleasurable exercise experience. In addition, if the moving arm 68 is used, the apparatus 30 promotes exercise of the user's total body. As noted in the earlier discussion of FIGS. 1 and 2, the arm 68 is linked to the pedal lever 46 by the coupling assembly 70 such that the arm 68 moves backward, away from the pivot axis 44 concurrently with the forward motion of the second end 54. Moreover, when the second end 54 moves backward, away from the pivot axis 44, the arm 68 moves forward towards the pivot axis 44. Consequently, the user's upper body is exercised simultaneously with the user's lower body. Moreover, the movement of the arm 68 generally opposes that of the second end 54 and of the pedal 56, resulting in an exercise gait that simulates a natural stepping gait. However, the handrail 66 can be used if the user desires only to exercise his lower body. The apparatus 30 thus provides a multiplicity of usage modes, thereby also enhancing exercise efficiency and promoting a pleasurable exercise experience.

B. Pedal and Arm Handle Resistive Control System.

Figure 11:
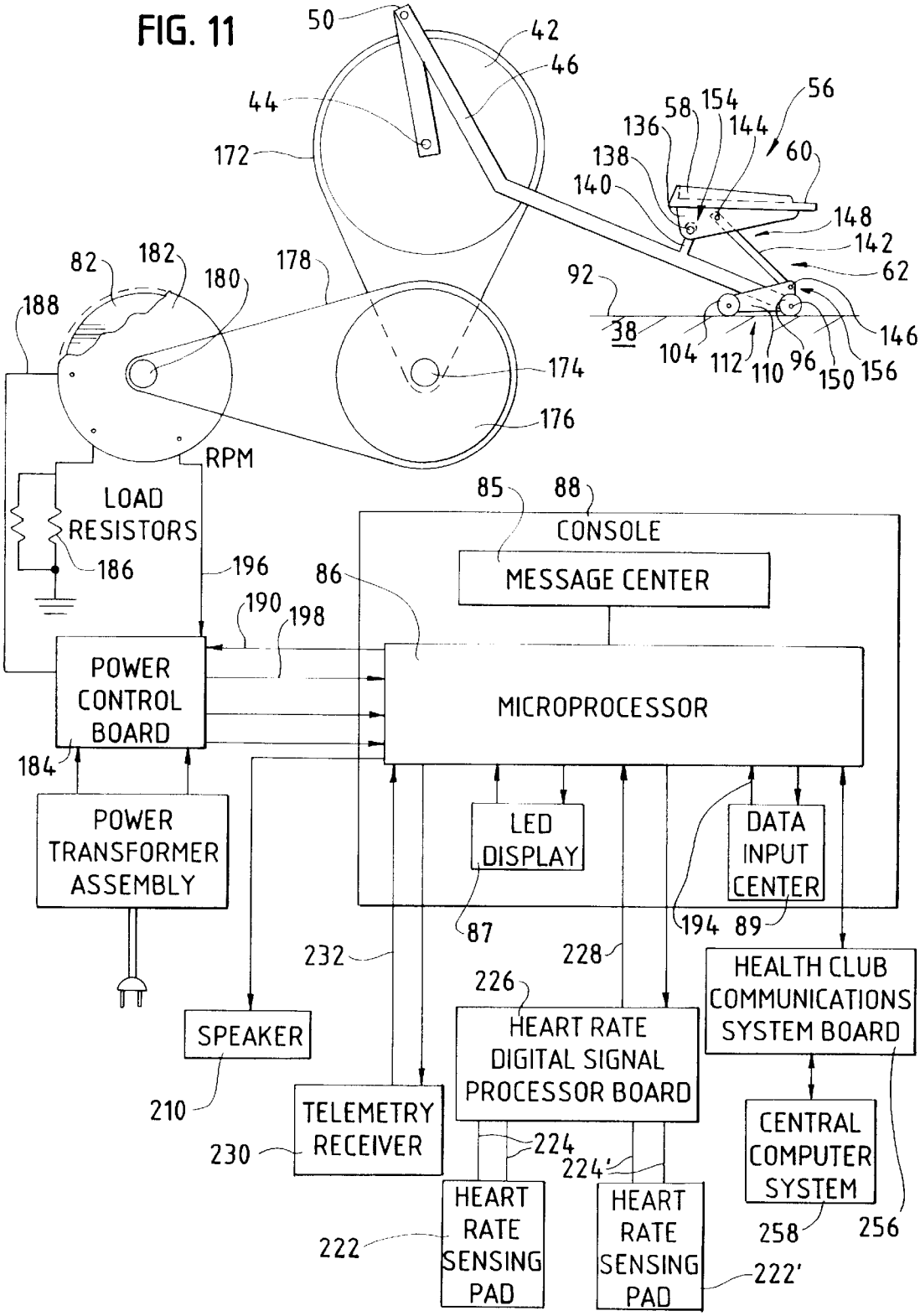
FIG. 11 is a schematic block diagram of the various mechanical and electrical functions of the exercise apparatus shown in FIG. 1.

As noted earlier, the resistive force generating components of the exercise apparatus 30 include the alternator 82 which, together with the transmission 84, transmits the resistive force to the pedal 56 and to the arm 68. Specifically, as best seen in FIGS. 7 and 8, the transmission includes the pulley 42 which is coupled by a belt 172 to a second pulley 174 that is attached to an intermediate pulley 176. A second belt 178 connects the intermediate pulley 176 to a third pulley 180 that is attached to the flywheel 182 of the alternator 82. The transmission 84 thereby transmits the resistive force provided by the alternator 82 to the pedal 56 and the arm 68 via the pulley 42. Turning to FIG. 11, in the preferred embodiment the microprocessor 86 housed within the console 88 is operatively connected to the alternator 82 via a power control board 184. The alternator 82 is also operatively connected to a ground through a resistance load source 186. A pulse width modulated output signal 188 from the power control board 184 is controlled by the microprocessor 86 and varies the current applied to the field of the alternator 82 by a pre-determined field control signal 190, in order to provide a resistive force which is transmitted to the pedal 56 and to the arm 68. In the preferred embodiment, the output signal 188 is continuously transmitted to the alternator 82, even when the pedal 56 is at rest. Consequently, when the user first steps on the pedal 56 to begin exercising, the braking force provided by the alternator 82 prevents the pedal 56 and the arm 68 from moving unexpectedly. Specifically, when the pedal 56 is at rest, the output signal 188 is set at a pre-determined value which provides the minimum current that is needed to measure the RPM of the flywheel 182. In the presently preferred embodiment, the minimum field current provided by the output signal 188 is 3%–6% of the maximum field current. When the user first steps on the pedal 56, the initial motion of the pedal 56 is detected as a change in the RPM signal 198, whereupon the microprocessor 86 maximizes the field control signal 190 thereby braking the pedal 56 and the arm 68. Thereafter, as explained in more detail below, the resistive force of the alternator 82 is varied by the microprocessor 86 in accordance with the specific exercise program chosen by the user so that the user can operate the pedal 56 as previously described.

Figure 12:
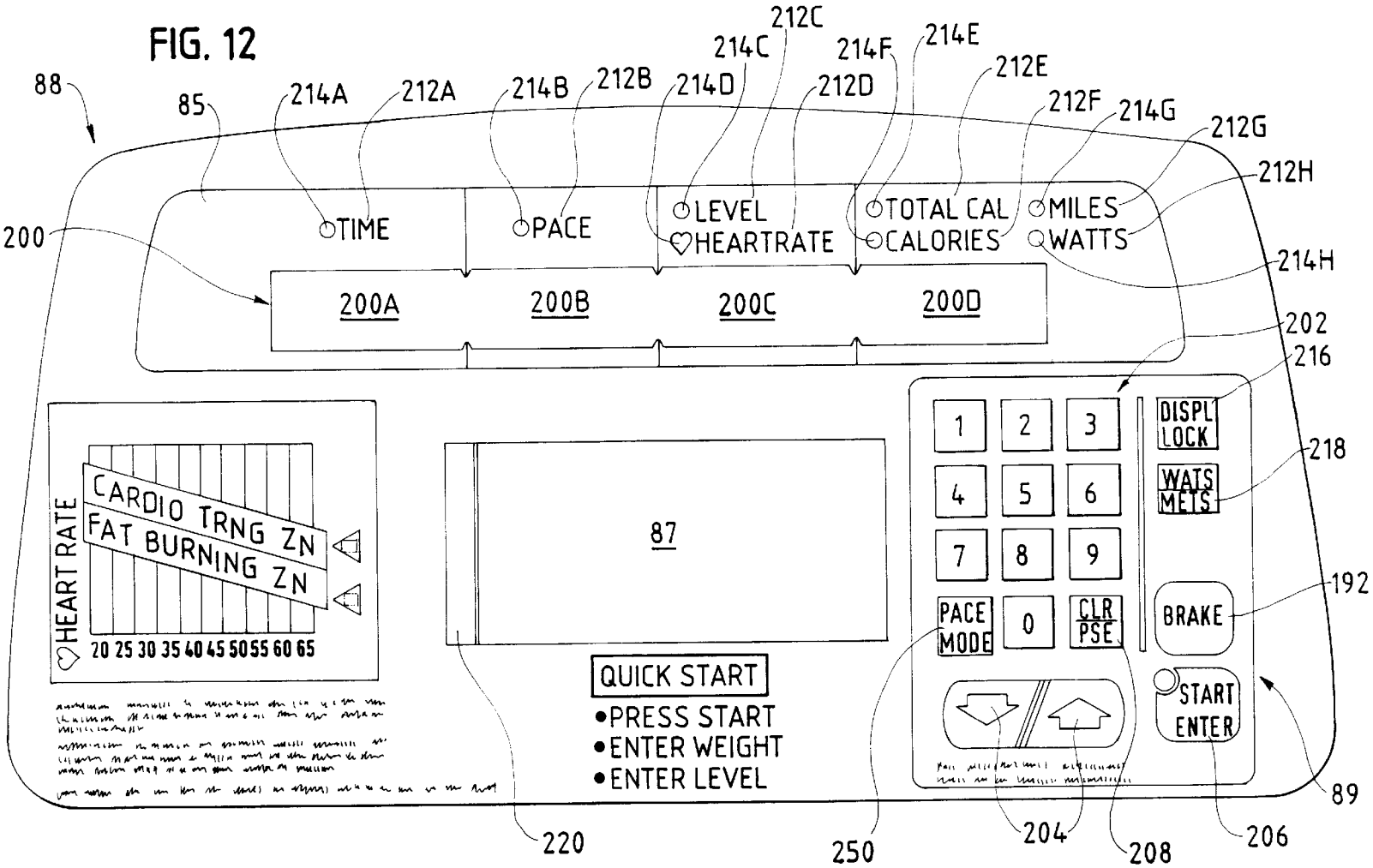
FIG. 12 is a plan layout of the display console of the exercise apparatus shown in FIG. 1.

The alternator 82 and the microprocessor 86 also interact to stop the motion of the pedal 56 when, for example, the user wants to terminate his exercise session on the apparatus 30. The data input center 89, which is operatively connected to the microprocessor 86, includes a brake key 192, as shown in FIG. 12, that can be employed by the user to stop the rotation of the pulley 42 and hence the motion of the pedal 56. When the user depresses the brake key 192, a stop signal is transmitted to the microprocessor 86 via an output signal 194 of the data input center 89. Thereafter, the field control signal 190 of the microprocessor 86 is varied to increase the resistive load applied to the alternator 82. The output signal 196 of the alternator provides a measurement of the speed at which the pedal 56 is moving as a function of the revolutions per minute (RPM) of the alternator 82. A second output signal 198 of the power control board 184 transmits the RPM signal to the microprocessor 86. The microprocessor 86 continues to apply a resistive load to the alternator 82 via the power control board 184 until the RPM equals a pre-determined minimum which, in the preferred embodiment, is equal to or less than 5 RPM.

In the preferred embodiment, the microprocessor 86 can also vary the resistive force of the alternator 82 in response to the user's input to provide different exercise levels. The message center 85 includes an alpha-numeric display panel 200, shown in FIG. 12, that displays messages to prompt the user in selecting one of several pre-programmed exercise levels. In the preferred embodiment, there are twenty-four pre-programmed exercise levels, with level one being the least difficult and level 24 the most difficult. The data input center 89 includes a numeric key pad 202 and selection arrows 204, either of which can be employed by the user to choose one of the pre-programmed exercise levels. For example, the user can select an exercise level by entering the number, corresponding to the exercise level, on the numeric keypad 202 and thereafter depressing the start/enter key 206. Alternatively, the user can select the desired exercise level by using the selection arrows 204 to change the level displayed on the alpha-numeric display panel 200 and thereafter depressing the start/enter key 206 when the desired exercise level is displayed. The data input center 89 also includes a clear/pause key 208 which can be pressed by the user to clear or erase the data input before the start/enter key 206 is pressed. In addition, the exercise apparatus 30 includes a user-feedback apparatus that informs the user if the data entered are appropriate. In the preferred embodiment, the user feed-back apparatus is a speaker 210, shown in FIG. 11, that is operatively connected to the microprocessor 86. The speaker 210 generates two sounds, one of which signals an improper selection and the second of which signals a proper selection. For example, if the user enters a number between 1 and 24 in response to the exercise level prompt displayed on the alpha-numeric panel 200, the speaker 210 generates the correct-input sound. On the other hand, if the user enters an incorrect datum, such as the number 100 for an exercise level, the speaker 210 generates the incorrect-input sound thereby informing the user that the data input was improper. The alphanumeric display panel 200 also displays a message that informs the user that the data input was improper. Once the user selects the desired appropriate exercise level, the microprocessor 86 transmits a field control signal 190 that sets the resistive load applied to the alternator 82 to a level corresponding with the pre-programmed exercise level chosen by the user.

The message center 85 displays various types of information while the user is exercising on the apparatus 30. As shown in FIG. 12, the alpha-numeric display panel 200 preferably is divided into four sub-panels 200A–D, each of which is associated with specific types of information. Labels 212A–H and LED indicators 214A–H located above the sub-panels 200A–D indicate the type of information displayed in the sub-panels 200A–D. The first sub-panel 200A displays the time elapsed since the user began exercising on the exercise apparatus 30. The second sub-panel 200B displays the pace at which the user is exercising. The third sub-panel 200C displays either the exercise level chosen by the user or, as explained below, the heart rate of the user. The LED indicator 214C associated with the exercise level label 212C is illuminated when the level is displayed in the sub-panel 200C and the LED indicator 214D associated with the heart rate label 212D is illuminated when the sub-panel 200C displays the user's heart rate. The fourth sub-panel 200D displays four types of information: the calories per hour at which the user is currently exercising; the total calories that the user has actually expended during exercise; the distance, in miles or kilometers, that the user has "traveled" while exercising; and the power, in watts, that the user is currently generating. In the default mode of operation, the fourth sub-panel 200D scrolls among the four types of information. As each of the four types of information is displayed, the associated LED indicators 214E–H are individually illuminated, thereby identifying the information currently being displayed by the sub-panel 200D. A display lock key 216, located within the data input center 89, can be employed by the user to halt the scrolling display so that the sub-panel 200D continuously displays only one of the four information types. In addition, the user can lock the units of the power display in watts or in metabolic units ("mets"), or the user can change the units of the power display, to watts or mets or both, by depressing a watts/mets key 218 located within the data input center 89.

In the preferred embodiment of the invention, the exercise apparatus 30 also provides several pre-programmed exercise programs that are stored within and implemented by the microprocessor 86. The different exercise programs further promote an enjoyable exercise experience and enhance exercise efficiency. The alpha-numeric display panel 200 of the message center 85, together with the display panel 87, guide the user through the various exercise programs. Specifically, the alpha-numeric display panel 200 prompts the user to select among the various preprogrammed exercise programs and prompts the user to supply the data needed to implement the chosen exercise program. The display panel 87 displays a graphical image that represents the current exercise program. The simplest exercise program is a manual exercise program. In the manual exercise program the user simply chooses one of the twenty-four previously described exercise levels. In this case the graphic image displayed by the display panel 87 is essentially flat and the different exercise levels are distinguished as vertically spaced-apart flat displays. A second exercise program, a so-called hill profile program, varies the effort required by the user in a pre-determined fashion which is designed to simulate movement along a series of hills. In implementing this program, the microprocessor 86 increases and decreases the resistive force of the alternator 82 thereby varying the amount of effort required by the user. The display panel 87 displays a series of vertical bars of varying heights that correspond to climbing up or down a series of hills. A portion 220 of the display panel 87 displays a single vertical bar whose height represents the user's current position on the displayed series of hills. A third exercise program, known as a random hill profile program, also varies the effort required by the user in a fashion which is designed to simulate movement along a series of hills. However, unlike the regular hill profile program, the random hill profile program provides a randomized sequence of hills so that the sequence varies from one exercise session to another. A detailed description of the random hill profile program and of the regular hill profile program can be found in U.S. Pat. No. 5,358,105, the entire disclosure of which is hereby incorporated by reference.

A fourth exercise program, known as a cross training program, urges the user to manipulate the pedal 56 in both the forward-stepping mode and the backward-stepping mode. When this program is chosen, the user begins moving the pedal 56 in one direction, for example, in the forward direction from position A to position C along the elliptical pathway 64. After a pre-determined period of time, the alpha-numeric display panel 200 prompts the user to prepare to reverse directions. Thereafter, the field control signal 190 from the microprocessor 86 is varied to effectively brake the motion of the pedal 56 and the arm 68. After the pedal 56 and the arm 68 stop, the alpha-numeric display panel 200 prompts the user to resume his workout. Thereafter, the user reverses directions and resumes his workout in the opposite direction.

Figure 2:
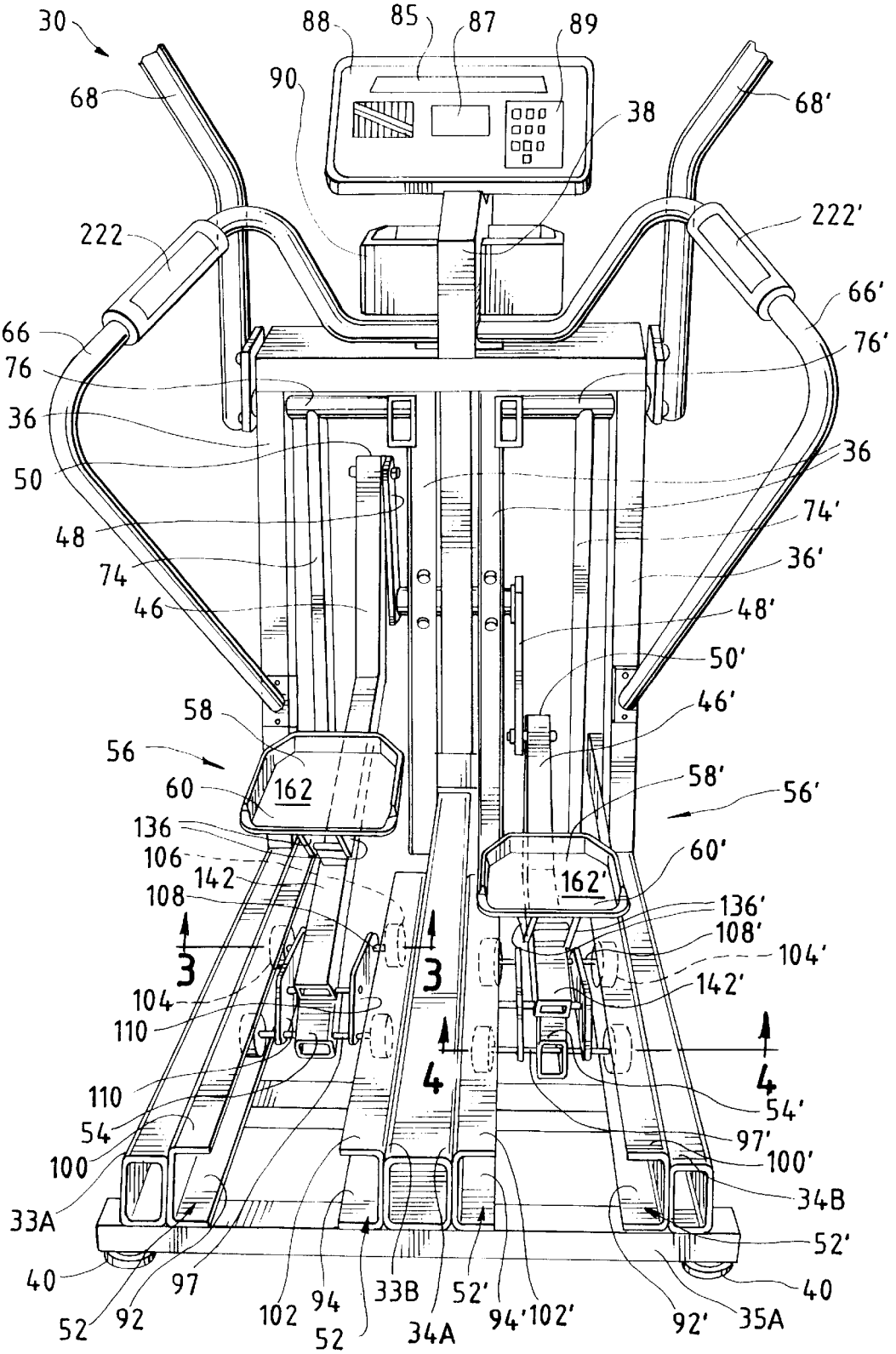
FIG. 2 is a partial rear perspective view of the exercise apparatus in FIG. 1.

Two exercise programs, a cardio program and a fat burning program, vary the resistive load of the alternator 82 as a function of the user's heart rate. When the cardio program is chosen, the microprocessor 86 varies the resistive load so that the use's heart rate is maintained at a value equivalent to 80% of a quantity equal to 220 minus the user's age. In the fat burning program the resistive load is varied so that the user's heart rate is maintained at a value equivalent to 65% of a quantity equal to 220 minus the user's heart age. Consequently, when either of these programs is chosen, the alpha-numeric display panel 200 prompts the user to enter his age as one of the program parameters. Alternatively, the user can enter a desired heart rate. In addition, the exercise apparatus 30 includes a heart rate sensing device that measures the user's heart rate as he exercises. As shown in FIGS. 1, 2, and 9, the heart rate sensing device consists of heart rate sensors 222 that are mounted either on the moving arm 68 or on the fixed handrail 66. In the preferred embodiment, the sensors 222 are mounted on the moving arm 68. An output signal 224 corresponding to the user's heart rate is transmitted from the sensors 222 to a heart rate digital signal processing board 226. The processing board 226 then transmits a heart rate signal 228 to the microprocessor 86. A detailed description of the sensors 222 and the heart rate digital signal processing board 226 can be found in U.S. Pat. Nos. 5,135,447 and 5,243,993, the entire disclosures of which are hereby incorporated by reference. In addition, the exercise apparatus 30 includes a telemetry receiver 230, shown in FIG. 9, that operates in an analogous fashion and transmits a telemetric heart rate signal 232 to the microprocessor 86. The telemetry receiver 230 works in conjunction with a telemetry transmitter that is worn by the user. In the preferred embodiment, the telemetry transmitter is a telemetry strap worn by the user around the user's chest, although other types of transmitters are possible. Consequently, the exercise apparatus 30 can measure the user's heart rate through the telemetry receiver 230 if the user is not grasping the arm 68. Once the heart rate signal 228 or 232 is transmitted to the microprocessor 86, the resistive load of the alternator 82 is varied to maintain the user's heart rate at the calculated value.

In each of these exercise programs, the user provides data that determine the duration of the exercise program. The user can choose between two exercise goal types, a time goal type and a calories goal type. If the time goal type is chosen, the alpha-numeric display panel 200 prompts the user to enter the total time that he wants to exercise. Alternatively, if the calories goal type is chosen, the user enters the total number of calories that he wants to expend. The microprocessor 86 then implements the chosen exercise program for a period corresponding to the user's goal. If the user wants to stop exercising temporarily after the microprocessor 86 begins implementing the chosen exercise program, depressing the clear/pause key 208 effectively brakes the pedal 56 and the arm 68 without erasing or changing any of the current program parameters. The user can then resume the chosen exercise program by depressing the start/enter key 206. Alternatively, if the user wants to stop exercising altogether before the chosen exercise program has been completed, the user simply depresses the brake key 192 to brake the pedal 56 and the arm 68. Thereafter, the user can resume exercising by depressing the start/enter key 206. In addition, the user can stop exercising by ceasing to move the pedal 56. The user then can resume exercising by again moving the pedal 56.

The exercise apparatus 30 also includes a pace option. In all but the cardio program and the fat burning program, the default mode is defined such that the pace option is on and the microprocessor 86 varies the resistive load of the alternator 82 as a function of the user's pace. When the pace option is on, the magnitude of the RPM signal 198 received by the microprocessor 86 determines the percentage of time during which the field control signal 190 is enabled and thereby the resistive force of the alternator 82. In general, the instantaneous velocity as represented by the RPM signal 198 is compared to a pre-determined value to determine if the resistive force of the alternator 82 should be increased or decreased. In the presently preferred embodiment, the pre-determined value is a constant of 30 RPM. Alternatively, the pre-determined value could vary as a function of the exercise level chosen by the user. Thus, in the presently preferred embodiment, if the RPM signal 198 indicates that the instantaneous velocity of the pulley 48 is greater than 30 RPM, the percentage of time that the field control signal 190 is enabled is increased according to Equation 1.

$$\text{field control duty cycle} = \text{field control duty cycle} + \frac{((|\text{instantaneous RPM} - 30|)/2)^2 * \text{field control duty cycle})}{256} \qquad \text{Equation 1}$$

here field duty cycle is a variable that represents the percentage of time that the field control signal 190 is enabled and where the instantaneous RPM represents the instantaneous value of the RPM signal 198.

On the other hand, in the presently preferred embodiment, if the RPM signal 198 indicates that the instantaneous velocity of the pulley 48 is less than 30 RPM, the percentage of time that the field control signal 190 is enabled is decreased according to Equation 2.

$$\text{field control duty cycle} = \text{field control duty cycle} - \frac{((|\text{instantaneous RPM} - 30|)/2)^2 * \text{field control duty cycle})}{256} \qquad \text{Equation 2}$$

where field duty cycle is a variable that represents the percentage of time that the field control signal 190 is enabled and where the instantaneous RPM represents the instantaneous value of the RPM signal 198.

Figure 13:
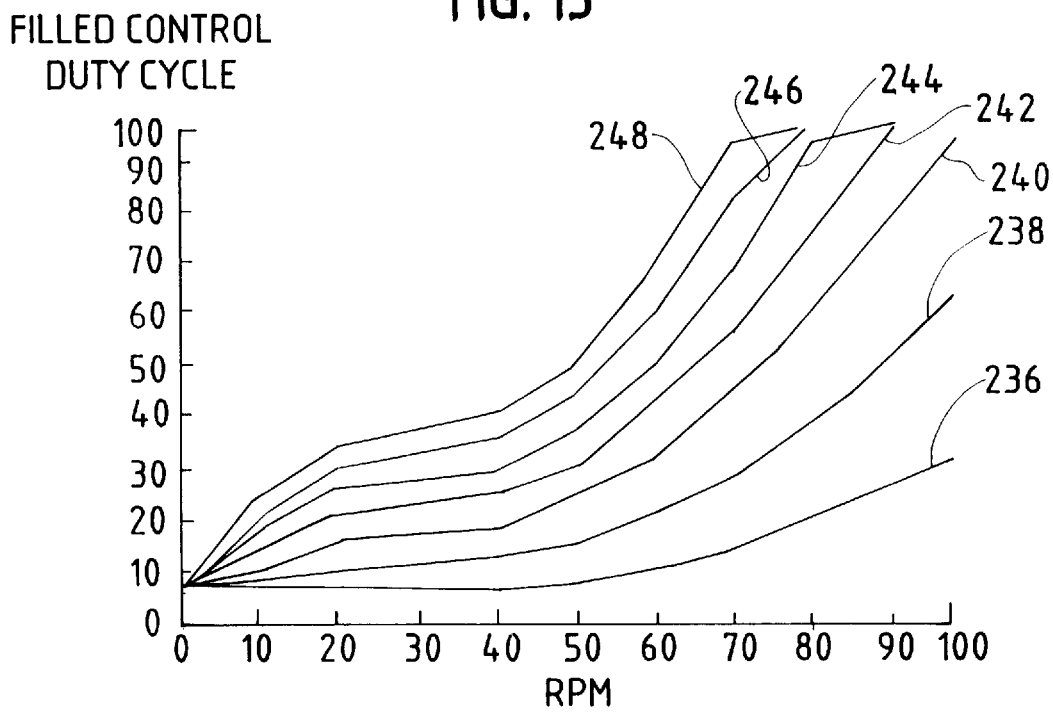

Moreover, once the user chooses an exercise level, the initial percentage of time that the field control signal 190 is enabled is pre-programmed as a function of the chosen exercise level. Consequently, in the presently preferred embodiment, the pace option provides a family of curves that determine the resistive force of the alternator 82 as a function of the exercise level chosen by the user and as a function of the user's pace. FIG. 13 illustrates some of the curves 236–248 which are used by the microprocessor 86 to control the resistive force of the alternator 82 when the pace mode option is on. Curve 236 represents the percentage of time that the field control signal 190 is enabled when the first exercise level, level 1, is chosen by the user. Similarly, curve 238 corresponds to exercise level 4, curve 240 corresponds to exercise level 7, curve 242 corresponds to exercise level 10, curve 244 corresponds to exercise level 13, curve 246 corresponds to exercise level 16, and curve 248 corresponds to exercise level 19. In addition, there are other curves (not shown) that correspond with the remaining levels of the twenty-four exercise levels that are provided in the preferred embodiment.

Figure 14:
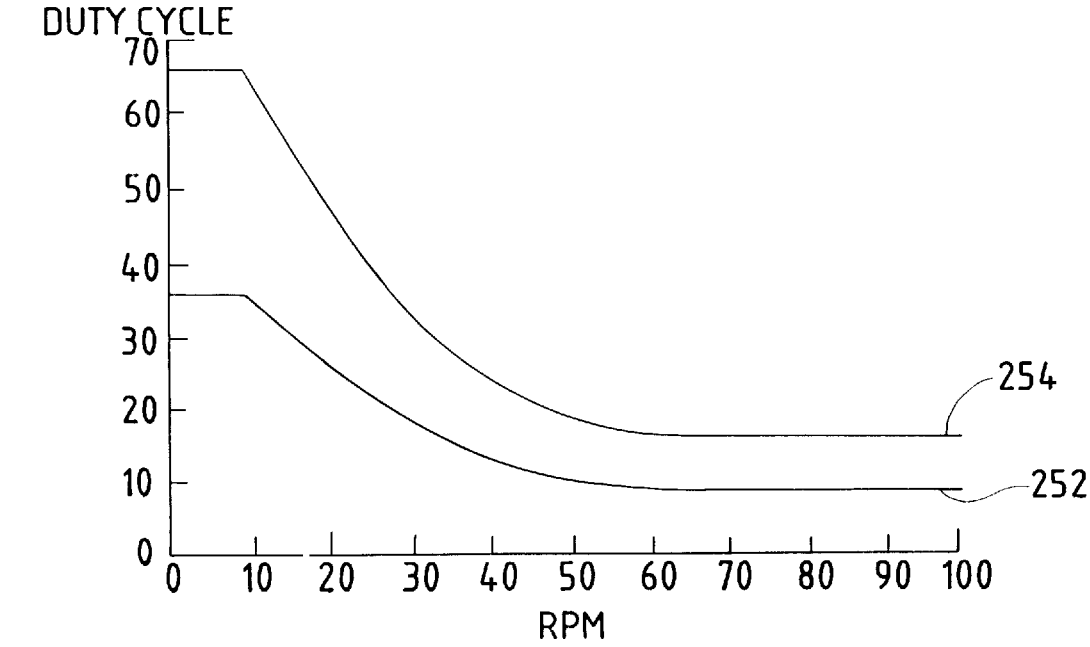
FIG. 14 is a graph of the percentage of time that the field control signal is enabled vs. the RPM signal when the exercise apparatus in FIG. 1 is used with the pace mode off or the exercise apparatus of FIG. 1 is used with the cardio or fat burning programs.

The user can disable the pace option, so that the resistive load of the alternator 82 varies as per FIG. 14, by depressing a pace mode key 250 located within the data input center 89. In addition, in the cardio program and the fat burning program, the pace mode default is set so that the pace mode is off. When the pace mode is disabled or when the user has chosen either the cardio or fat burning programs, the microprocessor 86 varies the time that the field control signal 190 is enabled primarily as a function of the exercise level chosen by the user and so that the percentage of time that the field control signal 190 is enabled is not less than a pre-determined minimum value and is not greater than a pre-determined maximum value. The pre-determined minimum value for the percentage of time that the field control signal 190 is enabled corresponds with the minimum value that is required to measure the RPM of the pulley 48. In the presently preferred embodiment, this predetermined minimum value is 6%. In addition, the maximum percentage of time that the field control signal 190 is enabled is 100% in the presently preferred embodiment.

Initially, the microprocessor 86 compares the instantaneous RPM of the pulley 48 to a pre-determined minimum value which, in the presently preferred embodiment is 15 RPM. If the instantaneous RPM of the pulley 48 is greater than or equal to 15 RPM, the value of the instantaneous RPM is assigned to a RPM variable. If, however, the instantaneous value of the RPM is less than 15 RPM, the RPM variable is set to equal 15 RPM, according to Equations 3 and 4.

$$\text{working RPM} = \text{instantaneous RPM} \qquad \text{Equation 3}$$

$$\text{if working RPM} < 15 \text{ RPM, working RPM} = 15 \text{ RPM} \qquad \text{Equation 4}$$

where the instantaneous RPM is the instantaneous value of the RPM signal 198 and where working RPM is the RPM variable.

The microprocessor 198 then determines a value for the percentage of time that the field control signal 190 is enabled as a function of both the exercise level chosen by the user and the value of the RPM variable, according to Equation 5:

$$\text{field duty cycle} = \frac{(30 * \text{base field})}{\text{working RPM}} \qquad \text{Equation 5}$$

where field duty cycle is a variable that represents the percentage of time that field control signal 190 is enabled and base field is the pre-determined initial value for the percentage of time that field control signal 190 is enabled based on the exercise level chosen by the user.

The value for the percentage of time that the field control signal 190 is enabled, the field duty cycle variable, is then compared to two different predetermined values. First, the field duty cycle variable is compared to the initial value for the amount of time the field control signal 190 is enabled and the field duty cycle variable is re-assigned if appropriate, according to Equation 6:

$$\text{If (field duty cycle)} < \frac{\text{base field}}{2} \text{ then} \qquad \text{Equation 6}$$

$$\text{(field duty cycle)} = \frac{\text{base field}}{2}$$

where field duty cycle is the variable that represents the percentage of time that field control signal 190 is enabled and base field is the pre-determined initial value for the percentage of time that field control signal 190 is enabled based on the exercise level chosen by the user.

Finally, the field duty cycle variable is compared to the pre-determined minimum value and the predetermined maximum value and is re-assigned if appropriate, according to Equations 7 and 8:

If (field duty cycle<minimum value) then field duty cycle=minimum value — Equation 7

If (field duty cycle>maximum value) then field duty cycle=maximum value — Equation 8 where field duty cycle is the variable that represents the percentage of time that field control signal 190 is enabled and where, in the presently preferred embodiment, the minimum value is 6% and the maximum value is 100%.

Thus, when the pace mode is off or when the user has chosen either the cardio program or the fat burning program, the microprocessor 86 varies the resistive force of the alternator 82, via the percentage of time that the field control signal 190 is enabled, so that the resistive force does not drop below one-half of the value that corresponds to the chosen exercise level and does not exceed two times the value that corresponds to the chosen exercise level. Consequently, the preferred embodiment of the exercise apparatus 30 provides a family of curves that determine the percentage of time that the field control signal 190 enabled primarily as a function of the exercise level chosen by the user. FIG. 14 illustrates two of the curves 252–254 which are used by the microprocessor 86 to control the resistive force of the alternator 82 when the pace mode option is on. Curve 252 represents the percentage of time that the field control signal 190 is enabled when the seventh first exercise level, level 7, is chosen by the user. Similarly, curve 254 corresponds to exercise level 16. In addition, there are other curves (not shown) that correspond with the remaining levels of the twenty-four exercise levels that are provided in the preferred embodiment.

The preferred embodiment of the exercise apparatus 30 further includes a communications board 256 that links the microprocessor 86 to a central computer 258, as shown in FIG. 11. Once the user has entered the preferred exercise program and associated parameters, the program and parameters can be saved in the central computer 258 via the communications board 256. Thus, during subsequent exercise sessions, the user can retrieve the saved program and parameters and can begin exercising without re-entering data. In addition, at the conclusion of an exercise session, the user's heart rate, distance traveled, and total calories expended can be saved in the central computer 258 for future reference.

In using the apparatus 30, the user begins his exercise session by first stepping on the pedal 56 which, as previously explained, is heavily damped due to the at-rest resistive force of the alternator 82. Once the user depresses the start/enter key 206, the alpha-numeric display panel 200 of the message center 85 prompts the user to enter the required information and to select among the various programs. First, the user is prompted to enter the user's weight. The alphanumeric display panel 200, in conjunction with the display panel 87, then lists the exercise programs and prompts the user to select a program. Once a program is chosen, the alphanumeric display panel 200 then prompts the user to provide program-specific information. For example, if the user has chosen the cardio program, the alphanumeric display panel 200 prompts the user to enter the user's age. After the user has entered all the program-specific information, the user is prompted to specify the goal type (time or calories), to specify the desired exercise duration in either total time or total calories, and to choose one of the twenty-four exercise levels. Once the user has entered all the required parameters, the microprocessor 86 implements the chosen exercise program based on the information provided by the user. When the user then operates the pedal 56 in the previously described manner, the pedal 56 moves along the elliptical pathway 64 in a manner that to simulates a natural heel to toe flexure that minimizes or eliminates stresses due to un-natural foot flexure. If the user employs the moving arm 68, the exercise apparatus 30 exercises the user's upper body concurrently with the user's lower body. Alternatively, the user can concentrate his exercise session on his lower body by using the handrails 66. The exercise apparatus 30 thus provides a wide variety of exercise programs that can be tailored to the specific needs and desires of individual users, and consequently, enhances exercise efficiency and promotes a pleasurable exercise experience.

III. Detailed Description Of The Second General Embodiment

Figure 15:
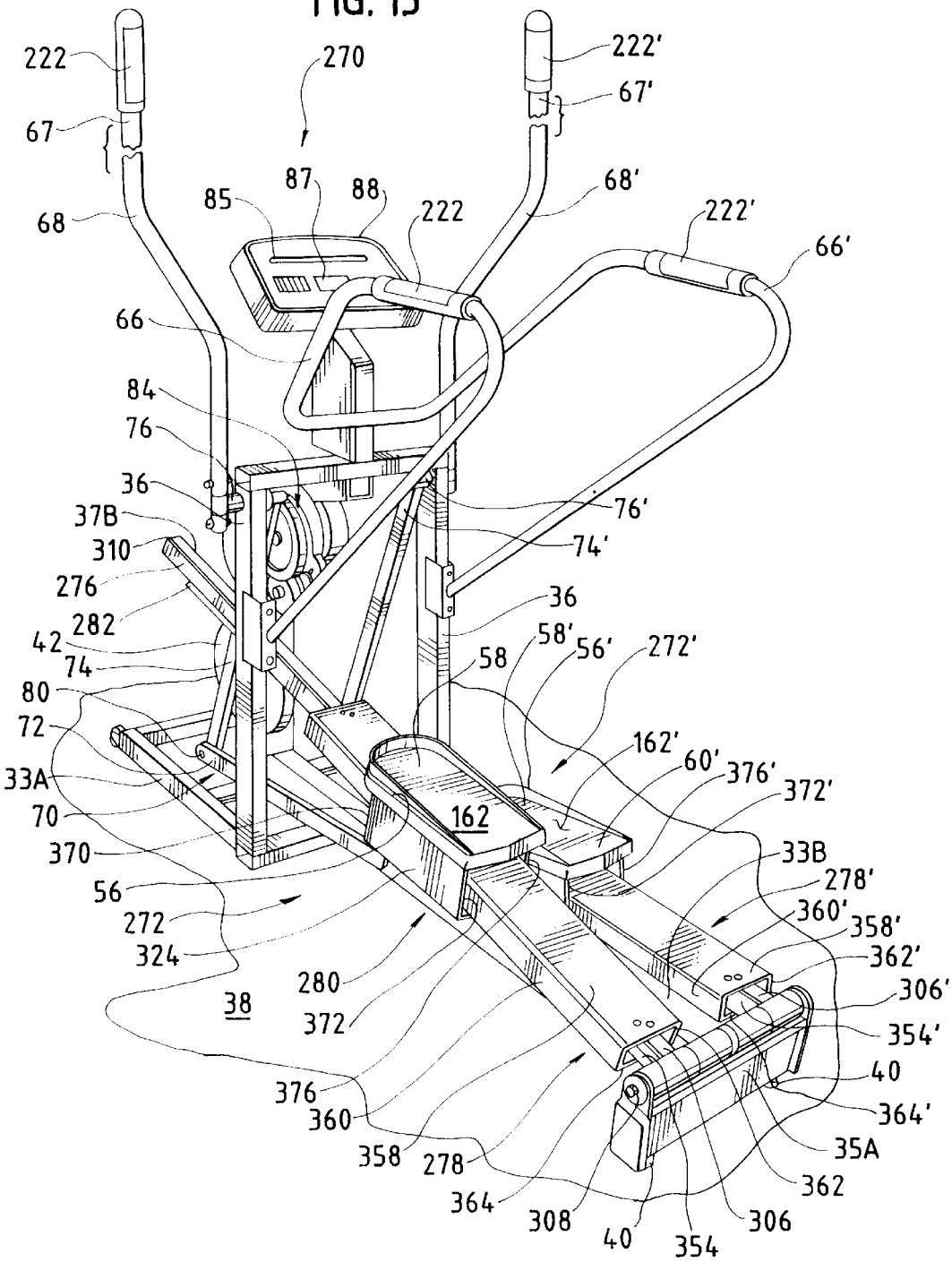
FIG. 15 is a side perspective view of a second embodiment of an exercise apparatus according to the invention.
Figure 16:
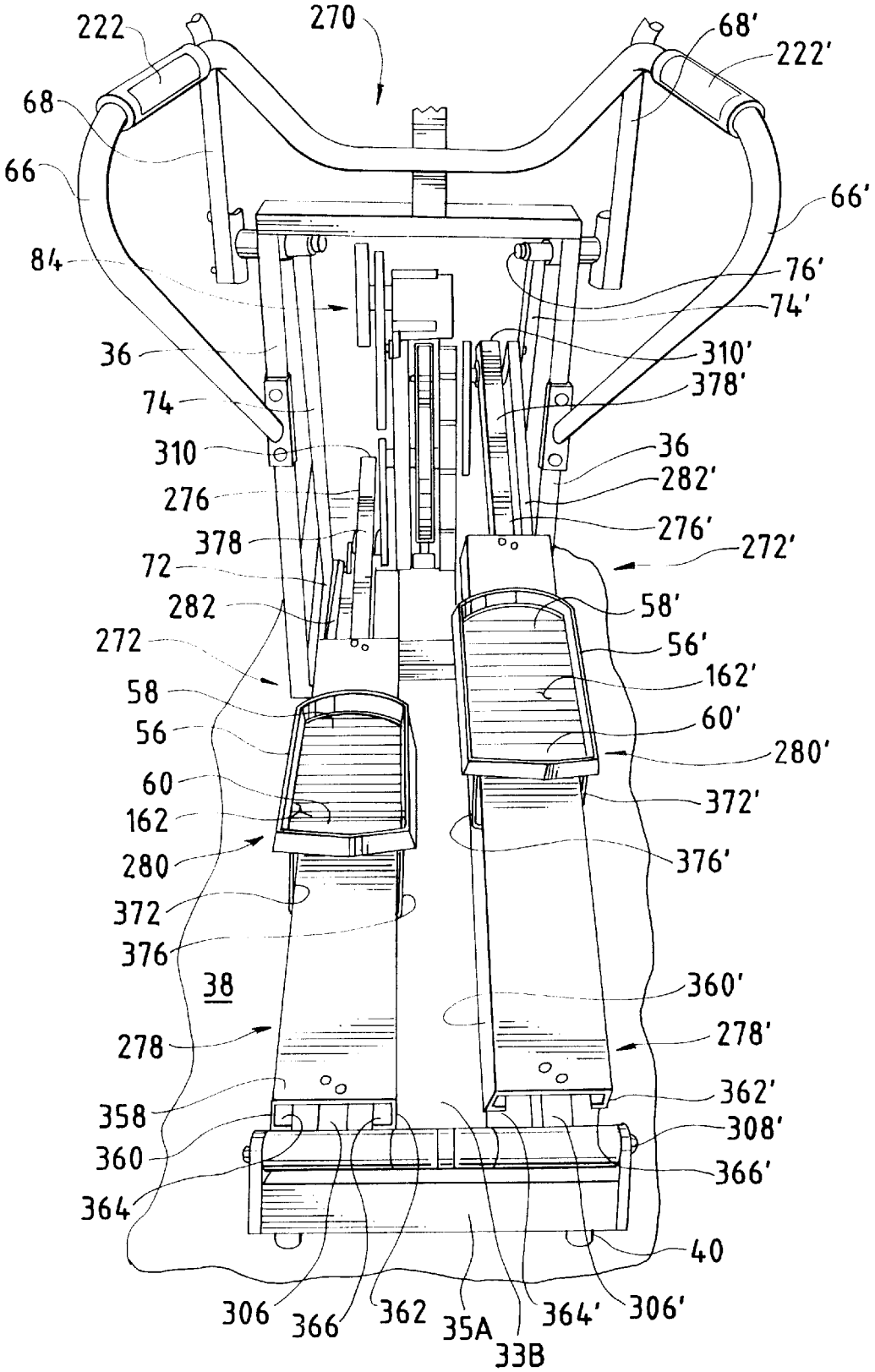
FIG. 16 is a partial back perspective view of the exercise apparatus in FIG. 15.
Figure 17:
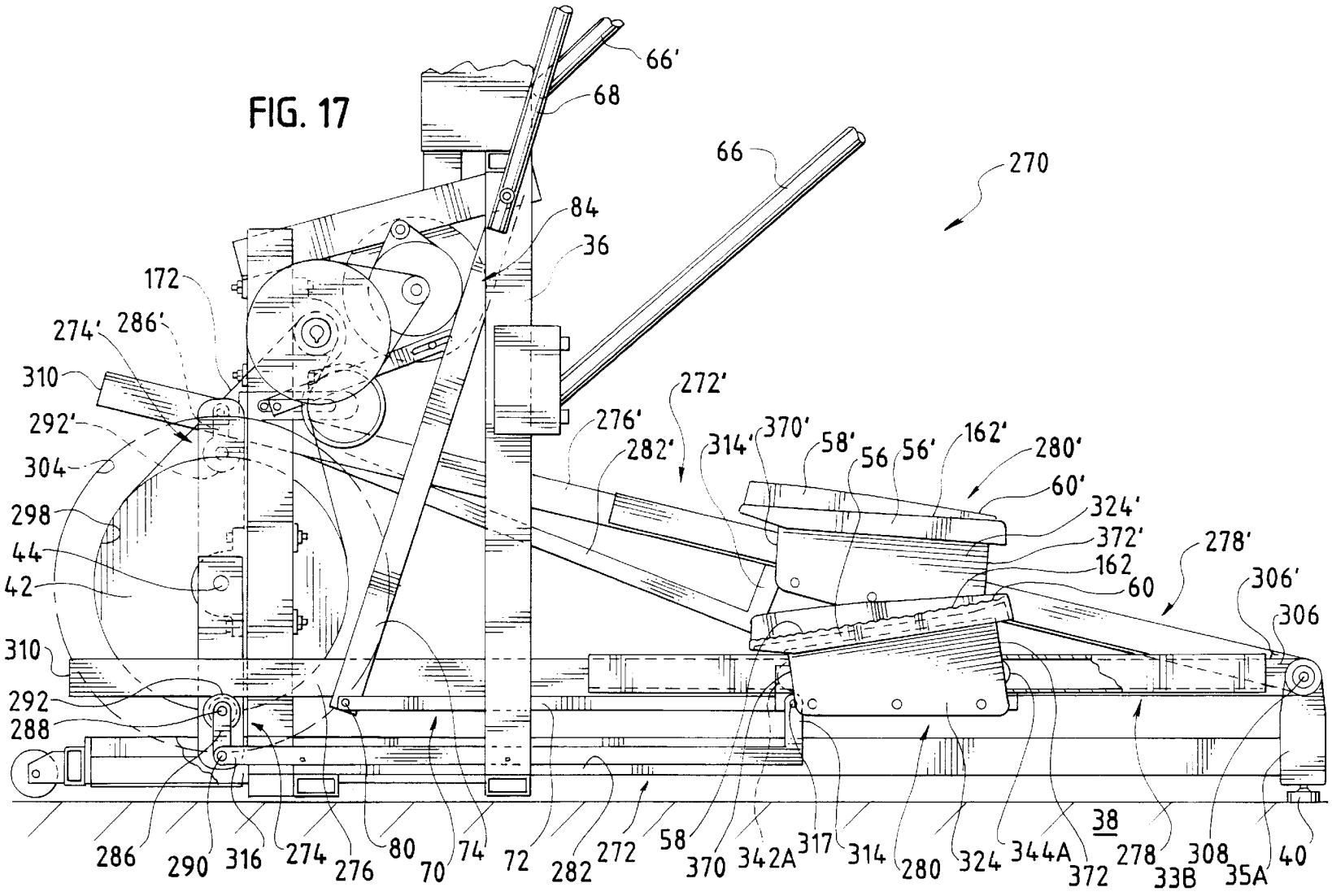
FIG. 17 is a partial side perspective of the apparatus in FIG. 14 and shows a first embodiment of the pedal tie which forms a part of the exercise apparatus in FIG. 15.

FIGS. 15–17 show a second general embodiment 270 of an exercise apparatus according to the invention. As noted previously, the second embodiment 270 of the invention includes the second type of pedal actuation assembly and therefore implements the desired elliptical pedal motion. As with the previous embodiment 30, the exercise apparatus 270 includes, but is not limited to, the frame 32, the pulley 42 and associated pivot axis 44, the pedal 56, the handrail 66, the moving arms 68, and the various motion controlling components, such as the alternator 82, the transmission 84, the microprocessor 86, the console 88, the power control board 184, the heart rate digital signal processing board 226, the communications board 256 and the central computer 258. The exercise apparatus 270 differs primarily from the previous embodiment 30, along with the various embodiments that follow, in the nature and construction of the pedal actuation assembly. As noted earlier, the pedal actuation assembly refers to those components which cooperate to (1) provide an elliptical path and (2) provide the desired foot flexure and weight distribution on the pedal 56. The pedal actuation assembly 272 of the exercise apparatus 270 includes an offset coupling assembly 274 (best seen in FIG. 18), a vertically pivoted track 276, a pedal guide 278, a pedal assembly 280 and a pedal tie member 282. As explained in more detail below, the offset coupling assembly 274, the pivoted track 276, and the pedal tie 282 cooperate to generate the desired elliptical motion of the pedal 56. The pedal 56 is attached to the pedal assembly 280 which in turn is slidable mounted on the vertically pivoting track 276 by the pedal guide 278. Thus, the pedal assembly 280 will move in such a manner as to implement the desired elliptical motion of the pedal 56.

Figure 18:
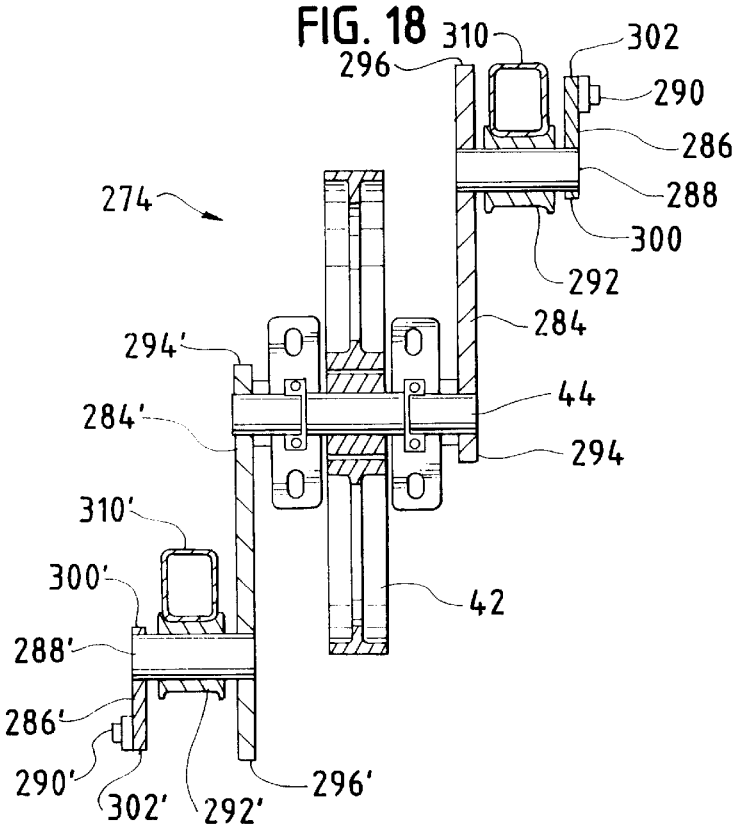
FIG. 18 is a front sectional view of the offset coupling assembly which forms a part of the exercise apparatus in FIG. 15.

FIG. 18 shows the preferred embodiment of the offset coupling assembly 274, which includes two crank arms 284 and 286, two axles 288 and 290, and a roller 292. A first end 294 of the first crank arm 284 is secured to the pulley pivot axis 44. The first axle 288 is secured to the first crank arm 284 proximate a second end 296 thereof and is substantially perpendicular to the first crank arm 284. As the pulley 42 rotates, the first axle 288 traces a first generally circular path 298 (shown in FIGS. 17 and 22A–H). A first end 300 of the second crank arm 286 is secured to the first axle 288. The second axle 290 is secured to the second crank arm 286 proximate a second end 302 thereof and is substantially perpendicular to the second crank arm 286. The second axle 290 traces a second generally circular path 304 (shown in FIGS. 17 and 22A–H) as the pulley 42 rotates. In the preferred embodiment, the second generally circular path 304 is larger than the first generally circular path 298. The dimensions of the first and second circular paths 298 and 304 determine the vertical and horizontal dimensions, respectively, of the generated elliptical motion. The roller 292 is supported by the first axle 288 between the first crank arm 284 and the second crank arm 286. The roller 292 operates to support the track 276 as it rotates around the first circular path 298.

Referring to FIG. 17, a second end 306 of the track 276 is pivotally attached to the frame 32 along a pivot axis 308. A first end 310 of the track 276 is supported by the roller 292 of the offset coupling assembly 274. As previously noted, the first axle 288, and hence the roller 292, trace the first circular path 298 as the pulley 42 rotates. Because the second end 306 of the track 276 is pivotally constrained at the pivot axis 308, the first end 310 of the track 276 will move in a vertical arcuate reciprocating path 312 (shown in FIGS. 22A–22H) as the pulley 42 rotates, the vertical distance of which is represented by the diameter of the first circular path 298. The arcuate motion of the track 276 thus contributes to the height of elliptical motion of the pedal 56 by virtue of the motion of the first end 310 of the track 276 around the first circular path 298. At the same, time the first end of the pedal tie 282 will rotate about the second circular path 304 while a second end 314 of the pedal tie 282 moves in a generally linear reciprocating path 318 (shown in FIGS. 22A–22H) as the pulley 42 rotates. The resulting linear reciprocating motion of the pedal assembly 280 will substantially govern the length of the elliptical motion of the pedal 56. Specifically, a first end 316 of the pedal tie 282 is pivotally secured to the second axle 290 of the offset coupling assembly 274 and moves around the second circular path 304 as the pulley 42 rotates. The second end 314 of the pedal tie 282 is pivotally secured to the pedal assembly 280 at a point 317. As explained in more detail with reference to FIGS. 20 and 21, the pedal guide 278 retains the pedal assembly 280 on the track 276 so that the pedal assembly 280 is constrained to move in a linear path along the track 276. Therefore, the second end 314 of the pedal tie 282 is also constrained to move in the linear reciprocating path 318 as the pulley 42 rotates. The combination of the reciprocating linear motion of the pedal assembly 280 and the reciprocating vertical arcuate motion of the track 276 results in a generally elliptical path 320 (shown in FIG. 23) of travel of the pedal 56.

Figure 19:
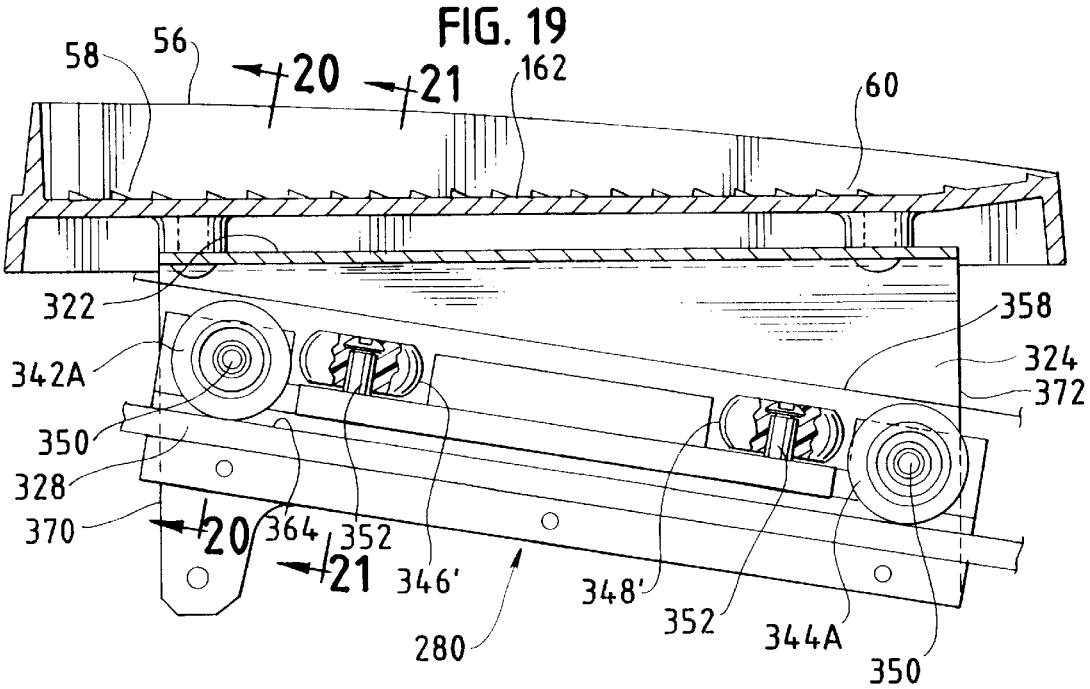
FIG. 19 is a stylized side view of the pedal and pedal assembly that forms parts of the exercise apparatus in FIG. 15.
Figure 20:
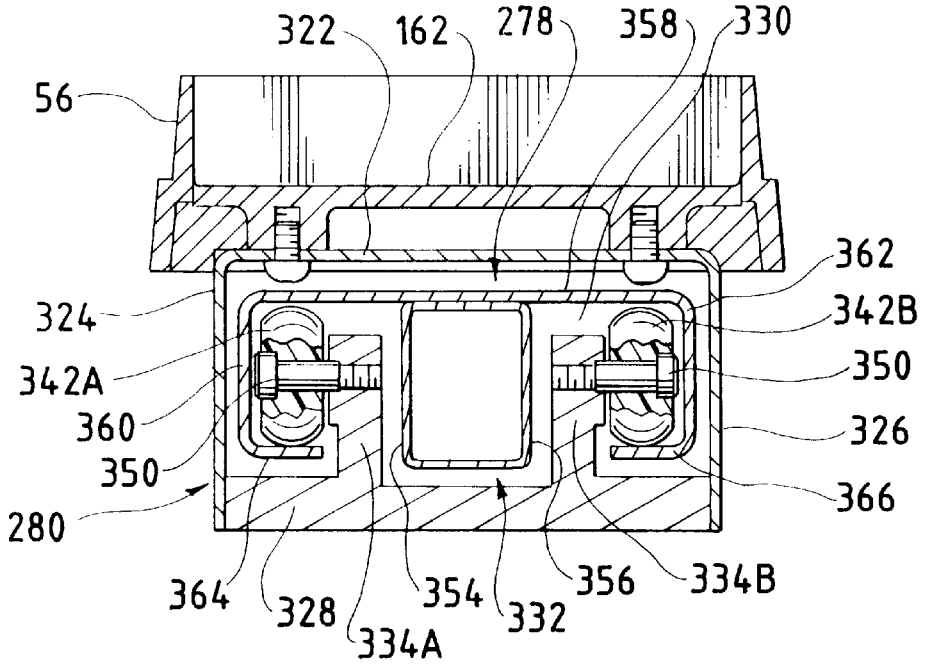
FIG. 20 is a partial cross sectional view along line 20—20 in FIG. 15.
Figure 21:
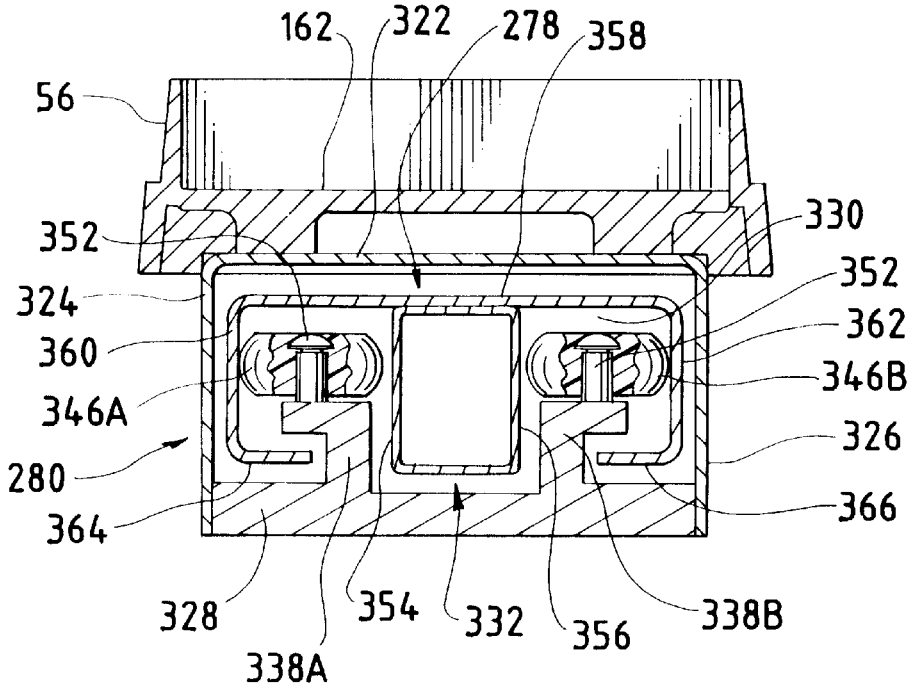
FIG. 21 is a partial cross sectional view along line 21—21 in FIG. 15.

The pedal assembly 280 is shown in more detail in FIGS. 19–21. The pedal assembly 280, includes a generally planar pedal support 322, a pair of laterally spaced-apart vertical supports 324 and 326, and a base support 328. The first vertical support 324 is secured to and extends between the pedal support 322 and the base support 328. Similarly, the second vertical support 226 is secured to and extends between the pedal support 322 and the base support 328. The pedal support 322, the vertical supports 324 and 326, and the base support 328 together define an orifice 330 through which a portion 332 of the moving track 276 extends. The pedal 56 is fixedly secured to the pedal support 322 by any suitable securing means, for example, by welding or by rivets or bolts. The pedal assembly 280 also includes paired sets of roller arms 334A, 334B, 338A, 338B, 340A, and 340B that support vertical rollers 342A, 342B, 344A, and 344B and horizontal rollers 346A, 346B, 348A, 348B on which the pedal assembly 280 rides. The roller arms 334A, 334B, 336A, 336B, 338A and 338B. are secured to the base support 334 and extend from the base support 334 into the orifice 330. The first two sets of paired roller arms 334A, 334B, 336A, and 336B support the front pair vertical rollers 342A and 342B and the back pair of vertical rollers 344A and 344B. Similarly, the second two sets of paired roller arms 338A, 338B, 340A, and 340B support the front pair of horizontal rollers 346A and 346B and the back pair of horizontal rollers 348A and 348B. In addition, the second set of paired roller arms 338A, 338B, 340A, and 340B are positioned intermediate the front-most roller arms 334A and 334B and the roller arms 336A and 336B so that the front pair of vertical rollers 342A and 342B and the back pair of vertical rollers 344A and 344B flank the pairs of horizontal rollers 346A, 346B, 348A, 348B. The vertical rollers 342A, 342B, 344A and 344B are pivotally coupled to horizontal axles 350 which are in turn rigidly secured to the support arms 334A, 334B, 336A, and 336B. Similarly, the horizontal rollers 346A, 346B, 348A, and 348B are pivotally coupled to vertical axles 352 which are secured to the roller arms 338A, 338B, 340A, and 340B. Each set of paired roller arms 334A, 334B, 336A, 336B, 338A, 338B, 340A, and 340B is positioned proximate the portion 332 of the guide 278 on opposite sides 360 and 362 thereof.

The pedal assembly 280, together with the pedal guide 278, are thus constrained to move in the linear reciprocating path 318 along the track 276. The pedal guide 278 includes a generally planar cross piece 358, a pair of laterally spaced-apart vertical rails 360 and 362 and a pair of laterally spaced-apart horizontal rails 364 and 366. The vertical rails 360 and 362 are secured to the generally planar cross piece 358 and extend downwardly from the generally planar cross piece 358. Each of the horizontal rails 364 and 366 is secured to one of the vertical rails 360 and 362 and extends inwardly from the respective vertical rail 360 or 362 so that the horizontal rails 364 and 366 are positioned below the planar cross piece 358. The pedal guide 278 is fixedly secured to the track 276 along the generally planar cross piece 358 by any suitable securing means, for example, by welding or by rivets or bolts, so that the portion 332 of the moving track 276 is intermediate the vertical rails 360 and 362. In addition, the rollers arms 334A, 336A, 338A, and 340A of the pedal assembly 280 are positioned intermediate the horizontal rail 364 and the portion 332 of the track 276 and the roller arms 334B, 336B, 338B, and 340B of the pedal assembly 280 are positioned intermediate the portion 332 of the moving track 276 and the horizontal rail 366. The vertical rollers 342A, 342B, 344A, and 344B are therefore positioned to engage the horizontal rails 364 and 366 and the horizontal rollers 346A, 346B, 348A, and 348B are positioned to engage the vertical rails 360 and 362. Consequently, the vertical movement of the pedal assembly 280 is limited by the cross piece 358 and by the horizontal tracks 364 and 366 and the horizontal movement of the pedal assembly 280 is limited by the vertical rails 360 and 362. The pedal assembly 280 and hence the second end 314 of the pedal tie 282 are therefore constrained to move in the linear reciprocating path 318 along the vertically reciprocating track 276.

The contributions of the components of the pedal actuation assembly 272 to the desired elliptical motion are now explained generally with reference to FIGS. 22A–22H and 23. As the pulley 42 rotates, the roller 292 on the first axle 288 of the offset coupling assembly 274 rotates in the first circular path 298, thereby moving the first end 310 of the track 276 in the reciprocating arcuate path 312. In addition, the rotation of the pulley 42 moves the second axle 290 of the offset coupling assembly 274 in the second circular path 304. The first end 316 of the pedal tie 282 is pivotally secured to the second axle 290 and so also moves in the second circular path 304. The second end 314 of the pedal tie 282 is secured to the pedal assembly 280 and so is constrained to move in the reciprocating linear path 318 along the moving track 276. The combination of the reciprocating arcuate motion of the first end 310 of the moving track 276 and the reciprocating linear motion of the second end 314 of the pedal tie 282 produces a substantially elliptical motion that is transmitted to the pedal 56 by the pedal assembly 280. The pedal 56 subsequently moves in the substantially elliptical path 320, shown in FIG. 23. The height of the substantially elliptical path 320 is determined by the radius of the first circular path 298 and the length of the substantially elliptical path 320 is determined by the radius of the second circular path 304. The dimensions of the elliptical path 320 therefore can be varied independently by varying the diameters of the first and second circular paths 298 and 304. For example, the height of the elliptical path 320 and be increased by lengthening the first crank arm 284 and thereby increasing the distance between the pivot axis 44 and the first axle 288 of the offset coupling assembly 274. Similarly, the length of the elliptical path 320 can be varied by changing the length of the second crank arm 286 of the offset coupling assembly 274.

In addition to transmitting the generated elliptical motion to the pedal 56, the pedal assembly 280 also influences the manner in which the user's weight is distributed as the pedal 56 moves in the elliptical path 320. Referring back to FIGS. 17 and 19, the lengths of the front side 370 and the back side 372 of the vertical support 324 are unequal, as are the lengths of the front side and back side 376 of the vertical support 326. Consequently, the top surface 162 of the pedal 56 is not parallel with the top surface 378 of the moving track 276 but instead is positioned at a fixed angle 380 relative to the top surface 378 of the moving track 276. In the preferred embodiment of the pedal assembly 280 the lengths of the front sides 370 and 374 and the back sides 372 and 376 of the vertical supports 324 and 326 are chosen so that the fixed angle 380 is about 9°. The fixed angle 380 of the top pedal surface 162 and the vertical reciprocating arcuate path 312 of the first end 310 of the moving track 276 together generate a varying angular displacement 382 between the top surface 162 of the pedal 56 and a fixed horizontal plane, such as the horizontal plane 384 of the floor 38. The varying angular displacement 382 helps to provide the foot weight distribution and flexure on the pedal 56 that simulates the normal human gait. Moreover, the motion of the pedal 56 along the elliptical path 320 generates a varying linear displacement 386 between the top surface 162 of the pedal 56 and the fixed reference plane 384. The magnitude of the varying linear displacement 386 promotes a pleasurable exercise experience by providing an appropriate intrinsic work-out level. The linear displacement 386 between the top surface 162 of the pedal 56 and the reference plane 384 is conveniently measured at a point 388 on the top surface 162 that roughly corresponds with the location of the ball of the user's foot.

The movement of the pedal 56, which is determined by the components of the pedal actuation assembly 272, is now discussed in detail with reference to FIGS. 22A–22H and 23. FIGS. 22A–22H trace the motion of the pedal 56 as the pedal 56 completes one forward-stepping revolution along the elliptical path 320, beginning at the rearmost position on the reciprocating linear path 318 of the second end 314 of the pedal tie 282. As with the previous embodiment 30, the apparatus 270 can be operated both in a forward-stepping mode and in a backward-stepping mode. When the apparatus 270 is operated in the forward-stepping mode, the pedal 56 travels in the counter-clockwise sequence illustrated in FIGS. 22A–22H. Alternatively, when the apparatus 270 is operated in the backward-stepping mode, the sequence of the pedal 56 is reversed so that the pedal moves from the starting point, shown in FIG. 22A, in a clockwise direction to the position shown in FIG. 22H.

Figure 22A:
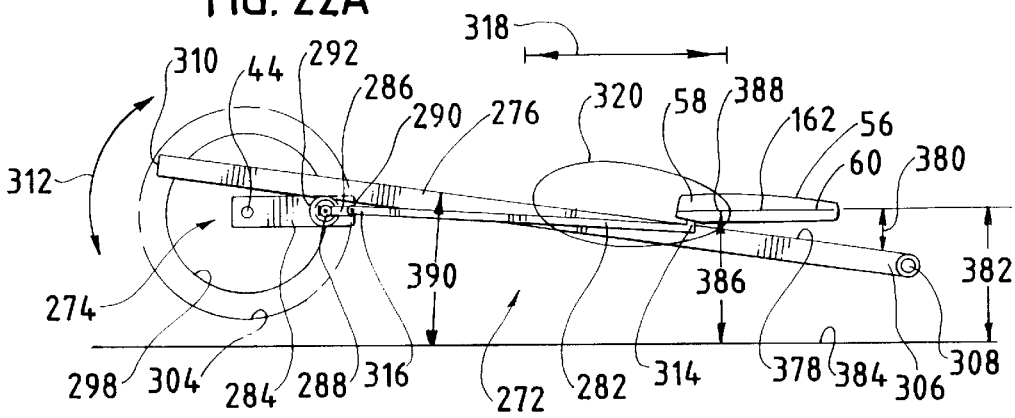
FIGS. 22A–22H are schematic representations of the reciprocating movement of the second end of the pedal tie.

Beginning at FIG. 22A, the second end 314 of the pedal tie 282 is at the rearmost position on the reciprocating linear path 318. As noted previously, the first end 310 of the moving track 276 moves in the reciprocating arcuate path 312 as the second end 314 of the pedal tie 282 moves in the reciprocating linear path 318. Consequently, the movement of the first end 310 of the moving track 276 generates a varying angular displacement 390 between the moving track 276 and the fixed, horizontal reference plane 384. When the second end 314 of the pedal tie 282 is at the rearmost position on the reciprocating linear path 318, the angular displacement 390 between the track 276 and the reference plane 384 is +7.7°. In addition, the angular displacement 382 between the top surface 162 of the pedal 56 and the horizontal plane 384 is +1.3° while the angle 380 between the top surface 162 and the top surface 378 of the track 276 is 9°. Moreover, the linear displacement 386 between the point 388 and the reference plane 384 is about 12 inches.

Figure 22B:
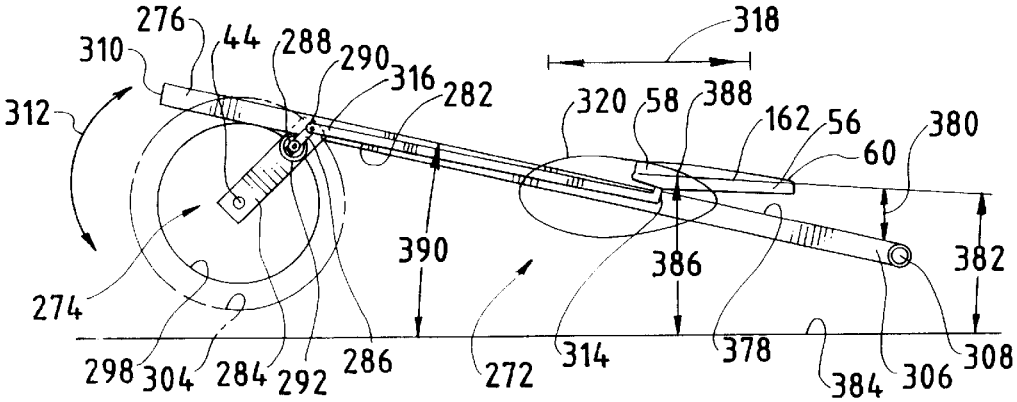

As the pedal 56 is moved by the user in the forward-stepping mode, rotation of the pulley 42 on the pivot axis 44 by about 45° moves the pedal 56 to the position shown in FIG. 22B. The second end 314 of the pedal tie 282 has advanced about one-fourth of the distance along the linear reciprocating path 318 toward the pivot axis 44. At this point, the varying angular displacement 382 between the top surface 162 of the pedal 56 and the reference plane 384 is about −3.5° while the angle 380 between the surface 162 and the top surface 378 of the moving track 276 remains 9°. In addition, the linear displacement 386 between the point 388 and the reference plane 384 has increased to about 13.7 inches while the angular displacement 390 between the moving track 276 and the reference plane 384 has increased to about 12.5°. This change in the angular displacement 382 also corresponds to a flexure of the foot in which the toe portion 58 is being raised above the heel portion 60. The weight distribution and flexure thus provided by the pedal actuation assembly 272 corresponds to that of the normal human gait.

Figure 22C:
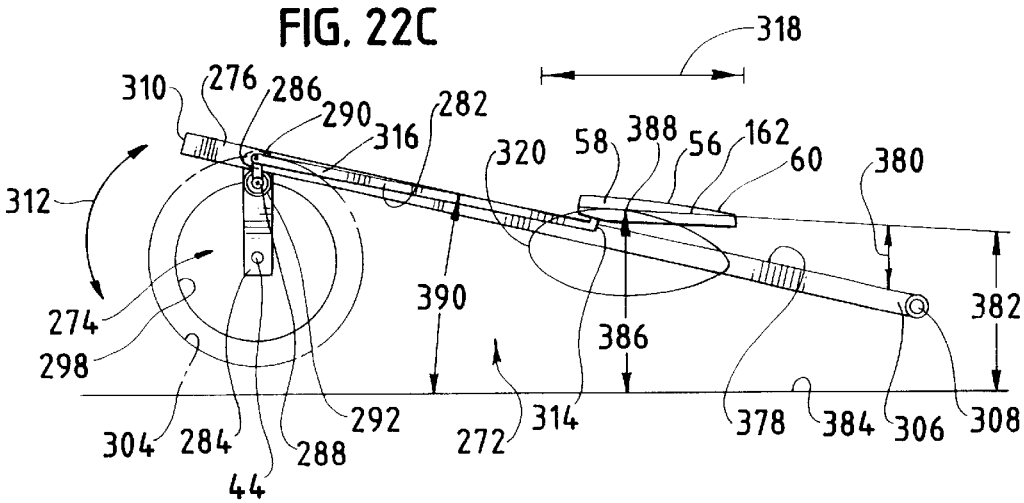

Forward rotation of the pulley 42 on the pivot axis 44 by about another 45° brings the pedal 56 to the position shown in FIG. 22C, at which point the second end 314 of the pedal tie 282 has traveled about half-way along the reciprocating linear path 318 towards the pivot axis 44. At this point, the varying angular displacement 382 between the top surface 162 of the pedal 56 and the reference plane 384 is about −4.3° while the angle 380 between the surface 162 and the top surface 378 of the moving track 276 remains 9°. In addition, the linear displacement 386 between the point 388 and the reference plane 384 has increased to about 15.6 inches while the angular displacement 390 between the moving track 276 and the reference plane 384 has increased to about 13.3°. This change in the angular displacement 382 also corresponds to a flexure in which the toe portion 58 is being raised even higher than the heel portion 60 as would occur in a normal non-assisted forward-stepping gait.

Figure 22D:
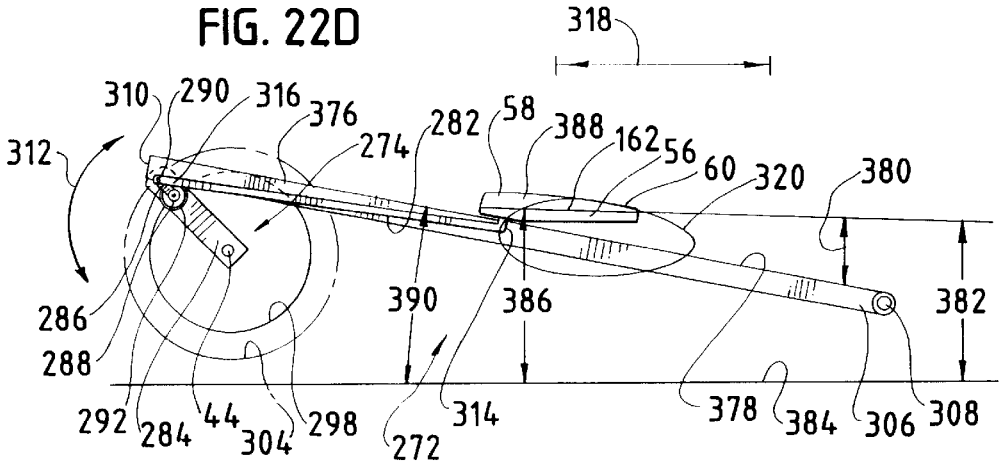

Forward rotation of the pulley 42 on the pivot axis 44 by about another 45° brings the pedal 56 to the position shown in FIG. 22D, at which point the second end 314 of the pedal tie 282 has traveled about three-fourths the distance along the reciprocating linear path 318 towards the pivot axis 44. At this point, the varying angular displacement 382 between the top surface 162 of the pedal 56 and the reference plane 384 is about −1.6° while the angle 380 between the surface 162 and the top surface 378 of the moving track 276 remains 9°. In addition, the linear displacement 386 between the point 388 and the reference plane 384 has decreased to about 15.4 inches while the angular displacement 390 between the moving track 276 and the reference plane 384 has decreased to about 10.6°.

Figure 22E:
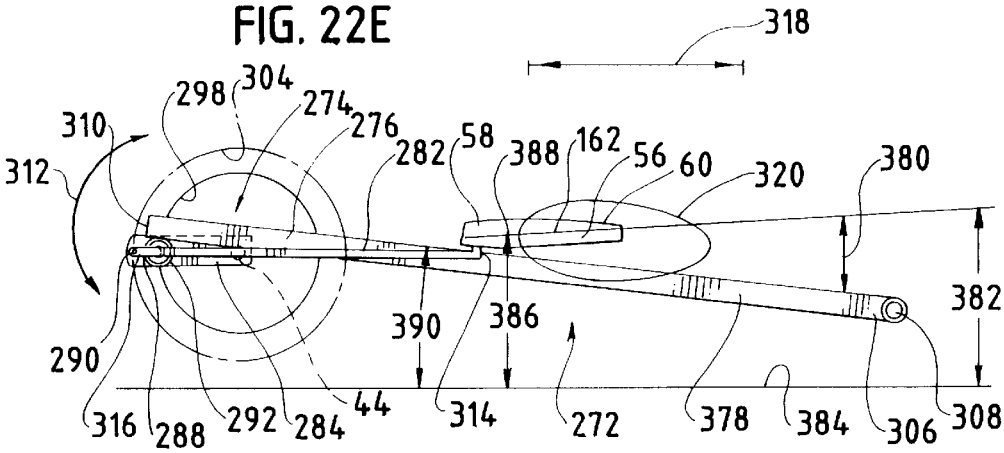

Continued rotation of the pulley 42 on the pivot axis 44 by another 45° brings the pedal 56 to the position shown in FIG. 22E, where the second end 314 of the pedal tie 282 has traveled the entire distance along the reciprocating path 318 towards the pivot axis 44 and is at the front-most position on the linear reciprocating path 318. The varying angular displacement 382 has now changed to about +3.0°, while the angle 380 remains 9°. The linear displacement 386 between the top surface 162 of the pedal 56 and the reference plane 384 has decreased to about 13 inches and the angular displacement 390 between the moving track 276 and the reference plane 384 has decreased to about 6.0°.

Figure 22F:
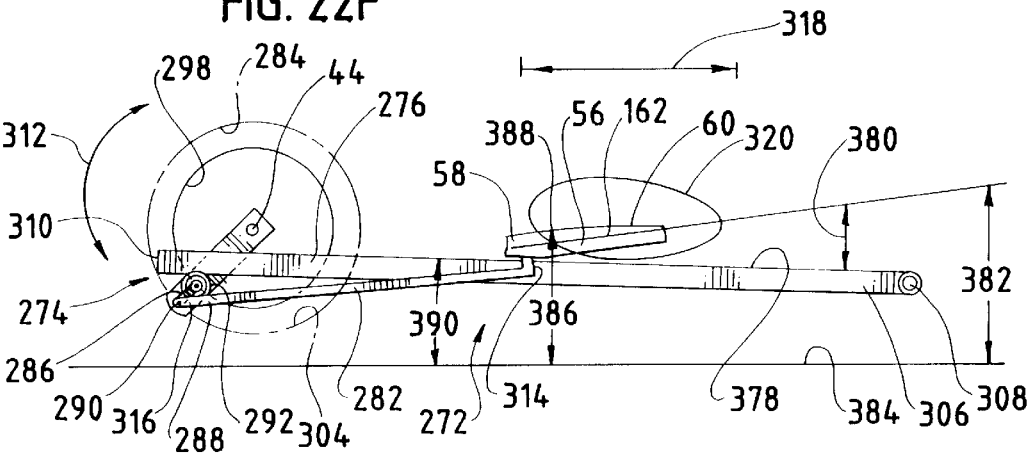

Forward rotation of the pulley 42 on the pivot axis 44 by another 45° moves the second end 314 of the pedal tie 382 backwards by about one-fourth of the distance along the reciprocating linear path 318, away from the pivot axis 44 and towards the pivot axis 308 of the moving track 276, and brings the pedal to the position shown in FIG. 22F. Although the angle 380 between the top surface 162 of the pedal and the top surface 378 of the moving track 276 remains 9°, the angular displacement 382 between the top surface 162 of the pedal 56 and the reference plane 384 has increased to about 7.2°. The linear displacement 386 between the point 388 and the reference plane 384 has decreased to about 10.4 inches and the angular displacement 390 between the moving track 276 and the reference plane 384 has decreased to about 1.8°. The pedal 56 is now in the lower portion of the elliptical path 320 which corresponds to the second half of the forward-stepping motion.

Figure 22G:
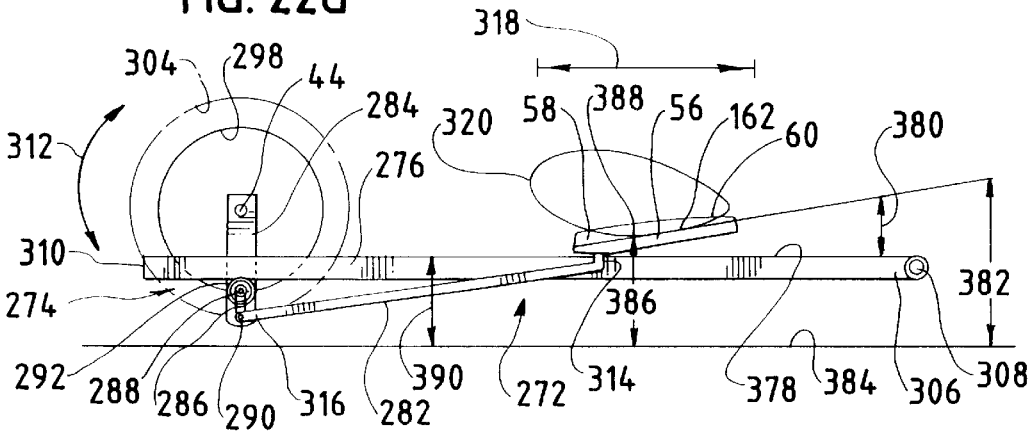

Continued rotation of the pulley 42 on the pivot axis 44 by another 45° brings the pedal 56 to the position shown in FIG. 22G, at which point the second end 314 of the pedal tie 282 has traveled backwards about half-way along the reciprocating linear path 318 towards the pivot axis 308 of the moving track 276. The angular displacement 382 between the top surface 162 of the pedal 56 and the reference plane 384 has increased to about +9° although the angle 380 remains 9°. The linear displacement 386 between the point 388 and the reference plane 384 has decreased even further, to about 9.3 inches, and the angular displacement 390 between the moving track 276 and the reference plane 384 has decreased to about 0°.

Figure 22H:
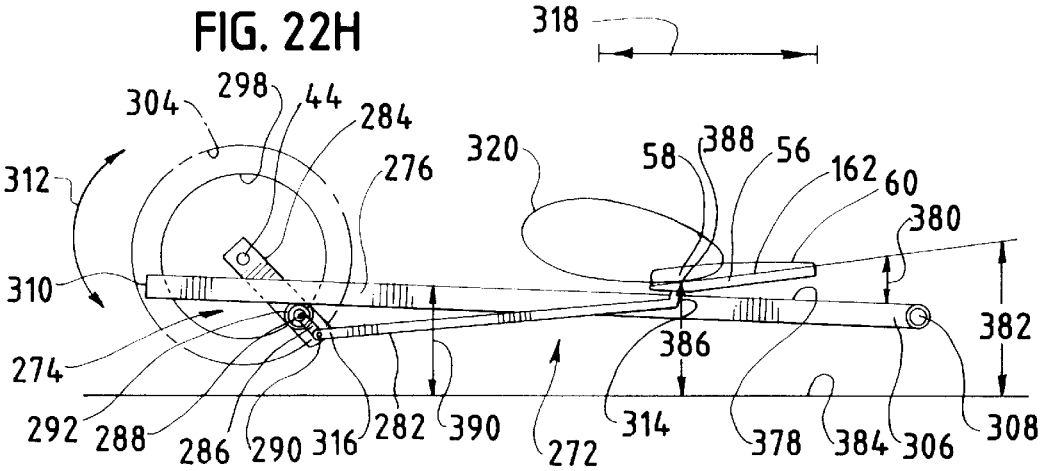

Forward rotation of the pulley 42 on the pivot axis 44 by another 45° moves the second end 314 of the pedal tie 282 backwards to a position that is about three-fourths of the distance along the reciprocating linear path 318, from the pivot axis 44 towards the pivot axis 308 of the moving track 276, and brings the pedal 56 to the position shown in FIG. 22H. Even though the angle 380 between the top surface 162 of the pedal 56 and the top surface 378 of the moving track 276 remains 9°, the angular displacement 382 between the top surface 162 and the reference plane 384 has decreased to about +6.8°. In addition, the linear displacement 386 between the point 388 on the top surface 162 of the pedal 56 and the reference plane 384 has increased to about 10 inches and the angular displacement 390 between the moving track 276 and the reference plane 384 has increased to about +2.2°. Continued rotation of the pulley 42 on the pivot axis 44 by another 45° completes the forward-stepping motion along the elliptical path 320 and brings the second end 314 of the pedal tie 382 back to the rearmost position along the reciprocating linear path 318 and the pedal 56 back to the position shown in FIG. 22A.

The forgoing examples of displacements and angles represent a preferred motion of pedal 56. It should be understood, however, that these motions can be changed by varying various parameters of the pedal actuation assembly 272 such as the lengths of the crank arms 284 and 286 and the length of the pedal tie 282 as well as changing the relative heights of the pivot axis 44 and the track pivot axis 308.

Figure 23:
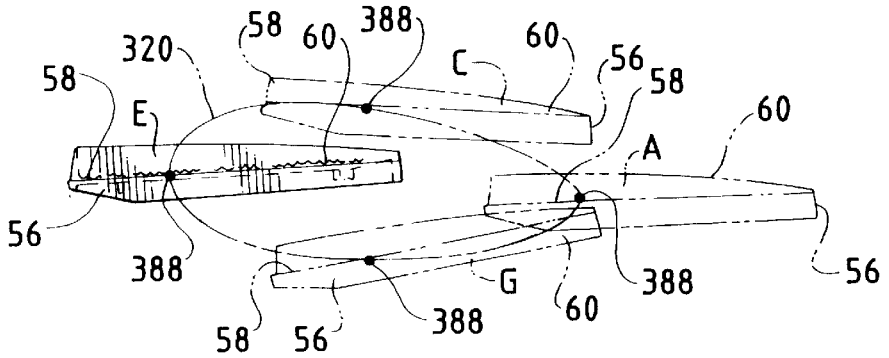
FIG. 23 is an illustration of the elliptical pathway traced by the pedal as the second end of the pedal tie completes the reciprocating path of travel shown in FIGS. 22A–22H.

FIG. 23 illustrates the elliptical path 320 with four of the previously-discussed positions of the pedal 56 superimposed thereon. Specifically, the pedal 56 labeled A represents the position and orientation of the pedal 56 as it appears in FIG. 22A. Similarly, the pedals labeled C, E, and G represent the position and orientation of the pedal 56 as it appears in FIGS. 22C, 22E, and 22G, respectively. It can thus be seen that the elliptical path 320 is produced by the combination of the vertical reciprocating linear motion of the second end 314 of the pedal tie 282 and the reciprocating arcuate motion of the first end 310 of the moving track 276. The length of the elliptical path 320 is governed by the reciprocating linear motion of the second end 314 of the pedal tie 282 which, in turn, results from the coupling it to the second axle 290 of the offset coupling assembly 274. The length of the elliptical path 320 is thus determined by the radius of the second circular path 304. The height of the elliptical path 320 is controlled by the reciprocating arcuate motion of the first end 310 of the track 276 which, in turn, is caused by the coupling to the first axle 288 of the offset coupling assembly 274. The height of the elliptical path 320 is thus determined by the radius of the first circular path 298.

Figure 24:
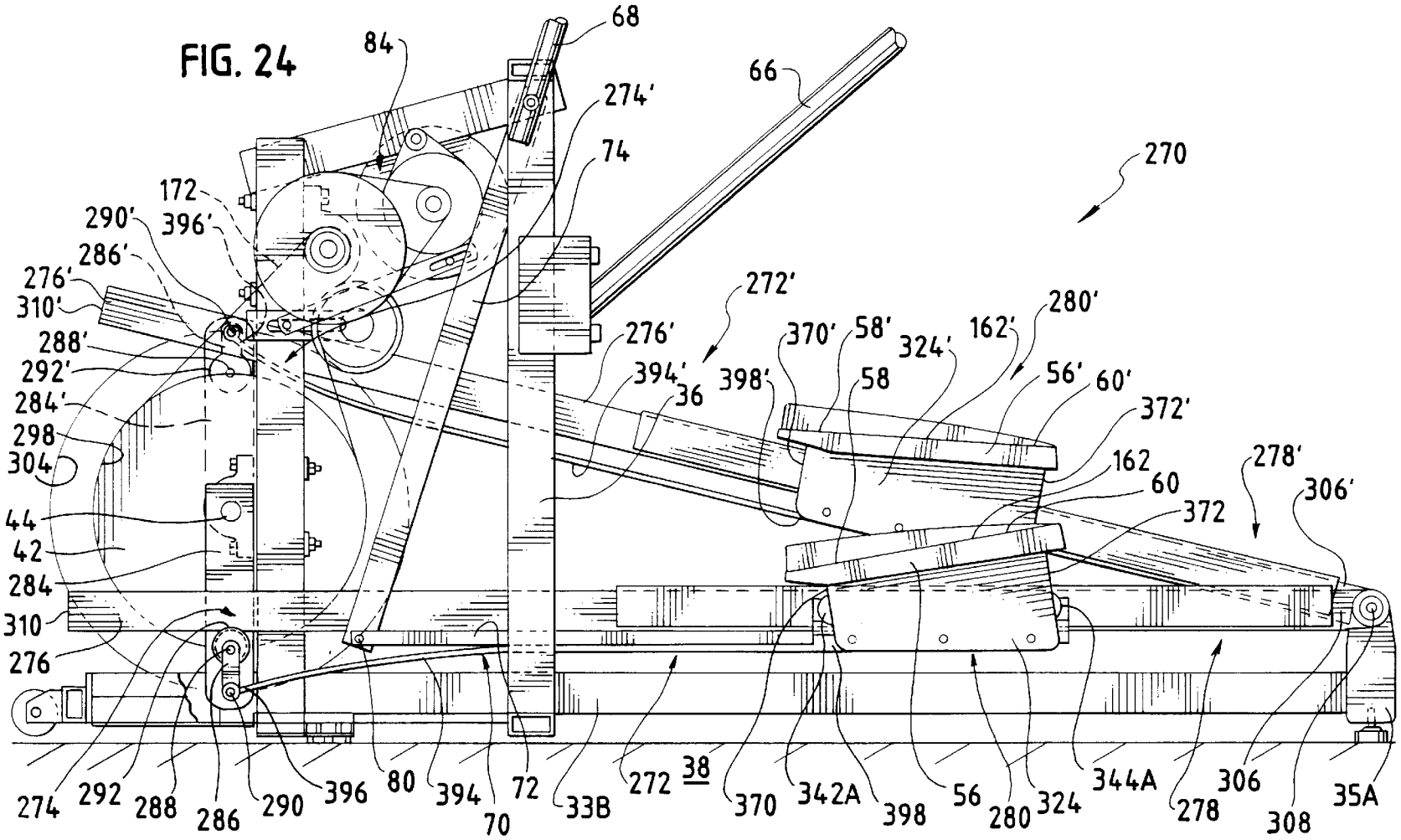
FIG. 24 is a partial side view of the exercise apparatus in FIG. 15 and shows a second embodiment of the pedal tie.

FIG. 24 shows a second embodiment 394 of a pedal tie that can be used in the pedal actuation assembly 272 of the apparatus 270. Like the previous embodiment 282, the pedal tie 394 couples the pedal assembly 280 to the offset coupling assembly 274. The pedal tie 394 differs from the previous embodiment 282 primarily in (1) the manner in which the pedal tie 394 is affixed to the pedal assembly 280 and (2) the physical characteristics of the pedal tie 394. Specifically, a first end 396 of the pedal tie 394 is pivotally secured to the second axle 290 of the offset coupling assembly 274 and a second end 398 of the pedal tie 394 is rigidly secured to the pedal assembly 280. Because the second end 398 is rigidly secured to the pedal assembly 280, changes in the angular relationship between the pedal tie 394 and the track 276 due to the different diameters of the circles 298 and 304 must be accommodated as the pulley 42 rotates. Therefore, the pedal tie 394 is constructed from a durable and flexible material that permits the pedal tie 394 to flex as the pulley 42 rotates. Any material that is both durable and appropriately flexible, for example, a flexible metal band, can be used to construct the pedal tie 394. The flexure of the pedal tie 394 accommodates these changes in angular relationship of the pedal tie 394 and the track which can occur as the pulley 42 rotates, without the need for a pivotal connection between the pedal tie 394 and the pedal assembly 280. For example, when the pedal 56 is in a position that corresponds to that shown in FIG. 22G, the pedal tie 394 flexes or bends as shown in FIG. 24. Similarly, when the pedal 56' is in a position that corresponds to that shown in FIG. 22C, the pedal tie 394' flexes or bends as shown in FIG. 24. It should be noted, however, that if the diameters of the circles 298 and 304 are the same, the pedal tie 394 will remain parallel to the track 276 and it would not be necessary for the pedal tie 394 to flex In all other respects, the pedal tie 394 and the apparatus 270 operate in the manner previously described with reference to FIGS. 22A–22H and 23.

Figure 25:
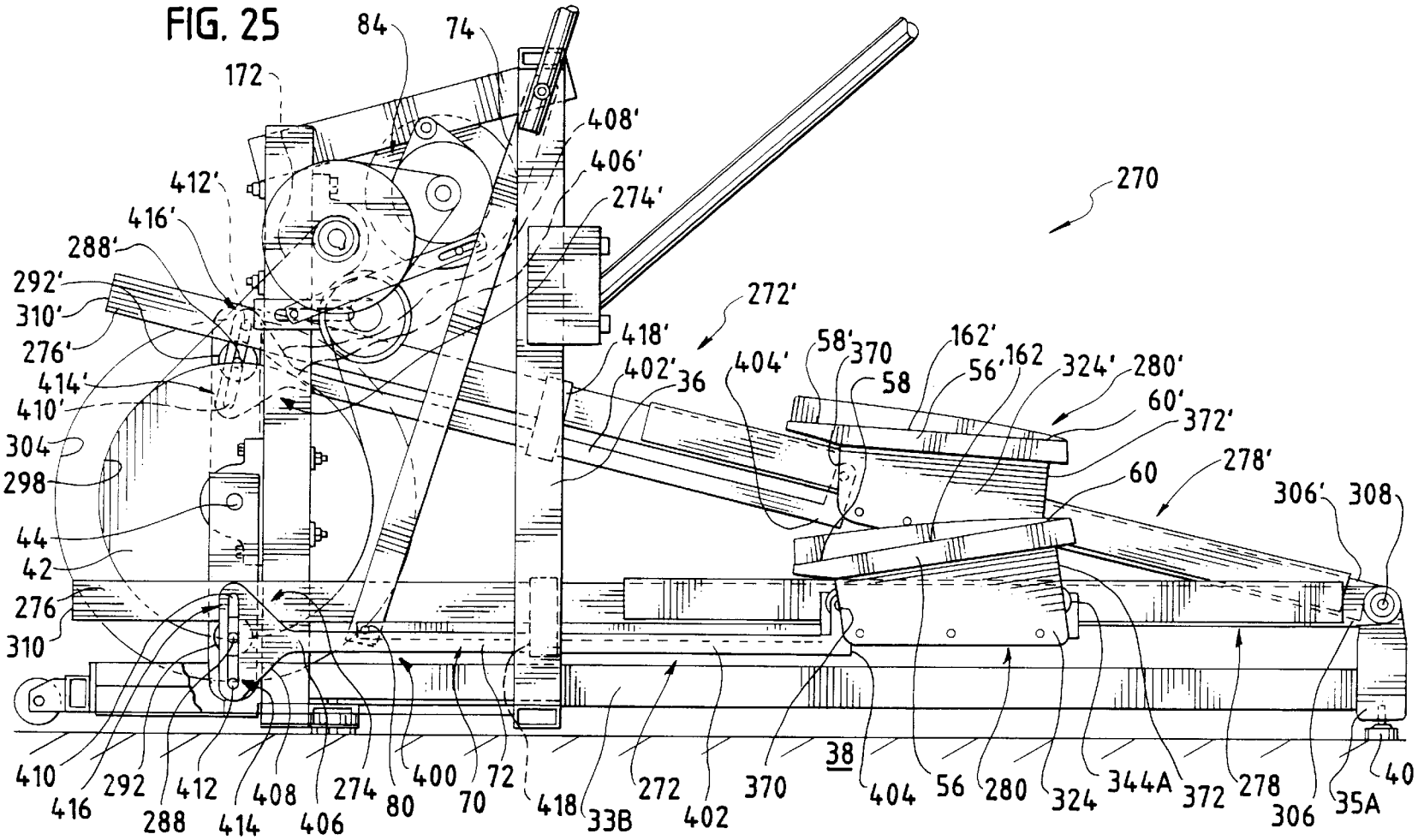
FIG. 25 is a partial side view of the exercise apparatus in FIG. 15 and shows a third embodiment of the pedal tie.

FIG. 25 shows a third embodiment of a pedal tie 400 that can be used in the pedal actuation assembly 272 of the apparatus 270. As with the previous embodiments 394, the pedal tie 400 couples the pedal assembly 280 to the second axle 290 of the offset coupling assembly 274. Similar to the previous embodiments 282 and 394, the pedal tie 400 includes an elongated member 402, the second end 404 of which is rigidly secured to the pedal assembly 280. Unlike the previous embodiments 282 and 394, the first end 406 of the pedal tie 400 includes a delta shaped portion 408. A slot 410 is formed in the delta shaped portion 408 and is in substantial orthogonal relationship with the pedal tie 400. The slot 410 in the pedal tie 400 is used in conjunction with a cam follower 412, or other similar mechanism, to couple the pedal tie 400 to the second axle 290 of the offset coupling assembly 274. Specifically, the cam follower 412 is an extension of the second axle 290 of the offset coupling assembly 290 and so follows the second circular path 304 as the pulley 42 rotates. The slot 410 is sized to receive the cam follower 412 so that as the cam follower 412 rotates in the second circular path 304 the cam follower 412 moves up and down the slot 410 and thereby accommodates the relative angular motion of the track 276 with respect to the pedal tie 400. The slot 410 in the pedal tie 400 thus accommodates the changes in orientation of the track 276 and the pedal tie 400 due to the different diameters of the circular paths 298 and 304. For example, when the pedal 56 is in a position that corresponds to that shown in FIG. 22G, the cam follower 412 is positioned within a lower portion 414 of the slot 410, as shown in FIG. 25. Similarly, when the pedal 56' is in a position that corresponds to that shown in FIG. 22C, the cam follower 412' is positioned within an upper portion 416' of the slot 410', as shown in FIG. 25. When the pedal actuation assembly 272 includes the pedal tie 400, the apparatus 270 additionally includes a pedal tie guide 418 which is secured to the track 276 and is positioned to guide the first elongated member 402 along a substantially linear path as the pulley 42 rotates. In all other respects, the pedal tie 400 and the apparatus 270 operate in the manner previously described with reference to FIGS. 22A–22H and 23.

Figure 26:
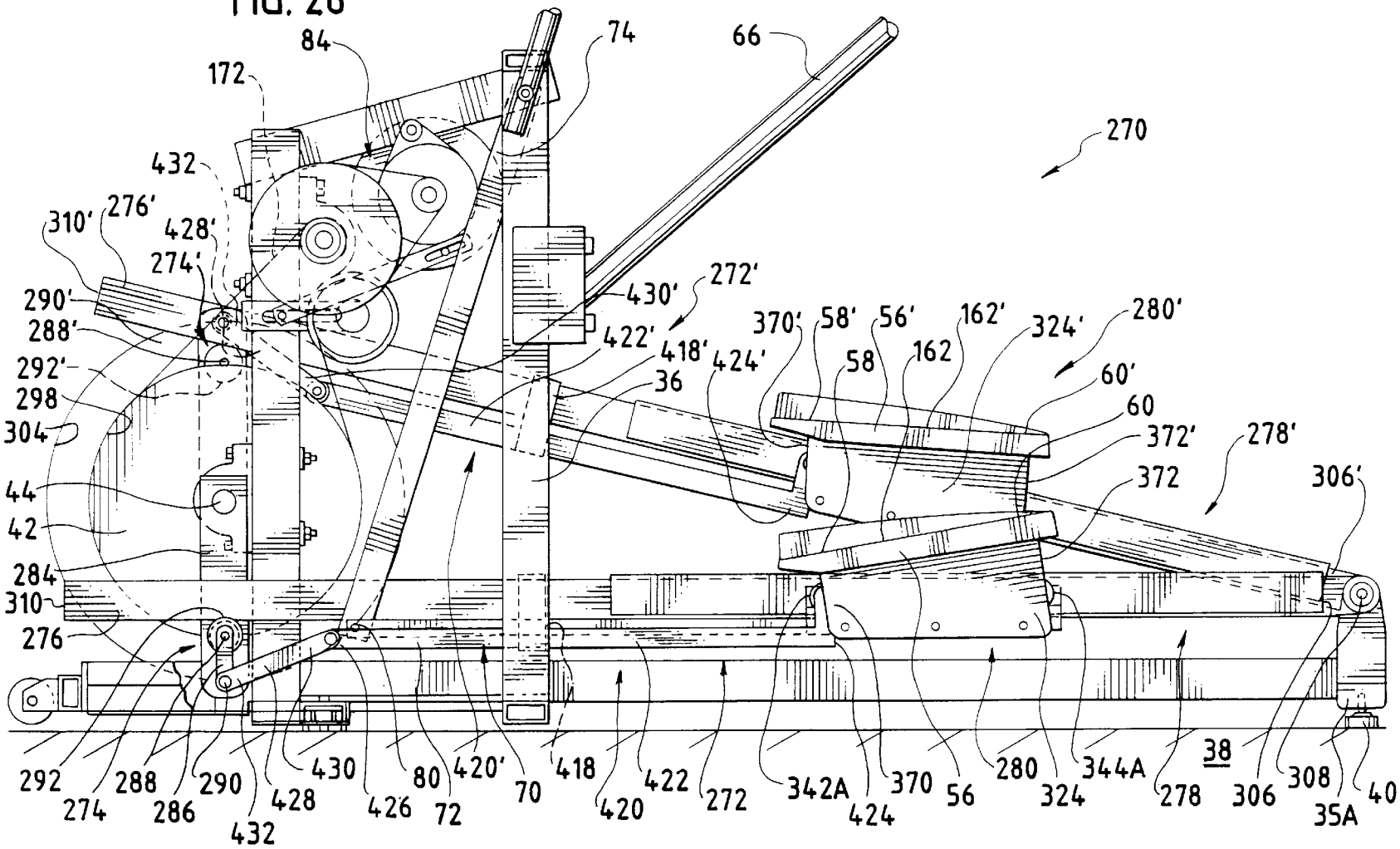
FIG. 26 is a partial side view of the exercise apparatus in FIG. 15 and shows a fourth embodiment of the pedal tie.
Figure 27:
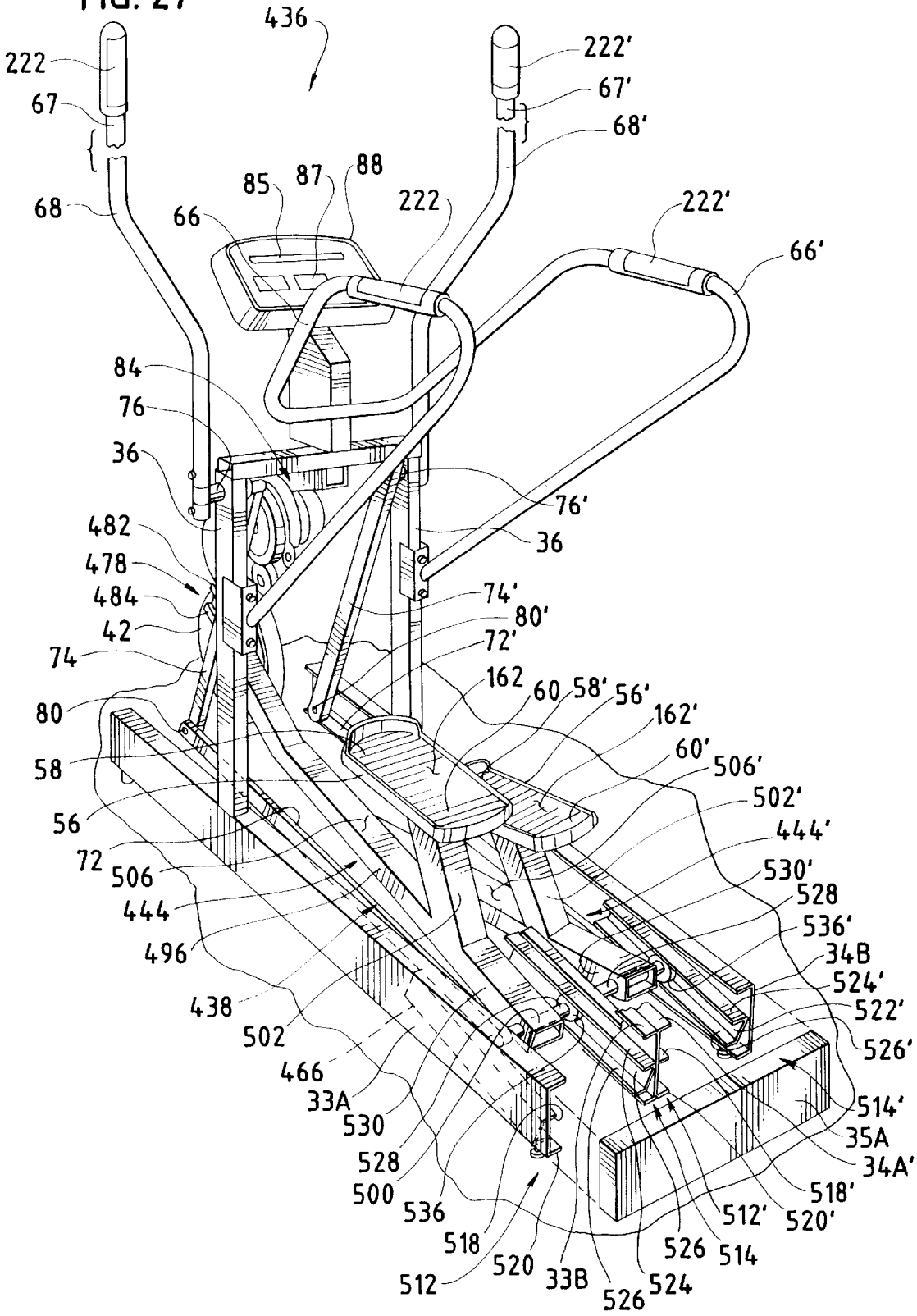
FIG. 27 is a side perspective view of the preferred embodiment of an exercise apparatus according to the invention.

FIG. 26 shows a fourth embodiment 420 of a pedal tie that can be used in the pedal actuation assembly 272 of the apparatus 270. Like the previous embodiments 282, 394, and 400, the pedal tie 420 couples the pedal assembly 280 to the second axle 290 of the offset coupling assembly 274. Similar to the previous embodiments 282, 394, and 400, the pedal tie 420 includes an elongated member 422, the second end 424 of which is rigidly secured to the pedal assembly 280. Unlike the previous embodiments 282, 394, and 400, the first end 426 of the first elongated member 422 is pivotally coupled to a second elongated member 428 at a second end 430 thereof. The first end 432 of the second elongated member 428, which also forms the first end of the pedal tie 420, is pivotably secured to the second axle 290 of the offset coupling assembly 274 and so moves in the second circular path 304 as the pulley 42 rotates. The pivotal connection between the first elongated member 422 and the second elongated member 428 of the pedal tie 420 accommodates the changes in orientation of the first end 432 and the pedal assembly 280 which necessarily occur as the pulley 42 rotates, without the need for pivotal linkages between the pedal tie 420 and the pedal assembly 280, by permitting the pedal tie 420 to pivot at the conjuncture between the first and second elongated members 422 and 428 as the pulley 42 rotates. For example, when the pedal 56 is in a position that corresponds to that shown in FIG. 22G, the first elongated member 428 pivots as shown in FIG. 24. Similarly, when the pedal 56' is in a position that corresponds to that shown in FIG. 22C, the first elongated member 428' pivots as shown in FIG. 24. When the pedal actuation assembly 272 includes the pedal tie 420, the apparatus 270 additionally includes the pedal tie guide 418 which is secured to the vertical member 36 and is positioned to guide the first elongated member 422 along a substantially linear path as the pulley 42 rotates. In all other respects, the pedal tie 424 and the apparatus 270 operate in the manner previously described with reference to FIGS. 22A–22H and 23.

This embodiment the cross training apparatus 270 can use the same programs as the previously described apparatus 30 and 270. When the user then operates the apparatus 270 as described above, the pedal 56 moves along the elliptical pathway 320 in a manner that simulates a natural heel to toe flexure that minimizes or eliminates stresses due to unnatural flexures. If the user employs the moving arm 68, the exercise apparatus 270 exercises the user's upper body concurrently with the user's lower body thereby providing a cross training workout. Alternatively, the user can concentrate his exercise session on his lower body by using the handrails 66.

IV. Detailed Description Of The Third General Embodiment

FIGS. 27–35 show a third and preferred embodiment 436 of an exercise apparatus according to the invention. As in the previous embodiments 30 and 270, the exercise apparatus 436 includes, but is not limited to, the frame 32, the pulley 42 and associated pivot axis 44, the pedal 56, the handrail 66, the moving arms 68, and the various motion controlling components, such as the alternator 82, the transmission 84, the microprocessor 86, the console 88, the power control board 184, the heart rate digital signal processing board 226, the communications board 256 and the central computer 258. However, unlike the previous embodiments 30 and 270, the preferred embodiment 436 of the invention generates an elliptical motion at the pulley 42. The apparatus 436 differs from the previous embodiments 30 and 270 in the exact nature and construction of the components which (1) provide an elliptical path for the pedal 56 and (2) provide the desired foot flexure and weight distribution.

As noted above, the third type of pedal actuation assembly is used to provide the desired elliptical motion of the pedal 56. FIGS. 27–29 and 33A–33H illustrate the preferred embodiment 438 of the third type of pedal actuation assembly which includes an ellipse generator 442 (best seen in FIGS. 33A–H) having an offset coupling assembly 440 (best seen on FIG. 30), a pedal bar 444, and a fixed, inclined track 466. As explained in more detail below, the ellipse generator 442 generates an elliptical path around the pivot axis 44. The pedal bar 444 is coupled to the ellipse generator 442 and operates in conjunction with the fixed, inclined track 446 to provide the desired generally elliptical motion of the pedal 56.

Figure 30:
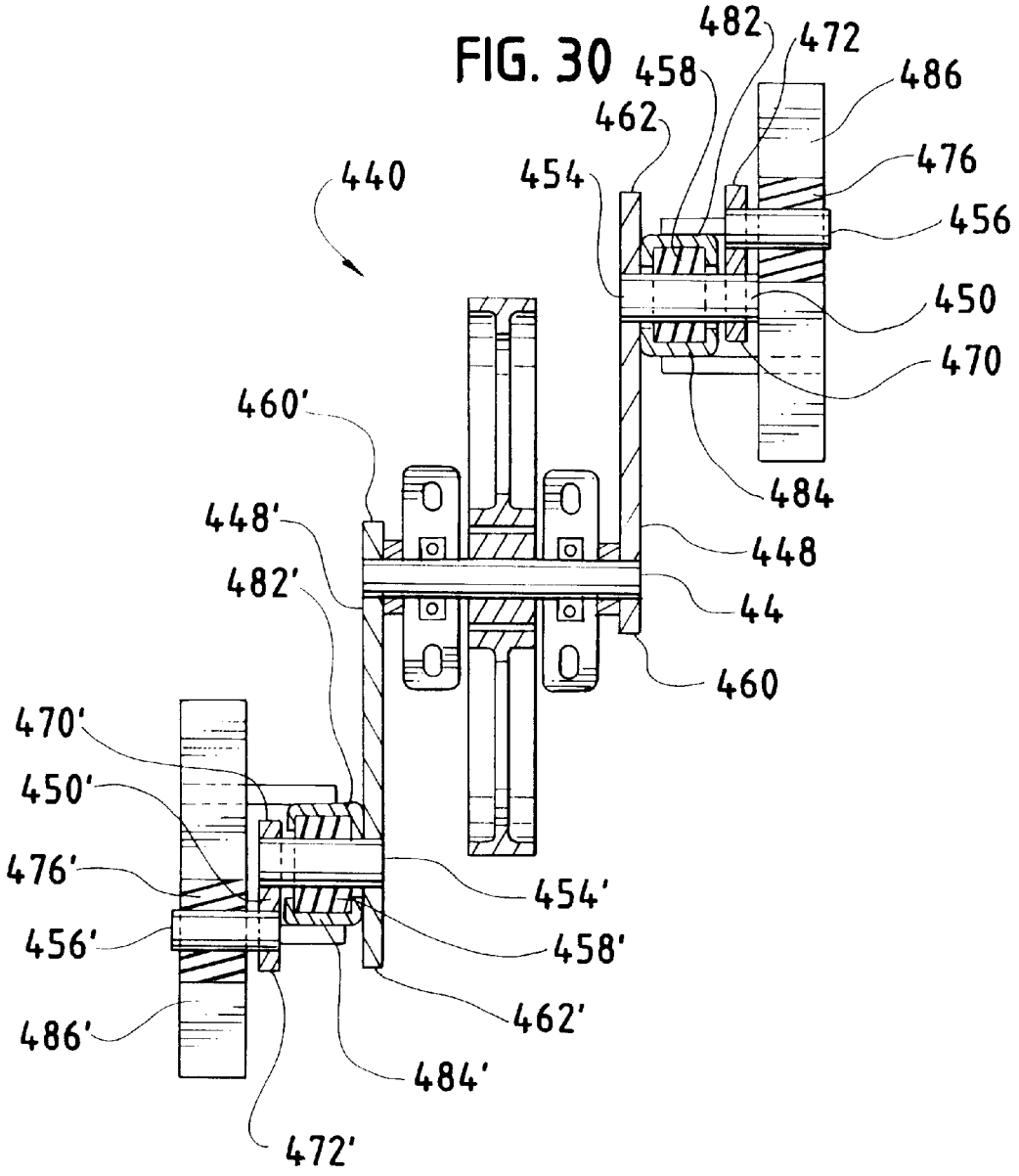
FIG. 30 is a front view of the offset coupling assembly which forms a part of the exercise apparatus in FIG. 27.

FIG. 30 shows the preferred embodiment of the offset coupling assembly 440 of the elliptical generator 442 which, like the offset coupling assembly 274 of the previous embodiment 270 of the invention, includes two crank arms 448 and 450, two axles 454 and 456, and a roller 458. A first end 460 of the first crank arm 448 is secured to the pulley pivot axis 44. The first axle 454 is secured to the first crank arm 448 proximate a second end 462 thereof and is substantially perpendicular to the first crank arm 448. As the pulley 42 rotates, the first axle 454 traces a first generally circular path 468 (shown in FIGS. 33A–33H). A first end 470 of the second crank arm 450 is secured to the first axle 454. The second axle 456 is secured to the second crank arm 450 proximate a second end 472 thereof and is substantially perpendicular to the second crank arm 450. The second axle 456 traces a second generally circular path 474 (shown in FIGS. 33A–33H) as the pulley 42 rotates. In the preferred embodiment, the second generally circular path 474 has a larger diameter than the first generally circular path 468. The diameters of the first and second circular paths 468 and 474 determine the vertical and horizontal dimensions, respectively, of the generated elliptical pedal 56 motion. The roller 458 is rotationally secured to the first axle 454 intermediate the first crank arm 448 and the second crank arm 450 and therefore moves in the first generally circular path 468 as the pulley 42 rotates on the pivot axis 44. The offset coupling assembly 440 further includes a second roller 476 which is rotationally secured to the second axle 456 and therefore moves in the second generally circular path 474 as the pulley 42 rotates.

Figure 29:
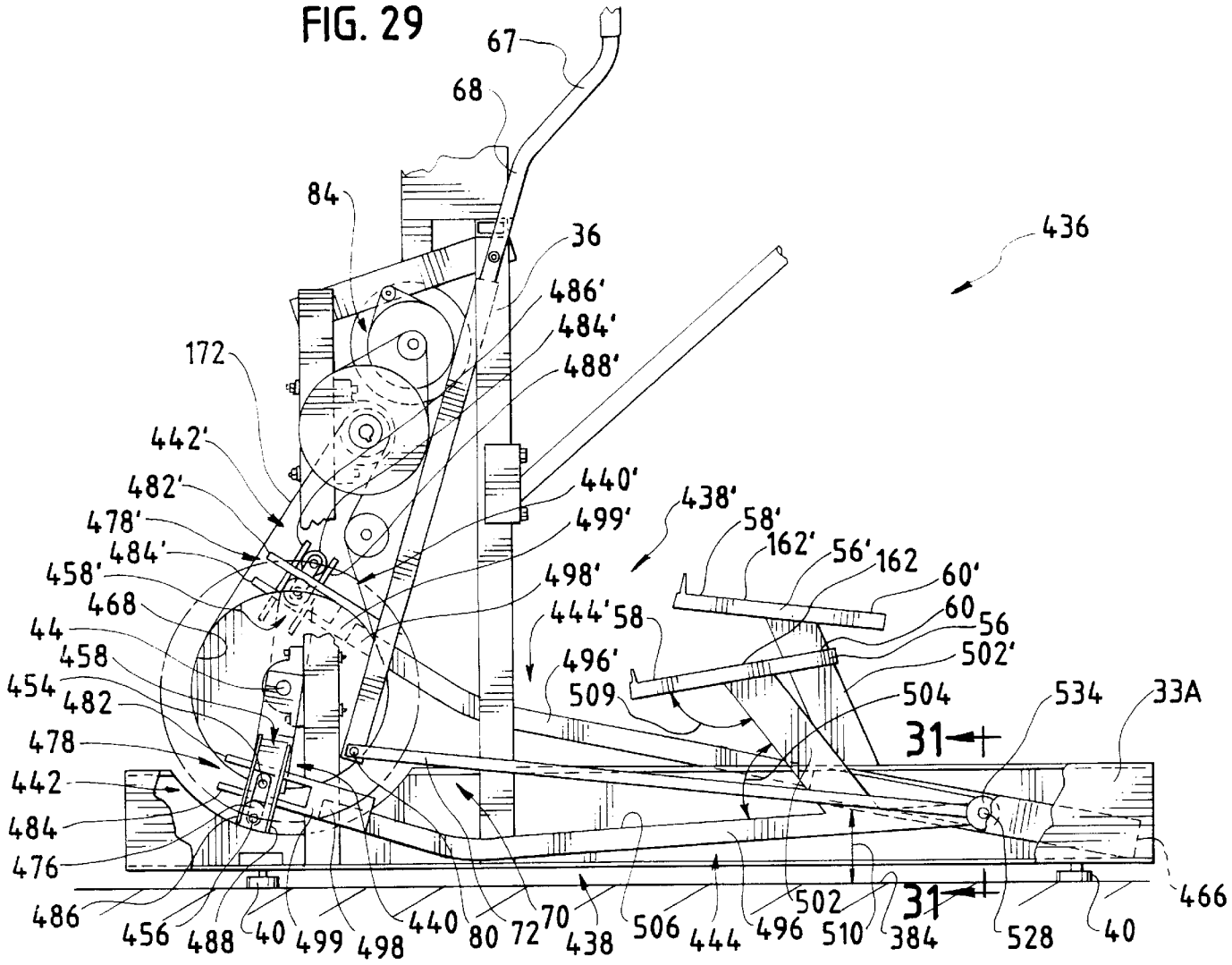
FIG. 29 is a partial side view of the exercise apparatus in FIG. 27 and shows the preferred embodiment of the pedal bar that forms a part of the apparatus.

As shown in FIG. 29, the ellipse generator 442 includes a pair of guides 478 and 480 that are in substantial orthogonal relationship with each other. A first channel is formed by a first and second spaced-apart substantially parallel bars 482 and 484 of the first guide 478. Similarly, a second channel is formed by a first and second spaced-apart substantially parallel bars 486 and 488 of the second guide 480. The two bars 482 and 484 of the first guide 478 are rigidly secured to the two bars 486 and 488 of the second guide 480 by any suitable securing means, for example, by welding. The first roller 458 of the offset coupling assembly 440 is positioned within the channel of the first guide 478 and can roll back and forth within the channel as the pulley 42 rotates on the pivot axis 42. Similarly, the second roller 476 of the offset coupling assembly 440 is positioned within the channel of the second guide 480 and can roll back and forth within the channel as the pulley 42 rotates. As is explained in more detail with reference to FIG. 32, the rotation of the second roller 476 in the second circular path 474 causes the first guide 478 to move in a first reciprocating linear path 490. The rotation of the first roller 458 in the first circular path 468 causes the second guide 480 to move in a second reciprocating linear path 492. The combination of the linear reciprocating paths 490 and 492 of the first and second guides 478 and 480 and of the first and second circular paths 468 and 474 of the offset coupling assembly rollers 458 and 476 causes the ellipse generator 442 to trace a substantially elliptical path 494 about the pivot axis 44. The vertical dimension of the elliptical path 494 is determined by the diameter of the first circular path 468 and the horizontal dimension of the ellipse 494 is determined by the diameter of the second circular path 474.

As illustrated in FIG. 29, the pedal bar 444 couples the pedal 56 to the ellipse generator 440 and thereby transmits the generated elliptical motion to the pedal 56. The preferred embodiment of the pedal bar 444 includes a first elongated member 496 which has a first end 498 that is rigidly secured to a portion 499 of the first guide 478 and a second end 500 that is rollingly coupled to the fixed track 446. The first end 498 of the elongated member 496 forms the first end of the pedal bar 444 and the second end 500 of the elongated member 496 forms the second end of the pedal bar 444. In the preferred embodiment, the elongated member 496 of the pedal bar 444 also includes an upwardly curved portion 501 that is near the first end 498. The pedal bar 444 also includes a vertical member 502 which extends upwardly at an angle 504 from a top surface 506 of the first elongated member 496. In the preferred embodiment, the angle 504 is about 115°. The pedal 56 is rigidly secured at a pre-determined angle 509 to the top 506 of the vertical member 502 by any suitable securing means, for example, by welding or by rivets or bolts. In the preferred embodiment, the angle 509 between the top surface 162 of the pedal 56 and the second elongated member 502 is about 60°. The track 446 is also positioned at a pre-determined angle 510 relative to the reference plane 384 of the floor 38. In the preferred embodiment, the angle 510 of the track 446 is about 10°. Together, the three angles 504, 509, and 510 contribute to the desired foot weight distribution and flexure.

Figure 28:
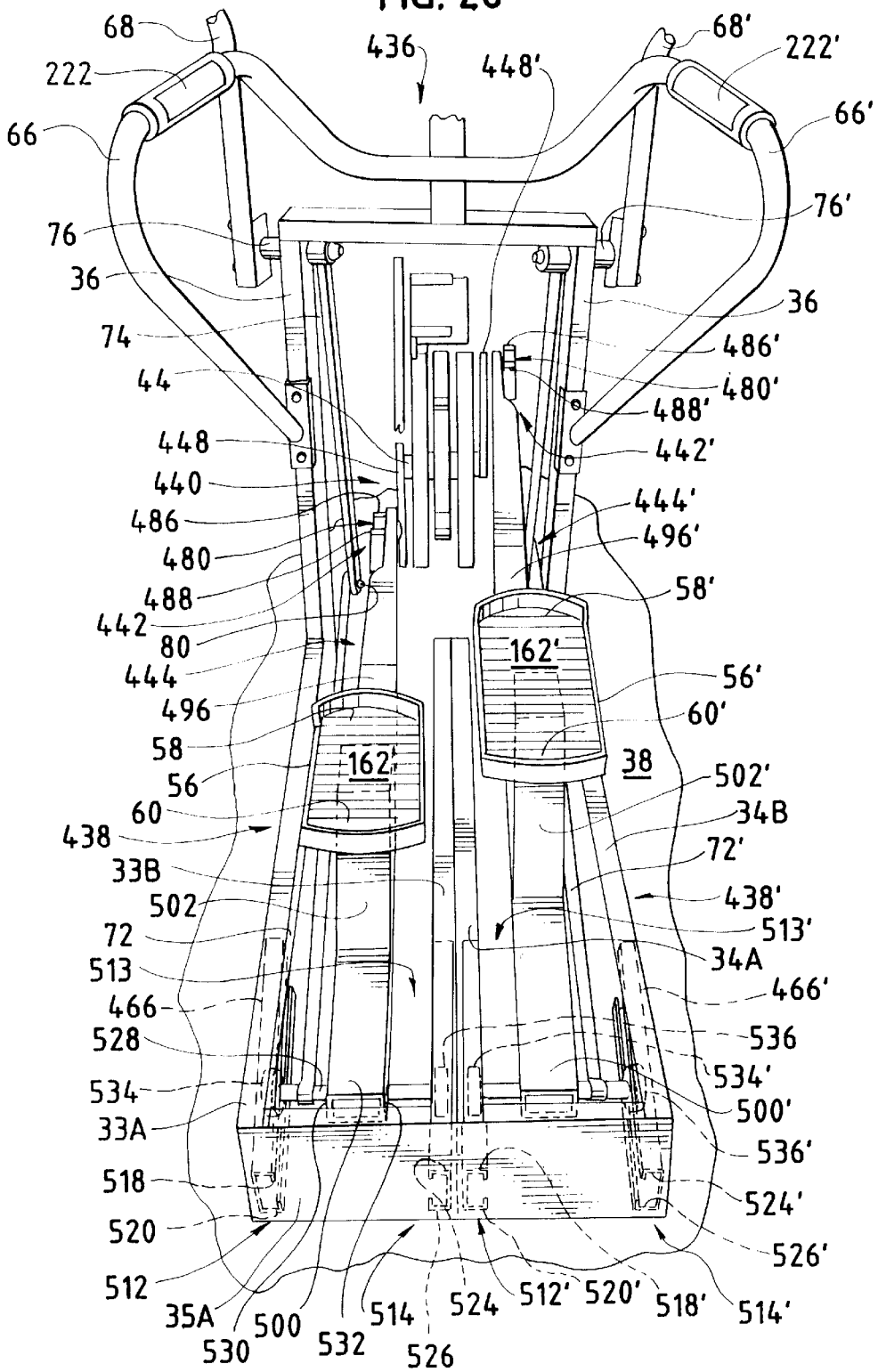
FIG. 28 is a partial rear perspective view of the exercise apparatus in FIG. 27.
Figure 31:
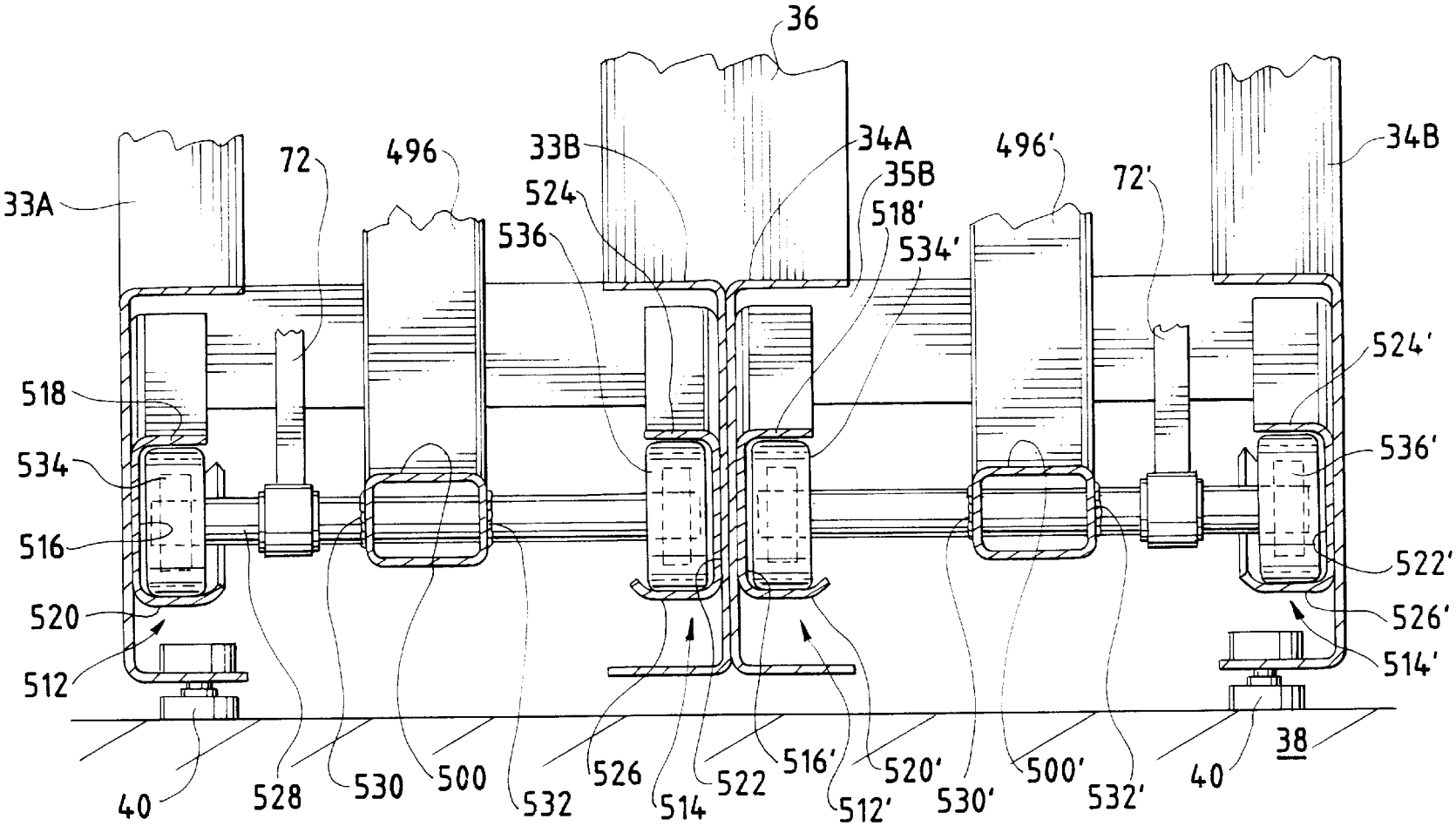
FIG. 31 is a cross sectional view along line 30—30 in FIG. 27.

Referring now to FIGS. 28 and 31, the track 446 includes a first track member 512 that is laterally spaced-apart from a second track member 514. The vertical member 502 of the pedal bar 444 extends upwardly through the guide 513. The first track member 512 includes a side portion 516 which is secured to and extends orthogonally between a top rail 518 and a bottom rail 520. The side portion 516 is fixedly secured to the longitudinal member 33A at the predetermined angle 510 by any suitable securing means, for example, be welding or by rivets. Similarly the second track member 514 includes a side portion 522 which is secured to and extends orthogonally between a top rail 524 and a bottom rail 526. The side portion 522 is fixedly secured to the longitudinal member 36 at the pre-determined angle 510 by any suitable securing means, for example, be welding or by rivets. As shown most clearly in FIG. 31, an axle 528 is secured to the second end 500 of the first elongated member 496 of the pedal bar 444 and extends outwardly from opposite sides 530 and 532 of the elongated member 496. A first roller 534 is rotationally secured to the axle 528 between the side portion 516 of the track member 512 and the side 530 of the elongated member 496. Similarly, a second roller 536 is rotationally secured to the axle 528 between the side portion 522 of the track member 514 and the side 532 of the elongated member 496. The first arm link 72 of the coupling assembly 70 is pivotally coupled to the axle 528 between the first roller 534 and the second end 500 of the pedal bar 444. The first roller 534 is positioned to engage the upper and lower rails 518 and 520 of the track member 512 and the second roller is positioned to engage the upper and lower rails 524 and 526 of the track member 514. The rollers 534 and 536 guide the second end 500 of the elongated member 496 along the track 446 as the pulley 42 rotates. Consequently, the second end 500 of the pedal bar 444 moves in a reciprocating linear path 538 (shown in FIGS. 33A–33H) as the pulley 42 rotates.

Figure 32:
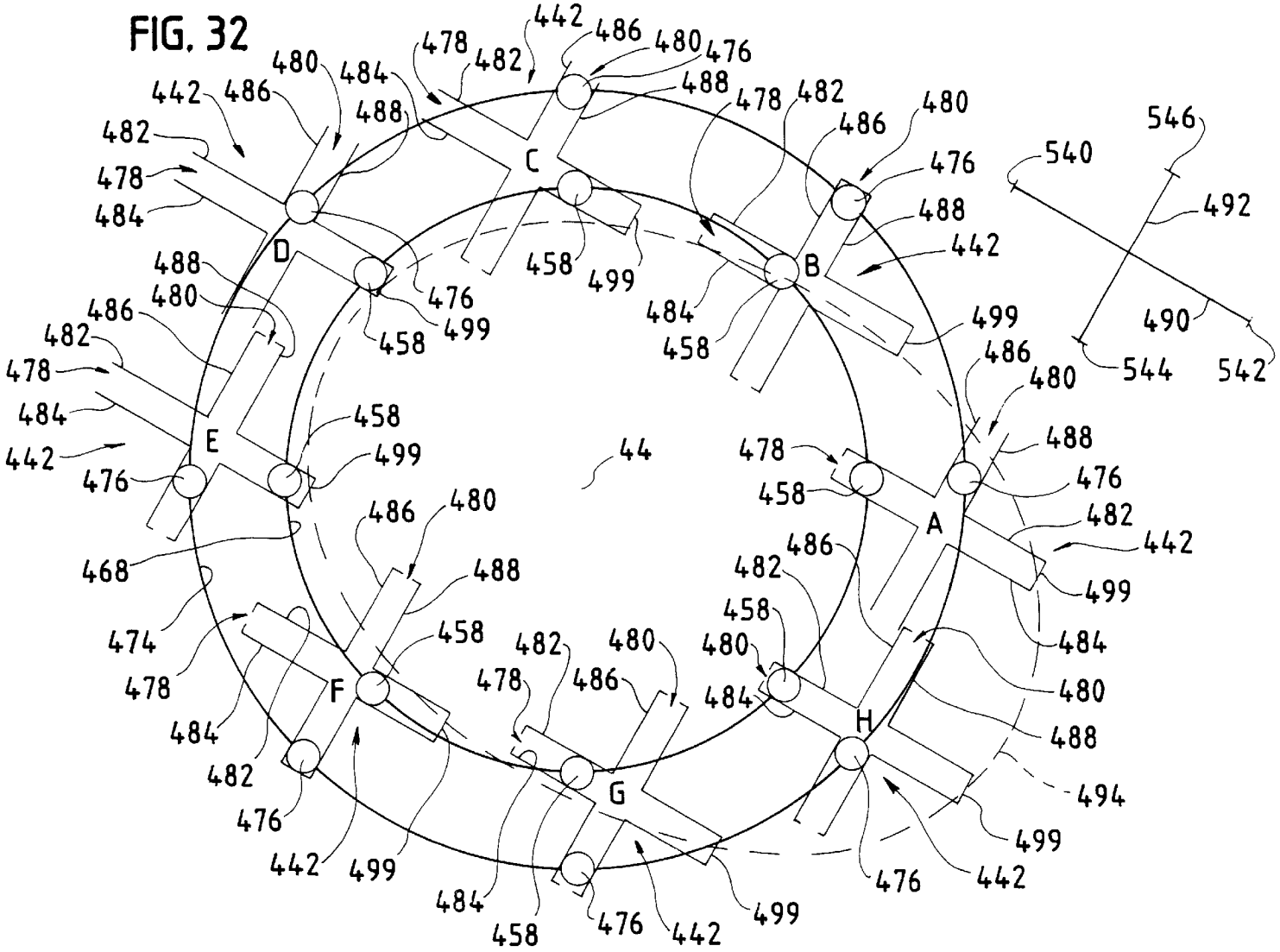
FIG. 32 is a stylized representation of the elliptical path generated by the ellipse generator which forms a part of the exercise apparatus in FIG. 27.

The contributions of the ellipse generator 442 and the pedal bar 444 to the desired elliptical motion are now explained generally with reference to FIG. 32. FIG. 32 shows the first and second circular paths 468 and 474 on which the first and second rollers 458 and 476 move as the pulley 42 rotates on the pivot axis 44. The ellipse generator 442 is superimposed on the circular paths 468 and 474 at eight positions labeled A–H. The positions A–H differ from each other by 45°. For example, starting at position A, forward rotation of the pulley 44 on the pivot axis 44 by 45° moves the ellipse generator 442 to position B. As shown in FIG. 29, it is to be understood that the first end 498 of the pedal bar 444 is secured to the portion 499 of the ellipse generator 442. For illustrative purposes, the orientation of the ellipse generator 442 is based on the assumption that the second end 500 of the pedal bar 444 is at an infinite distance from the pivot axis 44. FIG. 32 thus depicts an idealized rendition of the movement of the ellipse generator 442 about the pivot axis 44.

Beginning at position A, forward rotation of the pulley 42 on the pivot axis 44 by about 180° moves the offset coupling assembly rollers 458 and 476 along the first and second circular paths 468 and 474 and brings the ellipse generator 442 to position E. As the second roller 476 moves along the second circular path 474 from position A to position E, the second roller 476 is constrained by the second guide 480 guide, thereby moving the first guide 478 along the reciprocating linear path 490 towards a first end 540 of the path 490. Continued forward rotation of the pulley 42 on the pivot axis 44 by another 180° moves the rollers 458 and 476 and the ellipse generator 442 back to position A. As the second roller 576 moves on the second circular path 474 from position E to position A, the second roller 476 is constrained by the second guide 480, thereby moving the first guide 476 along the reciprocating linear path 490 towards a second end 542 thereof. Rotation of the second roller 476 along the second circular path 474 thus moves the first guide 478 back and forth along the reciprocating linear path 490. Consequently, the length of the reciprocating path 490 is determined by the radius of the second circular path 474. Similarly, beginning at position C, rotation of the pulley 42 on the pivot axis 44 by 180° brings the rollers 458 and 476 and the ellipse generator 442 to position G. As the first roller 458 moves in the first circular path 468 from position C to position G, the first roller 458 is constrained by the first guide 478, thereby moving the second guide 480 along the reciprocating linear path 492 towards a first end 544 thereof. Continued forward rotation of the pulley 42 on the pivot axis 44 by another 180° brings the rollers 458 and 476 and the ellipse generator 442 back to position C. As the first roller 458 moves along the first circular path 468 from position G to position C, the first roller 458 is constrained by the first guide 478, thereby moving the second guide 480 along the reciprocating linear path 492 towards a second end 546 thereof. Rotation of the first roller 458 along the first circular path 468 thus moves the second guide 480 back and forth along the reciprocating linear path 492. Consequently, the length of the reciprocating pathway 494 is determined by the radius of the first circular path 468.

The combination of the circular motions of the first and second rollers 458 and 476 and the reciprocating linear paths 490 and 492 of the first and second guides 478 and 480 thus produces the ellipse 494. The height of the ellipse 494 is determined by the radius of the first circular path 468 and the length of the ellipse 494 is determined by the radius of the second circular path 474. Unlike the previous two embodiments 30 and 270, the apparatus 436 produces an ellipse 494 about the pivot axis 44. In contrast, the previous two embodiments 30 and 270 provided elliptical motion at locations remote from the pivot axis 44: the embodiment 30 produced the ellipse 64 at a location intermediate the pivot axis 44 and the second end 54 of the pedal lever 46 and the embodiment 270 produced the ellipse 320 at the second end 314 of the pedal tie 282. The pedal bar 44 of the preferred embodiment 436 operates primarily to constrain the motion of the ellipse generator 442 so that the guides 478 and 480 move in the reciprocating paths 490 and 492 and to transmit the elliptical motion to the pedal 56 so that the pedal 56 moves in an elliptical path 548 as the portion 499 of the ellipse generator 442 and the first end 498 of the pedal bar 44 moves in the elliptical path 494 about the pivot axis 44.

The movement of the pedal 56, which is determined by the components of the pedal actuation assembly 438, is now discussed with reference to FIGS. 33A–33H and 34. FIGS. 33A–33H trace the motion of the pedal 56 as the pedal 56 completes one forward-stepping revolution along the elliptical path 548. As with the previous embodiments 30 and 70, the apparatus 436 can be operated in both a forward-stepping mode and in a backward-stepping mode. When the apparatus 436 is operated in the forward-stepping mode, the pedal 56 travels in the counter-clockwise sequence illustrated in FIGS. 33A–33H. When the apparatus 436 is operated in the back-ward stepping mode, the sequence is reversed so that the pedal 56 moves clockwise from the position shown in FIG. 33A to that shown in FIG. 33H. The angular relationships between the pedal bar 444 and the pedal 56, specifically the angle 504 (shown in FIG. 29) between the first elongated member 496 and the vertical member 502 and the angle 509 (shown in FIG. 29) between the top surface 162 of the pedal 56 and the vertical member 502, influence the manner in which the user's weight is distributed on the pedal 56 as the pedal 56 moves in the elliptical path 548. In particular, a varying angular displacement 550 between the top surface 162 and the reference plane 384 is generated as the pedal 56 moves in the elliptical path 548. The varying angular displacement 550 helps to provide a weight distribution and flexure that simulates a normal, non-assisted gait. Moreover, the motion of the pedal 56 along the elliptical path 548 generates a varying linear displacement 552 between the point 388 on the top surface 162 of the pedal 56 and the reference plane 384. Beginning in FIG. 33A, the second end 500 of the pedal bar 444 is at the rearmost position on the reciprocating linear path 538 and the ellipse generator 442 is in a location corresponding to position A in FIG. 32. At this point, the angular displacement 550 between the top surface 162 of the pedal 56 is about +0.5° and the linear displacement 552 between the point 388 and the plane 384 is about 15 inches.

Forward rotation of the pulley 42, as shown in FIGS. 33A–H, on the pivot axis 44 by about 45° moves the pedal 56 along the elliptical path 548 to the position shown in FIG. B. The second end 500 of the pedal bar 444 has advanced along the fixed, inclined track 446 toward the pivot axis 44 by about one-fourth of the reciprocating linear path 538 and the ellipse generator 442 has moved to a location corresponding to position B in FIG. 32. At this point, the angular displacement 550 between the surface 162 and the reference plane 384 is about −5° and the linear displacement 552 between the point 388 and the reference plane 384 is about 18 inches. The change in the angular displacement 550, from about +0.5° to about −5°, corresponds to a flexure in which the toe portion 58 is being raised above the heel portion 60.

Figure 33A:
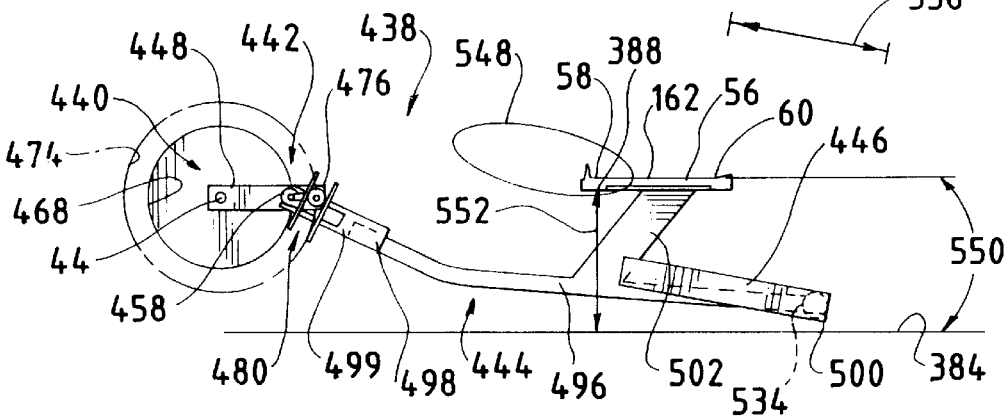
FIGS. 33A–33H are schematic representations of the reciprocating movement of the second end of the pedal bar.
Figure 33B:
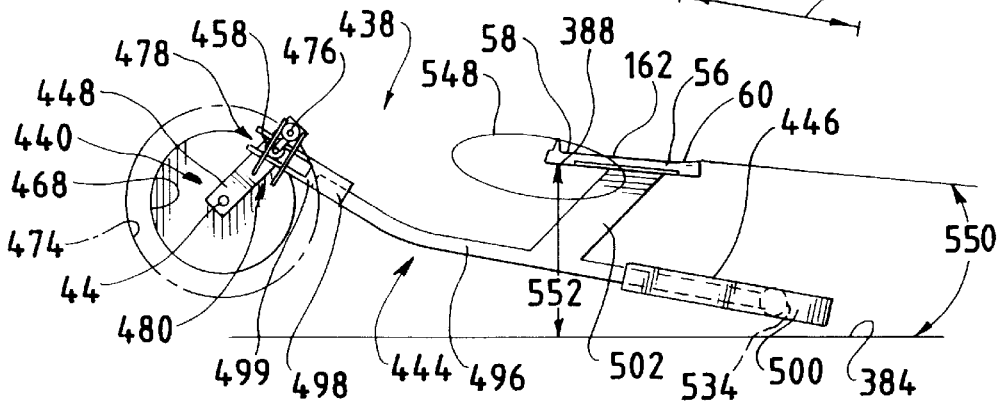
Figure 33C:
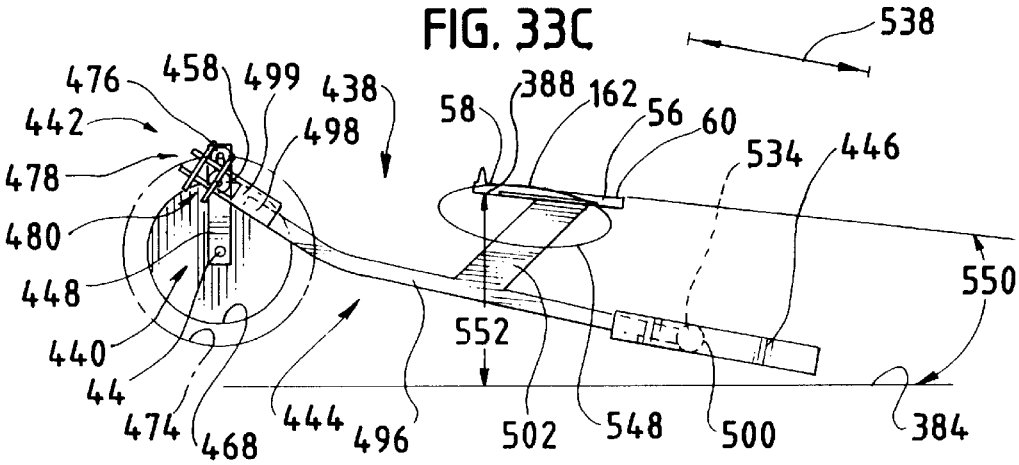

Then an additional forward rotation of the pulley 42 by about another 45° moves the pedal 56 along the elliptical path 548 to the position shown in FIG. 33C, at which point the second end 500 of the pedal bar 444 has advanced along the fixed, inclined track 446 toward the pivot axis 44 by about one-half of the reciprocating linear path 538 and the ellipse generator 442 has moved to a location corresponding to position C in FIG. 32. At this point, the varying angular displacement 550 between the top surface 162 of the pedal 56 and the reference plane 384 is about 7.1° and the varying linear displacement between the point 388 and the reference plane 384 is about 19 inches. The change in the angular displacement 550 also corresponds to a flexure in which the toe portion 58 is being raised even further above the heel portion 60.

Figure 33D:
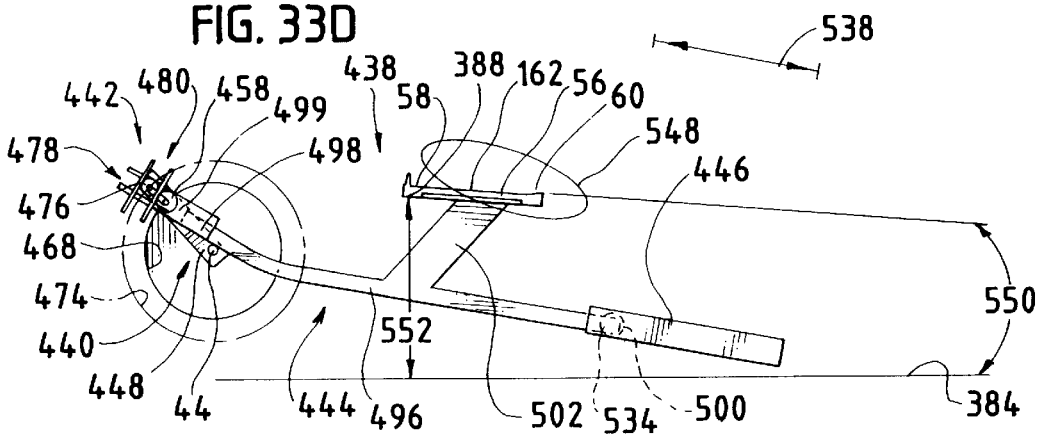

Another rotation of the pulley 42 on the pivot axis 44 by about 45° moves the pedal 56 along the elliptical path 548 to the position shown in FIG. 33D. The second end 500 of the pedal bar 444 has advanced about three-fourths of the way along the reciprocating linear path 538 toward the pivot axis 44 and the ellipse generator 442 has moved to a location corresponding to position D in FIG. 32. The varying angular displacement 550 is now about −4.1° and the varying linear displacement 552 is about 19 inches.

Figure 33E:
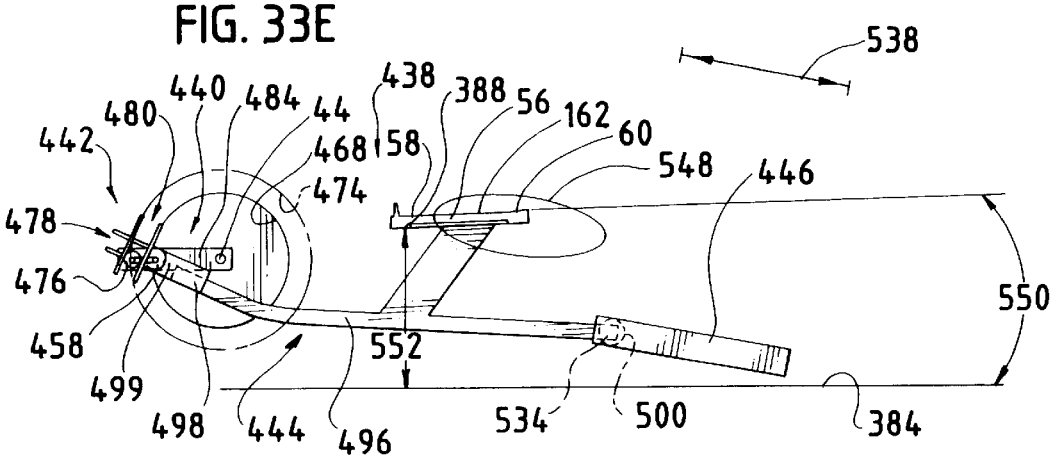

Continued forward rotation of the pulley 42 on the pivot axis 44 by another 45° moves the pedal 56 along the elliptical path 548 to the position shown in FIG. 33E, where the second end 550 of the pedal bar 444 has traveled the entire distance along the reciprocating linear path 538 towards the pivot axis 44 and the ellipse generator 442 has moved to a location corresponding to position E in FIG. 32. At this point, the varying angular displacement 550 is about +2° and the varying linear displacement 552 is about 18 inches.

Figure 33F:
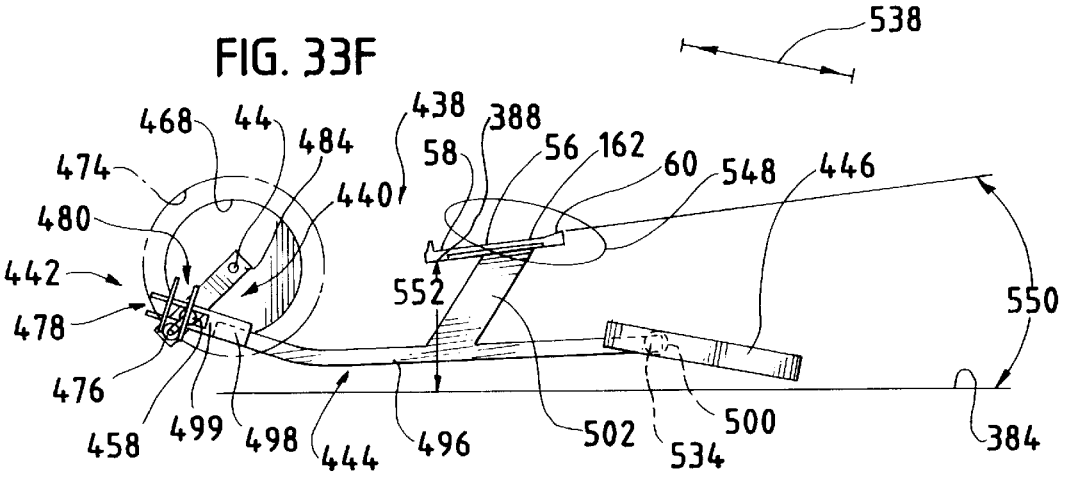

Another forward rotation of the pulley 42 on the pivot axis 44 by 45° moves the second end 500 of the pedal bar 44 backward, away from the pivot axis 44, by about one-forth of the reciprocating linear path 538 and moves the pedal 56 along the elliptical path 548 to the position shown in FIG. 33F. The ellipse generator 442 is now in a position corresponding to position F in FIG. 32. The varying angular displacement 550 between the top surface 162 of the pedal 56 and the reference plane has now increased to about +7.5° and the varying linear displacement 552 between the point 388 on the top surface 162 of the pedal 56 and the reference plane 384 has decreased to about 15 inches. The pedal 56 is now in the lower portion of the elliptical path 548 which corresponds to the second half of the forward-stepping motion.

Figure 33G:
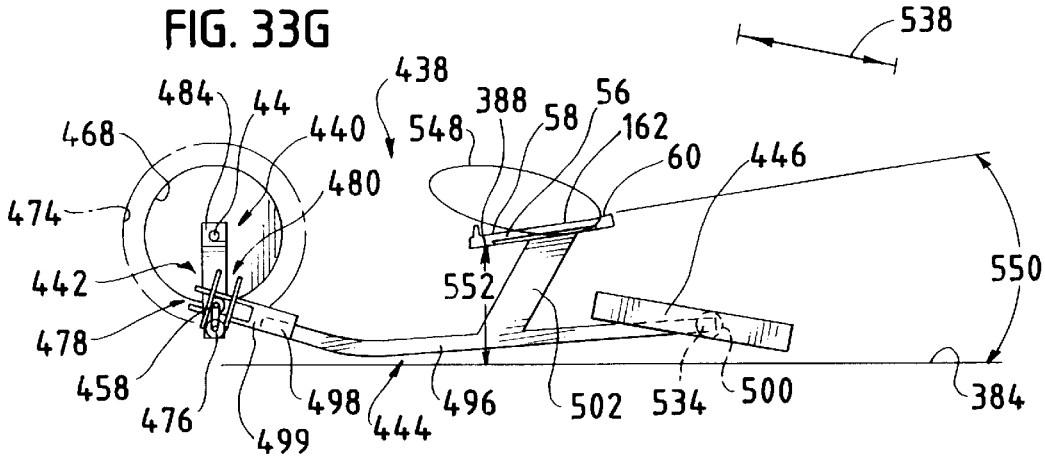

Continued forward rotation of the pulley 42 on the pivot axis 44 by about another 45° moves the pedal 56 along the elliptical path 548 to the position shown in FIG. 33G, at which point the second end 500 of the pedal bar 444 has traveled backwards about half-way along the reciprocating linear path 538 and the ellipse generator 442 has moved to a location that corresponds with position G in FIG. 32. The varying angular displacement 550 between the top surface 162 of the pedal 56 and the reference plane has increased even further to about +9° and the varying linear displacement 552 between the point 388 on the top surface 162 of the pedal 56 and the reference plane 384 has decreased to about 14 inches.

Figure 33H:
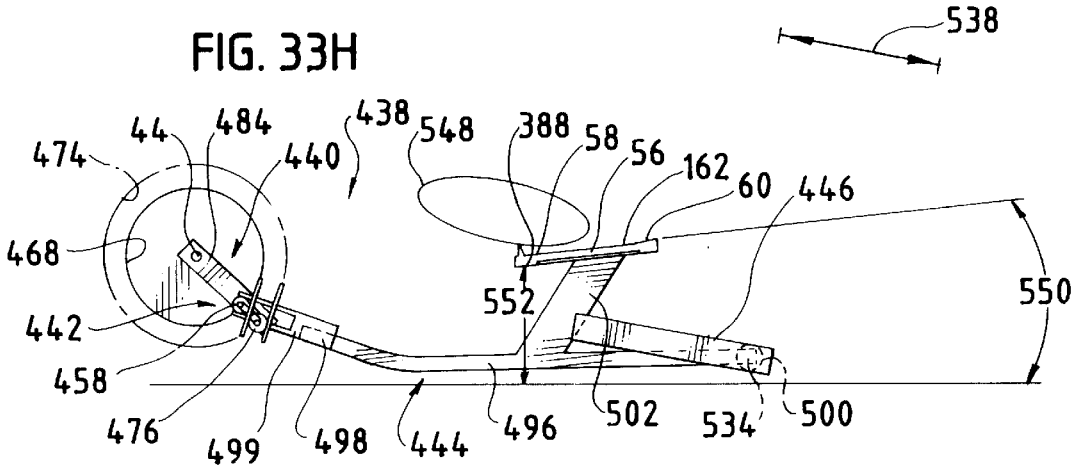

The final forward rotation of the pulley 42 on the pivot axis 44 by about another 45° moves the pedal 56 along the elliptical path 550 to the position shown in FIG. 33H. The second end 500 of the pedal bar 444 has now traveled backwards along the inclined track 446 by about three-fourths of the reciprocating linear path 538 and the ellipse generator 442 has moved to a location that corresponds with position H in FIG. 32. The varying angular displacement 550 between the top surface 162 of the pedal 56 and the reference plane has decreased to about +6.1° and the varying linear displacement 552 between the point 388 on the top surface 162 of the pedal 56 and the reference plane 384 remains at about 14 inches. Continued forward rotation of the pulley 42 on the pivot axis 44 by about another 45° completes the forward-stepping motion along the elliptical path 550 and brings the second end 550 of the pedal bar 444 back to the rearmost position along the reciprocating linear path 538 and the pedal 56 back to the position shown in FIG. 33A.

Figure 34:
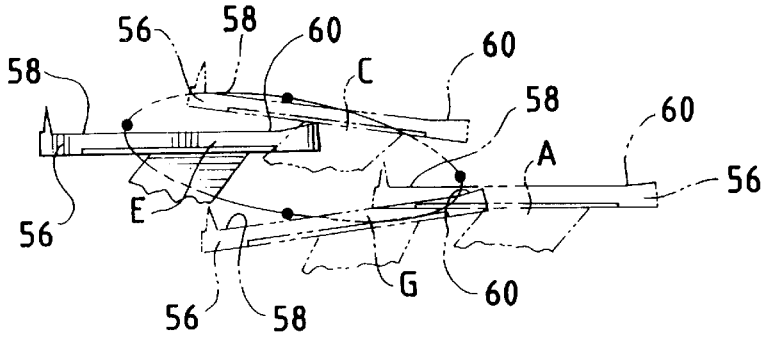
FIG. 34 is an illustration of the elliptical pathway traced by the pedal as second end of the pedal bar completes the reciprocating path of travel shown in FIGS. 33A–33H.

FIG. 34 illustrates the elliptical path 538 with four of the previously-discussed positions of the pedal 56 superimposed thereon. Specifically, the pedal labeled A represents the position and orientation of the pedal 56 at it appears in FIG. 33A. Similarly, the pedals labeled C, E, and G represent the position and orientation of the pedal 56 as it appears in FIGS. 33C, 33E, and 33G, respectively. As with the pedal actuation assemblies 163 and 272 of the previous embodiments 30 and 270, the pedal actuation assembly 438 of the preferred embodiment 436 of the invention thus causes the pedal 56 to move in a substantially elliptical path 538 in a manner which simulates a normal, non-assisted gait. In particular, the circular motions of the offset coupling assembly rollers 458 and 476, when combined with the reciprocating linear motions of the two guides 478 and 480, produce an elliptical path 494 about the pivot axis 44 of the pulley 42. The first end 498 of the pedal bar 444, which is rigidly secured to the portion 499 of the ellipse generator 442, therefore moves along the elliptical path 494 as the pulley 42 rotates. In contrast, in the first embodiment 30, the first end 50 of the pedal lever 46 moves in the circular path 51 as the pulley 42 rotates. Moreover, in the second embodiment 270, the first end 316 of the pedal tie 282 moves in the circular path 304 and the first end 310 of the moving track 376 moves in the reciprocating arcuate path 312 as the pulley 42 rotates.

The preferred embodiment 436, like the previous embodiment 270, offers the advantage that the dimensions of the elliptical motion can be varied independently by varying the sizes of the first and second circular paths. The distances and angles as discussed above in connection with FIGS. 33A–H represent a preferred example of the motion of pedal 56. However, by modifying various parameters of the exercise apparatus 436, it is possible to provide different pedal motions. For example, the heights of the elliptical paths 494 and 548 can be increased by lengthening the first crank arm 448 and thereby increasing the distance between the pivot axis 44 and the first axle 454 of the offset coupling assembly 440. Similarly, the lengths of the elliptical paths 494 and 548 can be varied by changing the length of the second crank arm 450 of the offset coupling assembly 440.

Figure 35:
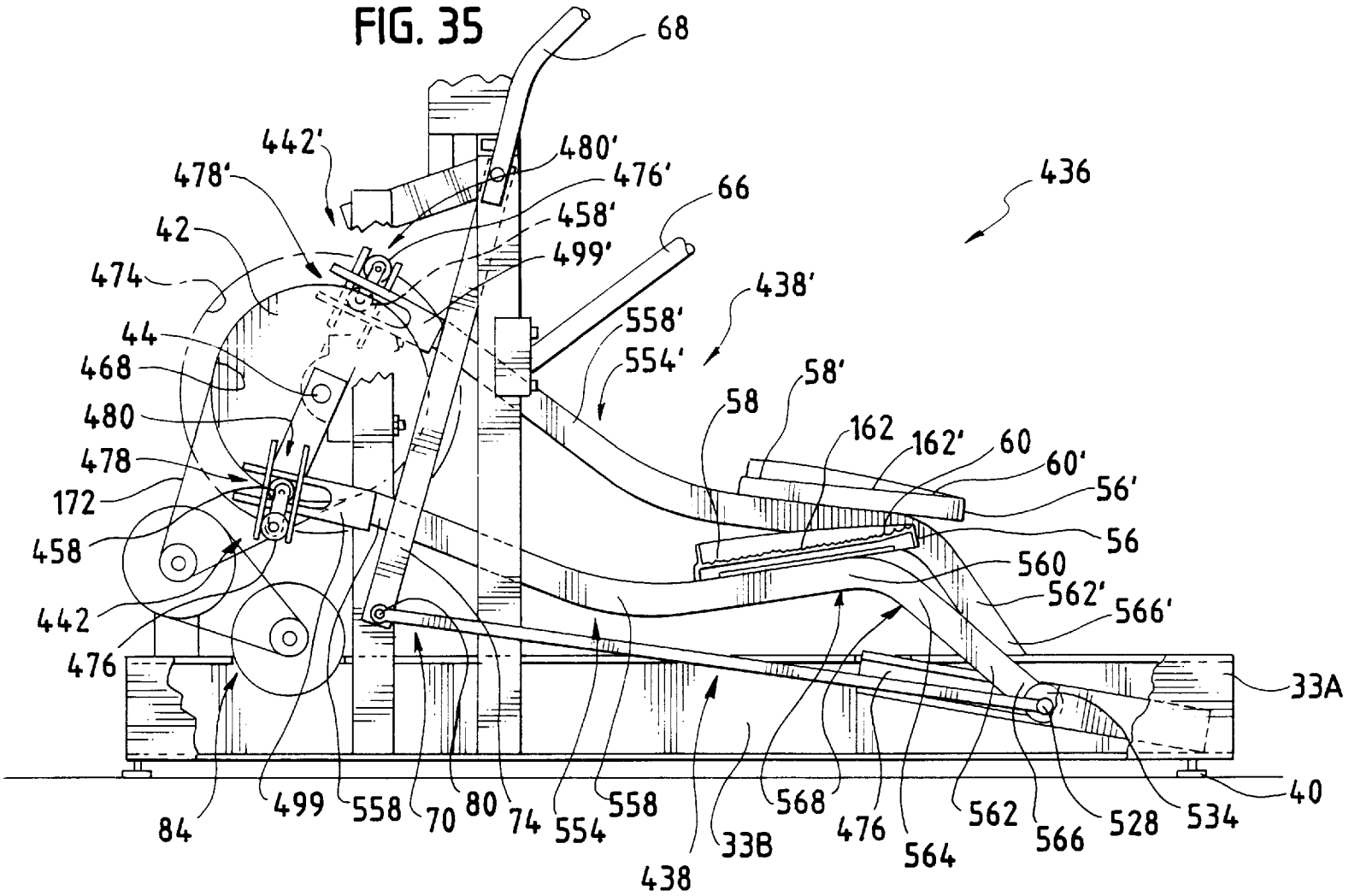
FIG. 35 is a partial side view of the exercise apparatus in FIG. 27 and shows an alternative embodiment of the pedal tie.

FIG. 35 shows a second embodiment 554 of a pedal bar that can be used in the pedal actuation assembly 438 of the apparatus 436. As with the previous embodiment 444, the pedal bar 554 transmits the elliptical motion generated proximate the pivot axis 44 to the pedal 56. The pedal bar 554 differs from the previous embodiment 444 in its shape. The pedal bar 554 includes a first elongated member 556 which has a first end 558 that is rigidly secured to the portion 499 of the ellipse generator 442. A second end 560 of the elongated member 554 is rigidly secured to a second elongated member 562 at a first end 564 thereof. The axle 528 extends through a second end 566 of the second elongated member 562. The rollers 534 and 536 are pivotally coupled to the axle 528 as previously described. The second end 566 of the second elongated member 562 thus rolling engages the track 446. The first end 558 of the first elongated member 556 forms the first end of the pedal bar 554 and the second end 566 of the second elongated member 562 forms the second end of the pedal bar 554. The second elongated member 562 extends downwardly from the first elongated member 556 at a pre-determined angle 568 which, in the preferred embodiment of the pedal bar 554, is about 131°. The pedal 56 is rigidly secured to a top surface 570 of the first elongated member 558 near the second end 560 thereof. In all other respects, the pedal bar 554 and the apparatus 436 operate in the manner previously described with reference to FIGS. 33A–33H and 34.

Figure 36:
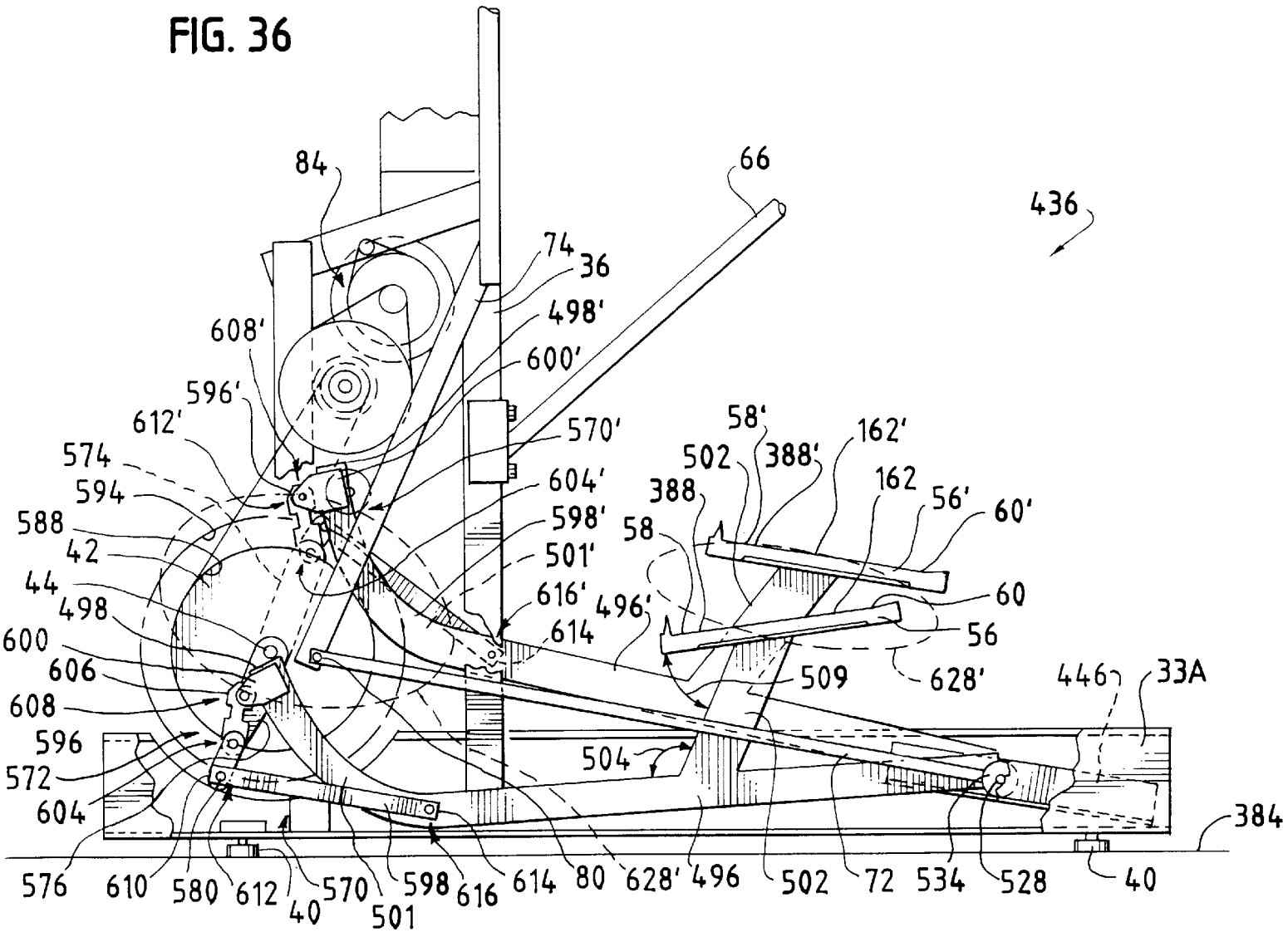
FIG. 36 is a partial side view of the apparatus in FIG. 27 and shows the preferred embodiments of the ellipse generator and the offset coupling assembly.
Figure 37:
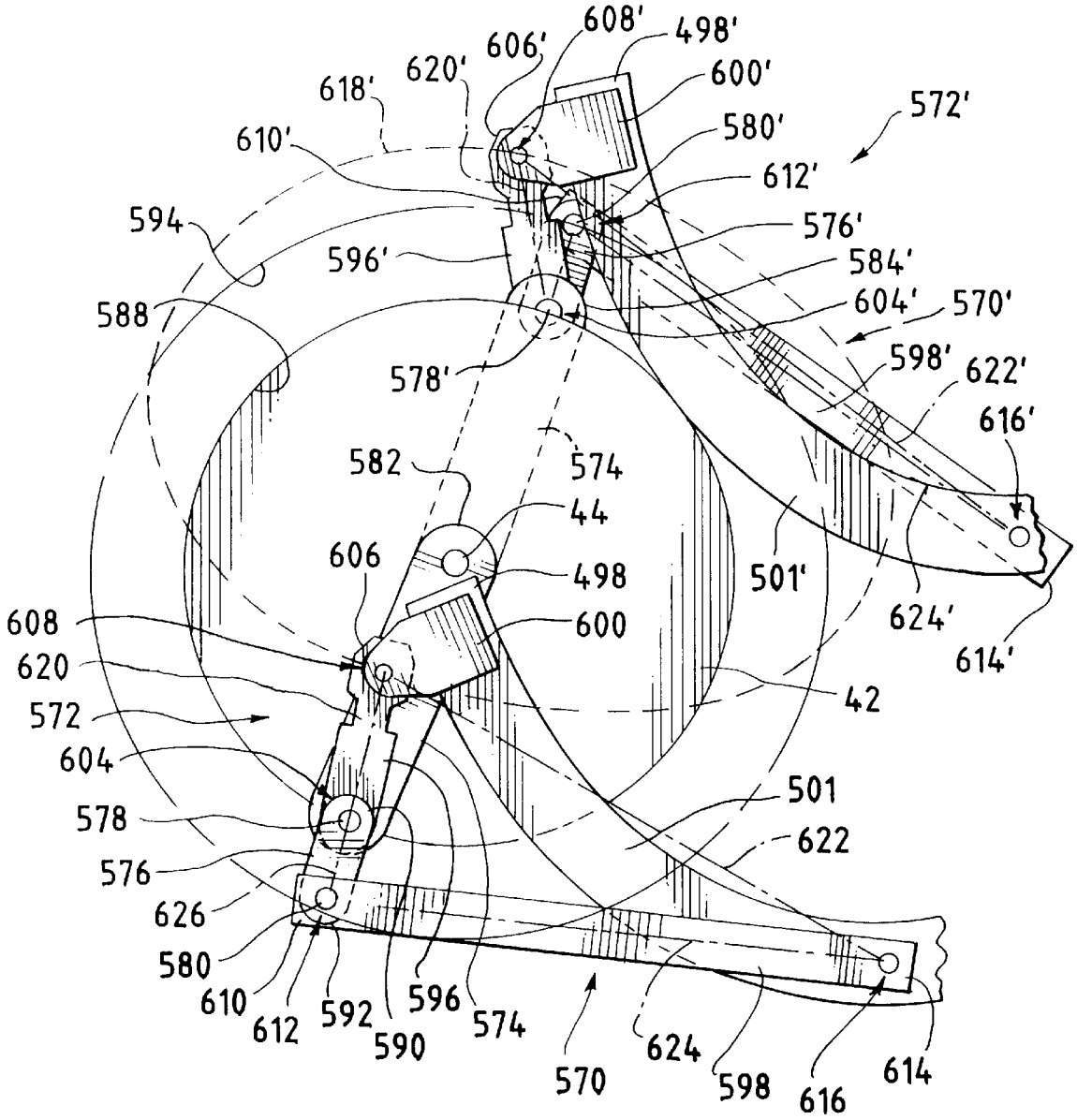
FIG. 37 is an enlarged front view of the ellipse generator and the offset coupling assembly in FIG. 36.
Figure 38:
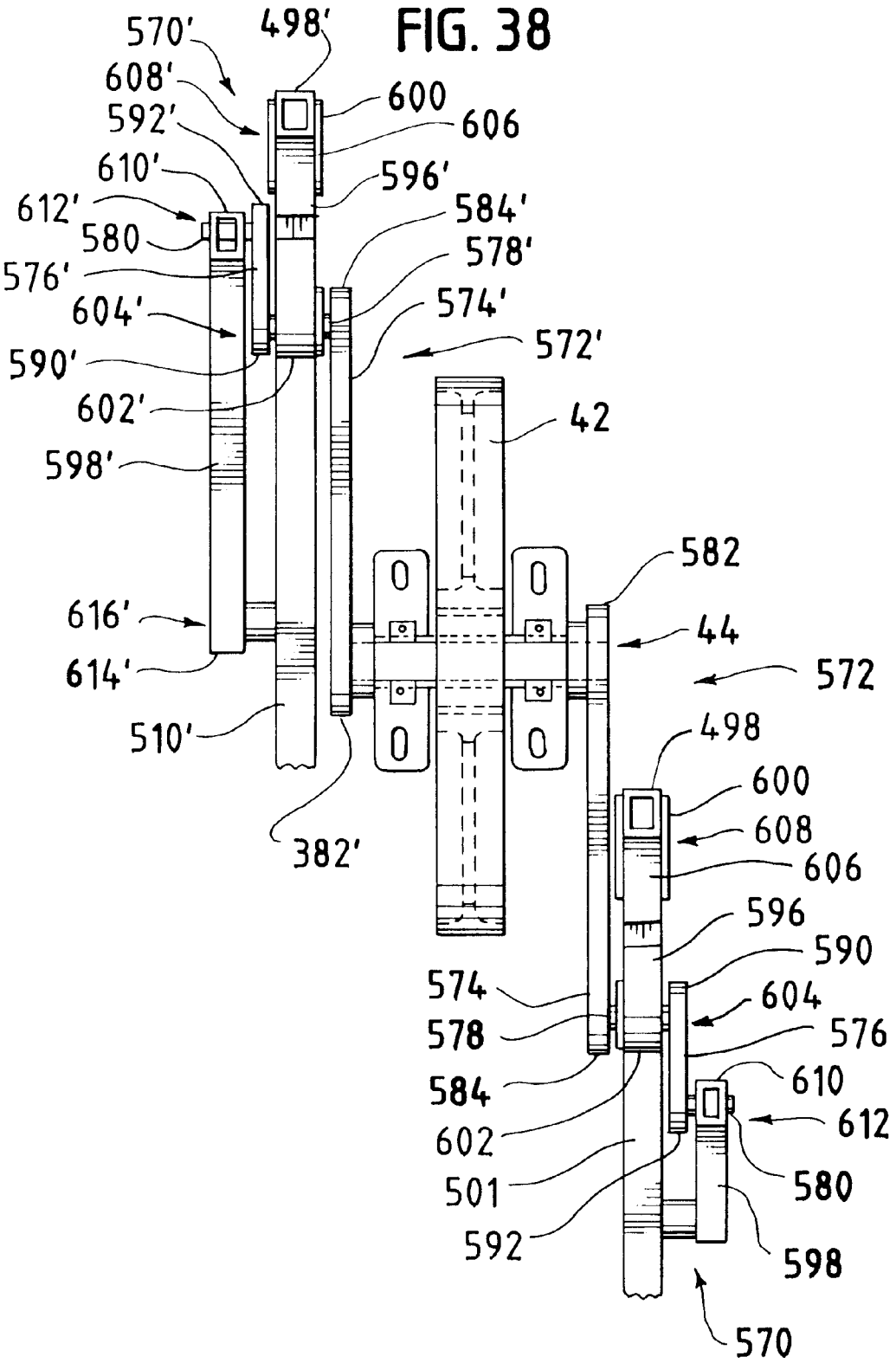
FIG. 38 is an enlarged side view of the ellipse generator and the offset coupling assembly in FIG. 36.

FIGS. 36–38 show alternative and preferred embodiments of an ellipse generator 570 and an offset coupling assembly 572. As best seen in FIGS. 37 and 38, the offset coupling assembly 572, like the previous embodiments 274 and 440, includes two crank arms 574 and 576 and two axles 578 and 580. A first end 582 of the first crank arm 574 is secured to the pulley pivot axis 44. The first axle 578 is secured to the first crank arm 574 proximate a second end 584 thereof and is substantially perpendicular to the first crank arm 574. As the pulley 42 rotates, the first axle 578 traces a first generally circular path 588 (shown in FIGS. 36, 37, and 39A–39D). A first end 590 of the second crank arm 576 is secured to the first axle 578. The second axle 580 is secured to the second crank arm 576 proximate a second end 592 thereof and is substantially perpendicular to the second crank arm 576. The second axle 580 traces a second generally circular path 594 (shown in FIGS. 36, 37, and 39A–39D) as the pulley 42 rotates. The diameter of the second circular path 594 preferably is larger than the diameter of the first circular path 588. The ellipse generator 570 includes two connecting rods 596 and 598 and a bracket 600. A first end 602 of the first connecting rod 596 is pivotally coupled to the first axle 578 to define a first pivot point 604. A second end 606 of the first connecting rod 596 is pivotally coupled to the bracket 600 to define a second pivot point 608. The bracket 600 is fixedly secured to the first end 498 of the pedal bar 444, near the curved portion 501 (shown in FIG. 36, 37, and 39A–39D). A first end 610 of the second connecting rod 598 is pivotally coupled to the second axle 580 to define a third pivot point 612. A second end 614 of the second connecting rod 598 is pivotally coupled to the pedal bar 444 to define a fourth pivot point 616.

The distances between the pivot points 604, 608, 612, and 616 define a four-bar linkage which, together with the circular paths 588 and 594 traced by the first axle 578 and the second axle 580, causes the first end 498 of the pedal bar 444 to trace a substantially elliptical path 618 (shown in FIGS. 36, 37, and 39A–39D) about the pulley pivot axis 44. Specifically, a first link 620 (shown in dashed line in FIG. 37) is defined by the distance between the first pivot point 604 and the second pivot point 608 and in the preferred embodiment is about 4 inches long. The first link 620 is also a portion of the first connecting rod 596. A second link 622 (shown in dashed line in FIG. 37) is defined by the distance between the second pivot point 608 and the fourth pivot point 616 and preferably is about 14.4 inches long. The second link 622 is a portion of the curved portion 501 of the pedal bar 444. A third link 624 (shown in dashed line in FIG. 37) is defined by the distance between the fourth pivot point 616 and the third pivot point 612 and preferably is about 14 inches long. The third link 624 is a portion of the second connecting rod 598. A fourth link 626 (shown in dashed line in FIG. 37) is defined by the distance between the third pivot point 612 and the first pivot point 604 and is preferably about 2.3 inches long. The fourth link 626 is a portion of the second crank arm 576. The vertical dimension of the elliptical path 618 traced by the first end 498 of the pedal bar 444 is determined by the length of the first link 620 together with the diameter of the first circular path 588 (shown in FIGS. 36, 37, and 39A–39D). The horizontal dimension of the ellipse 618 is determined by the length of the third link 624 together with the diameter of the second circular path 594. If the first link 620, the second link 622, the third link 624, and the pedal bar 444 were infinitely long, the ellipse 618 would be a perfect ellipse. However, the limited dimensions of the first and third links 620 and 624, coupled with the relative shortness of the first link 620, cause the shape of the ellipse 618 to be distorted slightly. As shown in FIG. 36, the pedal bar 444 couples the pedal 56 to the ellipse generator 570 and transmits the generated elliptical motion to the pedal 56 so that the pedal 56 traces a substantially elliptical path 628 (shown in FIGS. 36 and 39A–39D).

The movement of the pedal 56 is now discussed with reference to FIGS. 39A–39D. As the pulley 42 (not shown) rotates about the pivot axis 44, the first axle 578 and the second axle 580 move along the circular paths, 588 and 594 respectively and thereby move the second end 500 of the pedal bar 444 back and forth along a reciprocating linear path 630. As previously noted, the apparatus 436 can be operated in both a forward-stepping mode and in a backward stepping mode. When the apparatus 438 is operated in the forward-stepping mode, the pedal 56 travels in the sequence illustrated in FIGS. 39A–39D. When the apparatus is operated in the backward-stepping mode, the sequence is reversed so that the pedal moves from the position shown in FIG. 39A to that shown in FIG. 39D. In either mode, the pedal bar 444 transmits the elliptical motion 618 which is generated about the pivot axis 44 to the pedal 56 which consequently moves along the elliptical path 628. It should be noted that the elliptical path 628 followed by the pedal 56 is not identical with the elliptical path 618 generated at the pulley axis 44. The vertical constraint of the second end 500 of the pedal bar 444 causes the shape of the ellipse 628 to be more uniformly elliptical. In addition, the angle 504 (shown in FIG. 36) between the elongated member 496 and the vertical member 502 of the pedal bar 444 and the angle 509 (shown in FIG. 36) between the top surface 162 of the pedal 56 and the vertical member 502 influence the manner in which the user's weight is distributed on the pedal 56 as the pedal moves in the elliptical path 628. Specifically, a varying angular displacement 632 between the top surface 162 of the pedal 56 and the reference plane 384 is generated as the pedal 56 moves in the elliptical path 628. The varying angular displacement 632 helps to provide a weight distribution and flexure that simulates a normal, non-assisted gait. The movement of the pedal 56 along the elliptical path 628 also generates a varying linear displacement 634 between the point 388 on the top surface 162 of the pedal 56 and the reference plane 384. The magnitude of the change in the vertical displacement 634 affects the amount of effort required by the user to complete a stepping-motion; the greater the changes in the vertical displacement 634, the more rigorous the work-out.

Figure 39A:
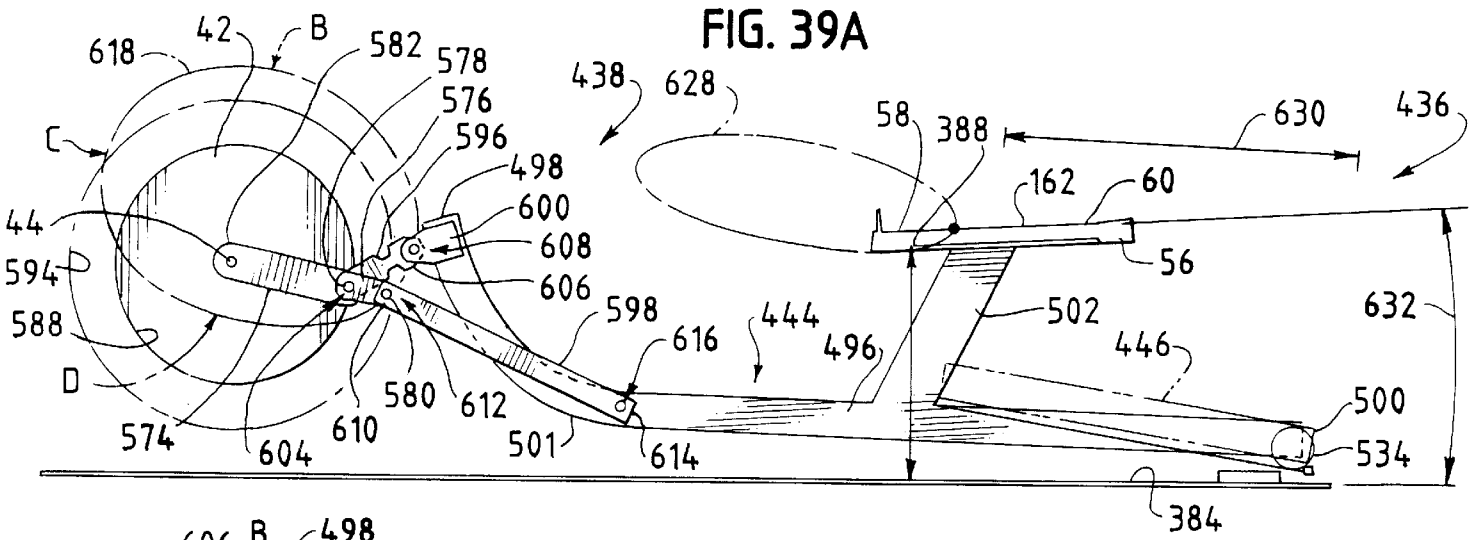
FIGS. 39A–39D are schematic representations of the reciprocating movement of the second end of the pedal bar of the apparatus shown in FIG. 36.

Beginning in FIG. 39A, the second end 500 of the pedal bar 444 is at the rearmost position along the reciprocating linear path 630 and first end 498 of the pedal bar 444 is located along the ellipse 618 at position A. At this point, the angular displacement 632 between the top surface 162 of the pedal 56 and the reference plane 384 is about +0.8° and the linear displacement 634 between the point 388 and the reference plane 384 is about 15.6 inches. Forward rotation of the pulley on the pivot axis 44 by about 90° moves the pedal 56 along the elliptical path 628 to the position shown in FIG. 39B. The second end 500 of the pedal bar 444 has advanced along the fixed, inclined track 446 toward the pivot axis 44 by about one-half of the reciprocating linear path 630 and the first end 498 of the pedal bar 444 has moved along the ellipse 618 to position B. At this point the angular displacement 632 between the top surface 162 of the pedal 56 and the reference plane 384 is about −10.7° and the linear displacement 634 between the point 388 and the plane 384 is about 20 inches. The change in the angular displacement from about +0.80 to about −10.7° corresponds to a flexure in which the toe portion 58 is being raised above the heel portion 60. An additional forward rotation of the pulley 42 on the pivot axis 44 by about another 90° moves the pedal 56 along the elliptical path 628 to the position shown in FIG. 39C. The second end 500 of the pedal bar 444 has traveled the entire distance along reciprocating linear path 630 towards the pivot axis 44 and the first end 498 of the pedal bar 444 has moved along the ellipse 618 to position C. At this point the angular displacement 632 is about 3° and the linear displacement 634 is about 19 inches. An additional forward rotation of the pulley 42 on the pivot axis 44 by about another 90° moves the pedal 56 along the elliptical path 628 to the position shown in FIG. 39D. The second end 500 of the pedal bar 444 has moved backwards along the inclined track 446, away from the pivot axis 44, until the second end 500 is about one-half the distance between the frontmost and rearmost positions of the reciprocating linear path. Concurrently, the first end 498 of the pedal bar 444 has moved along the ellipse 618 to position D. At this point the angular displacement between the top surface 162 of the pedal 56 and the reference plane 384 is about 5° and the linear displacement 634 between the ball point 388 and the reference plane 384 is about 15 inches. An additional forward rotation of the pulley 42 about the pivot axis 44 by about 90° completes the forward stepping motion along the elliptical path 628 and brings the second end 500 of the pedal bar 444 back to the rearmost position along the reciprocating linear path 630 and brings the pedal 56 back to the position shown in FIG. 39A.

Figure 39B:
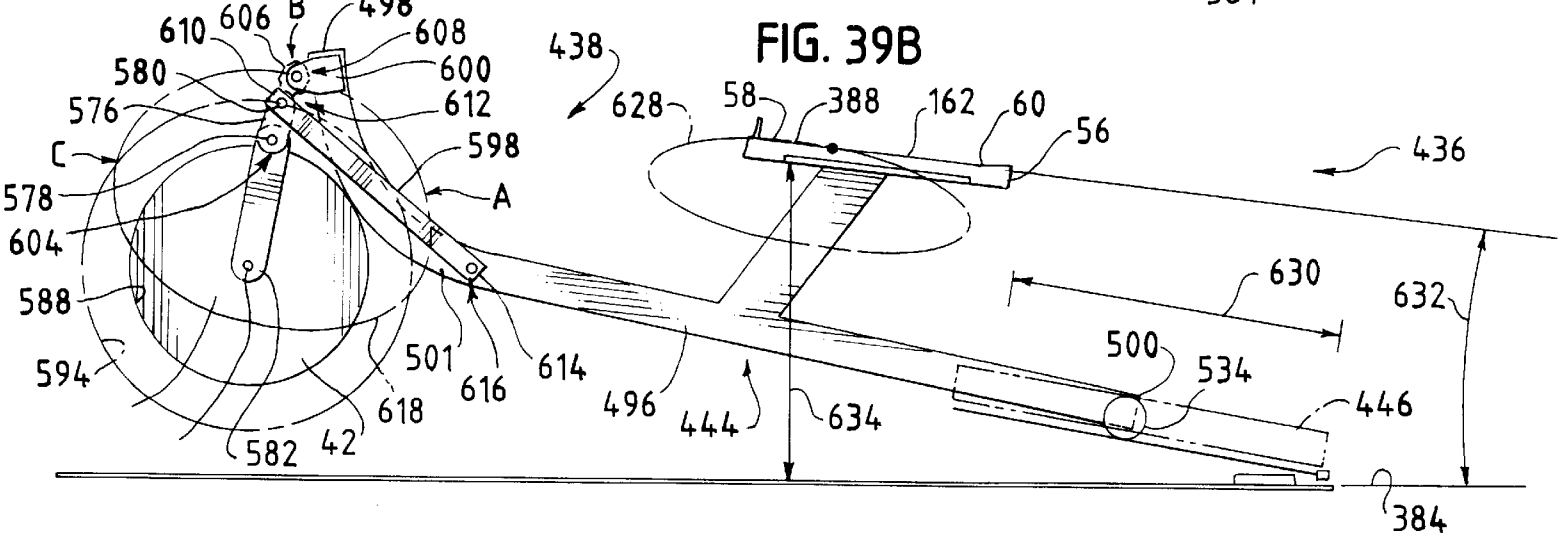
Figure 39C:
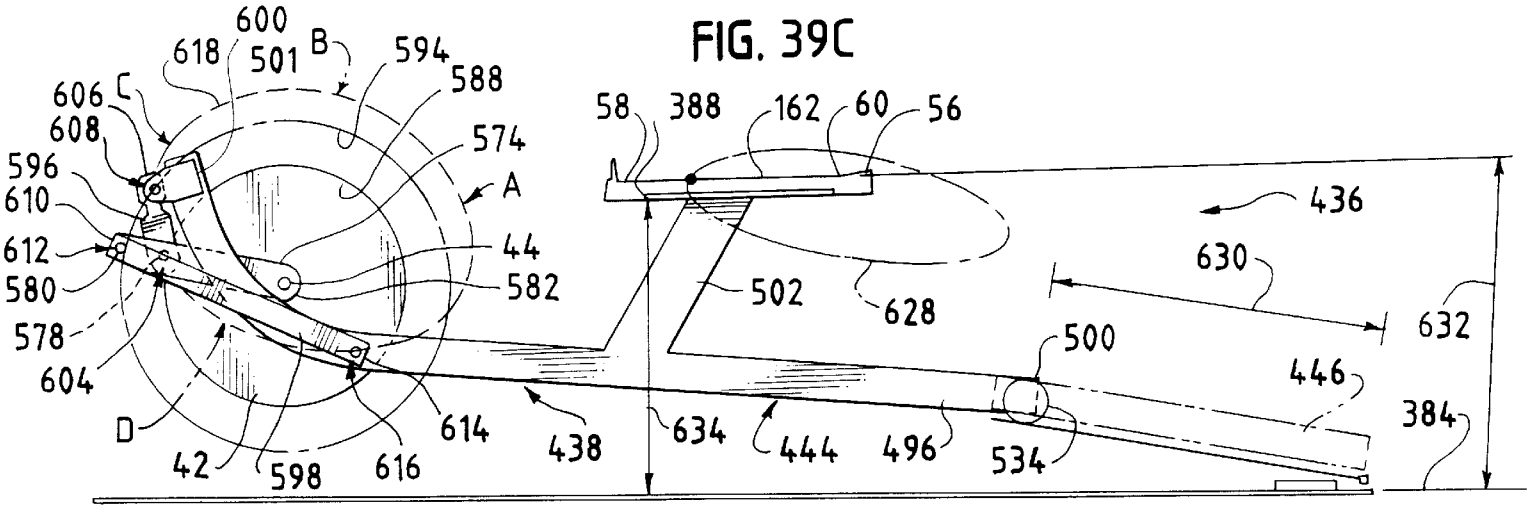
Figure 39D:
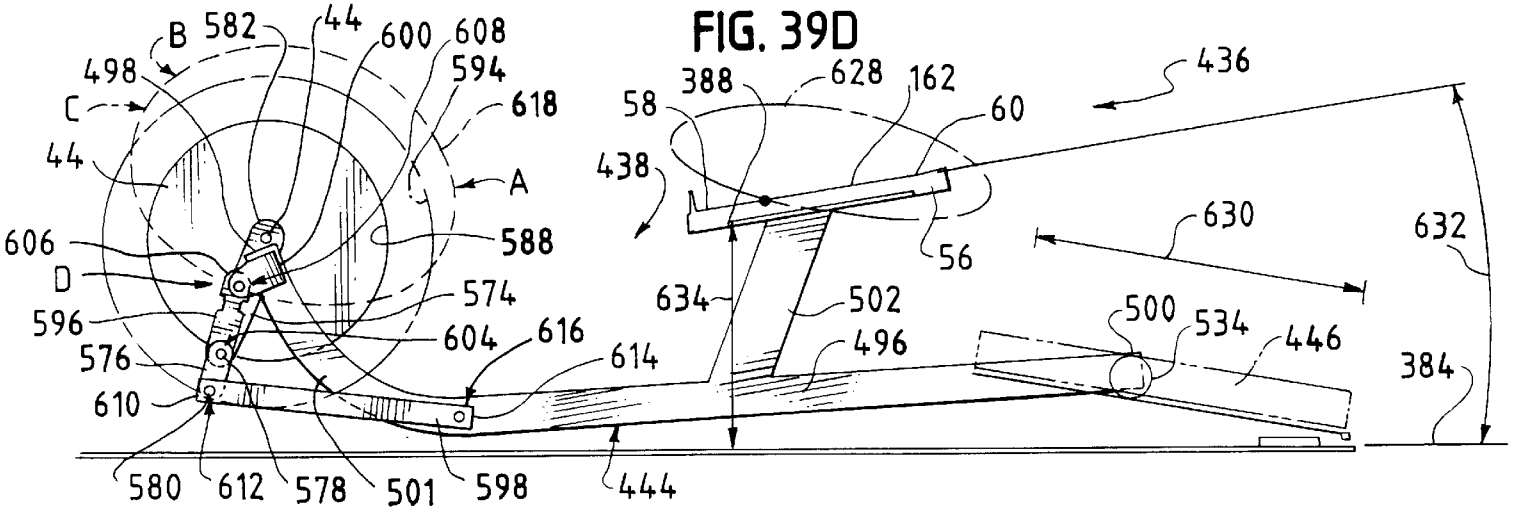

It can thus be seen that the ellipse generator 570 and the other components of the pedal actuation assembly 438 produce an pedal motion that simulates a normal, non-assisted gait. As the user begins the forward stepping motion, the pedal 56 moves upwards along the elliptical path 628, for example, from position A to position B, and concurrently the heel portion 60 is lowered below the toe portion 58, as shown in FIG. 39B, in a manner that simulates the flexure which occurs when the user begins a non-assisted forward stepping motion. As the pedal 56 continues moving forward along the elliptical path 628, for example, from position B to position C, the heel portion 60 begins to rise, relative to the toe portion 58. In the second part of the forward-stepping motion, the pedal 56 moves downward along the elliptical path 628, for example, from position C to position D, and concurrently the heel portion 60 is raised even further above the toe portion 58 as shown in FIG. 39D. The elevation of the heel portion 60 relative to the toe portion 58 simulates a flexure that would occur if the user were completing a normal, non-assisted forward stepping motion. The preferred embodiment of the device 436 thus provides an elliptical stepping motion that simulates a natural heel to toe flexure.

It should be noted that the use of an ellipse generating mechanism, such as the ellipse generator 442 or the ellipse generator 570, connected to a pedal mechanism, such as the pedal bar 444 and pedal 56, which reciprocates in a track, such as track 446, provides a particularly effective method of generating a generally elliptical pedal motion. Ellipse generators, other than the ellipse generator 442 or the ellipse generator 570, can also be connected to a reciprocating pedal mechanism to provide the desired pedal motion. For example, a cycloid ellipse generator could be used instead of either the ellipse generator 442 or the ellipse generator 570.

The preferred embodiment of the cross training apparatus 436 can use the same programs as the previously described apparatus 30 and 270. If the user employs the moving arm 68, the exercise apparatus 436 exercises the user's upper body concurrently with the user's lower body thereby providing a cross training workout. Alternatively, the user can concentrate his exercise session on his lower body by using the handrails 66. The exercise apparatus 436 thus provides a wide variety of exercise programs that can be tailored to the specific needs and desires of individual users, and consequently, enhances exercise efficiency and promotes a pleasurable exercise experience.

Although the present invention has been described with reference to specific embodiments thereof, it will be understood that various changes and modifications will be suggested to one skilled in the art and it is intended that the invention encompass such changes and modifications as fall within the scope of the appended claims.

We claim:

1. An exercise apparatus, comprising:

a frame adapted for placement on the floor;

a pivot axle attached to said frame;

a track secured to said frame in a generally horizontal orientation;

a pedal mechanism including a pedal bar slidably connected to said track at a first end of said pedal bar to permit movement of said first end of said pedal bar in a direction substantially parallel to said track and a pedal secured to said pedal bar; and an ellipse generator, including: a first crank arm connected at a first end to said pivot axle; first connecting means for connecting a second end of said first crank arm to a first point on said pedal bar proximate to said second end of said pedal bar; a second crank arm secured at a first end to said second end of said first crank arm; and second connecting means for connecting a second end of said second crank arm to a second point on said pedal bar between said first point and said first end of said pedal bar, resulting in the movement of said second end of said pedal bar in a first generally elliptical path and movement of said pedal in a second generally elliptical path as said first and second crank arms rotates about said pivot axle.

2. The apparatus of claim 1 wherein said first connecting means includes a first connecting member having a first end pivotally connected to said second end of said first crank arm and having a second end pivotally connected to said first point of said pedal bar.

3. The apparatus of claim 2 wherein said first connection means additionally includes a bracket secured to said first point of said pedal bar and pivotally connected to said first end of said first connecting member.

4. The apparatus of claim 2 wherein said second connection means includes a second connecting member having a first end pivotally connected to said second end of said second crank arm and having a second end pivotally connected to said second point on said pedal bar.

5. The apparatus of claim 1 wherein said first point on said pedal bar is located closer to said second end of said pedal bar than said second point on said pedal bar.

6. The apparatus of claim 5 wherein said pedal bar is curved approximately between said second and said first points on said pedal bar.

7. The apparatus of claim 1 wherein said second crank arm is spaced laterally from said first crank arm.

8. The apparatus of claim 7 wherein said second crank arm is aligned in parallel with said first crank arm.

9. The apparatus of claim 1 wherein said pedal has a toe and a heel portion with said toe portion located toward said pivot axle.

10. The apparatus of claim 9 wherein said pedal bar includes:

a first elongated member having a top surface ; and a pedal support member extending upward from and secured to said first elongated member wherein said pedal is secured to said pedal support member.

11. An exercise apparatus, comprising:

a frame adapted for placement on the floor;

a pivot axle attached to said frame;

a track secured to said frame in a generally horizontal orientation;

a pedal mechanism including a pedal bar slidably connected to said track at a first end of said pedal bar to permit said first end to move parallel to said track and a pedal having a toe and a heel portion with said toe portion located toward said pivot axle and wherein said pedal is secured to said pedal bar; and an ellipse generator, including: a crank arm secured to said pivot axle; first connecting means for connecting said crank arm at a first point on said pedal bar proximate to said second end of said pedal bar such that said second end of said pedal bar said rotates about said pivot axle in a first generally elliptically shaped path; and second connecting means for connecting said crank arm to a second point on said pedal bar, resulting in the movement of said pedal in a second generally elliptically shaped path as said first and second crank arms rotates about said pivot axle.

12. The apparatus of claim 11 wherein said second connection means includes a first connecting member pivotally connected between said crank arm and said second point on said pedal bar.

13. The apparatus of claim 12 wherein said first connecting means includes a second connecting member pivotally connected between said crank arm and to said first point of said pedal bar.

14. An exercise apparatus, comprising:

a frame adapted for placement on the floor;

a track secured to said frame;

a pedal mechanism including a pedal bar having a first end slidably connected to said track; and a pedal secured to said pedal bar; and an ellipse generator connected to a second end of said pedal bar so as to produce both a reciprocating motion of said first end of said pedal bar along said track and a generally elliptical motion of said second end of said pedal bar resulting in the movement of said pedal in a generally elliptically shaped path wherein said pedal is secured to said pedal bar intermediate said first end of said pedal bar and said ellipse generator.

15. The apparatus of claim 14 wherein said pedal is located on said pedal mechanism such that a toe portion is intermediate a heel portion of said pedal and said ellipse generator and said heel portion is raised above said toe portion when said pedal mechanism moves along said track in a direction away from said ellipse generator.

16. The apparatus of claim 15 wherein said pedal bar includes:

a first elongated member having a top surface ; and a pedal support member extending upward from and secured to said first elongated member wherein said pedal is secured to said pedal support member.

17. An exercise apparatus, comprising:

a frame adapted for placement on the floor;

a pivot axle supported by said frame;

a pedal bar having first and second ends;

a pedal secured to said pedal bar;

an ellipse generator secured to said pivot axle and to said first end of said pedal bar such that said first end of said pedal bar moves in a first generally elliptically shaped path around said pivot axle; and a track secured to said frame and engaging a second end of said pedal bar such that said second end moves in a linear reciprocating path as said first end of said pedal bar moves in said elliptical path around said pivot axle resulting in a second generally elliptically shaped motion of said pedal.

18. The apparatus of claim 17 further including an arm handle and link coupling means for coupling said arm handles to said pedal such that said arm handle moves in synchronism with said pedal.

19. The apparatus of claim 17 wherein said ellipse generator includes a first guide and a second guide.

20. The apparatus of claim 19 wherein said ellipse generator includes:

a first crank arm secured to said pivot axle;

a first axle secured proximate to a second end of said first crank arm;

a second crank arm secured to said first axle;

a second axle secured proximate to a second end of said second crank arm;

a first roller rotationally secured to said first axle; and a second roller rotationally secured to said second axle.

21. The apparatus of claim 20 wherein said first guide includes first and second spacedapart bars forming a first channel and said second guide includes first and second spaced-apart bars forming a second channel wherein said first guide secured to said second guide such that said first and said second channels are substantially orthogonal to each other.

22. The apparatus of claim 21 wherein said first roller is located within said first channel and said second roller is located within said second channel.

23. The apparatus of claim 17 wherein said pedal bar includes:

a first elongated member having a top surface ; and a pedal support member extending upward from and secured to said first elongated member wherein said pedal is secured to said pedal support member.

* * * * *